US007845160B2

(12) United States Patent
Takubo

(10) Patent No.: US 7,845,160 B2
(45) Date of Patent: Dec. 7, 2010

(54) CONTROL DEVICE FOR INTERNAL COMBUSTION ENGINE

(75) Inventor: Hideki Takubo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 936 days.

(21) Appl. No.: 11/646,348

(22) Filed: Dec. 28, 2006

(65) Prior Publication Data

US 2007/0204596 A1 Sep. 6, 2007

(30) Foreign Application Priority Data

Mar. 1, 2006 (JP) ..... 2006-055182

(51) Int. Cl.
*F01N 5/00* (2006.01)
*F01N 3/00* (2006.01)
*F01N 3/10* (2006.01)

(52) U.S. Cl. ..... 60/285; 60/277; 60/299

(58) Field of Classification Search ..... 60/277, 60/285, 299, 276
See application file for complete search history.

(56) References Cited

U.S. PATENT DOCUMENTS

2002/0038177 A1 3/2002 Ishikawa et al.
2005/0204726 A1* 9/2005 Lewis ..... 60/285
2005/0284133 A1* 12/2005 Kerns et al. ..... 60/285

FOREIGN PATENT DOCUMENTS

| | | | |
|---|---|---|---|
| DE | 697 28 325 | T2 | 8/2004 |
| JP | 61-104137 | A | 5/1986 |
| JP | 63-195351 | A | 8/1988 |
| JP | 2000-097081 | A | 4/2000 |
| JP | 2001-304018 | A | 10/2001 |
| JP | 2002-070625 | A | 3/2002 |
| JP | 2002-227690 | A | 8/2002 |
| JP | 2004-044444 | A | 2/2004 |
| JP | 2005-248914 | A | 9/2005 |

* cited by examiner

*Primary Examiner*—Thomas E Denion
*Assistant Examiner*—Michael Carton
(74) *Attorney, Agent, or Firm*—Sughrue Mion, PLLC

(57) ABSTRACT

Provided is a control device for an internal combustion engine, which can enable stable and fine control of an average air/fuel ratio of an exhaust gas on the upstream side of a catalyst. The control device for an internal combustion engine includes: a catalytic converter; an upstream $O_2$ sensor to the upstream of the catalyst; a downstream $O_2$ sensor to the downstream of the catalyst; a first air/fuel ratio feedback control unit for controlling the air/fuel ratio of the exhaust gas based on an output value of the upstream $O_2$ sensor and a controlling constant group; a second air/fuel ratio feedback control unit for calculating a target average air/fuel ratio AFAVEobj based on the output value of the upstream $O_2$ sensor and an output target value VR2; and a conversion unit for calculating at least two controlling constants by using the target average air/fuel ratio AFAVEobj as a common index.

15 Claims, 37 Drawing Sheets t1
t2
t3
t4
t5
t6
t7
t8
VR1

V1

COMPARISON
LEAN
RICH
LEAN

F0
TDR

CDLY
0
TDL

F1
TDR
TDL
TDR

FAF
KIR
RSL
KIL
KIR
RSR
RSL
KIL

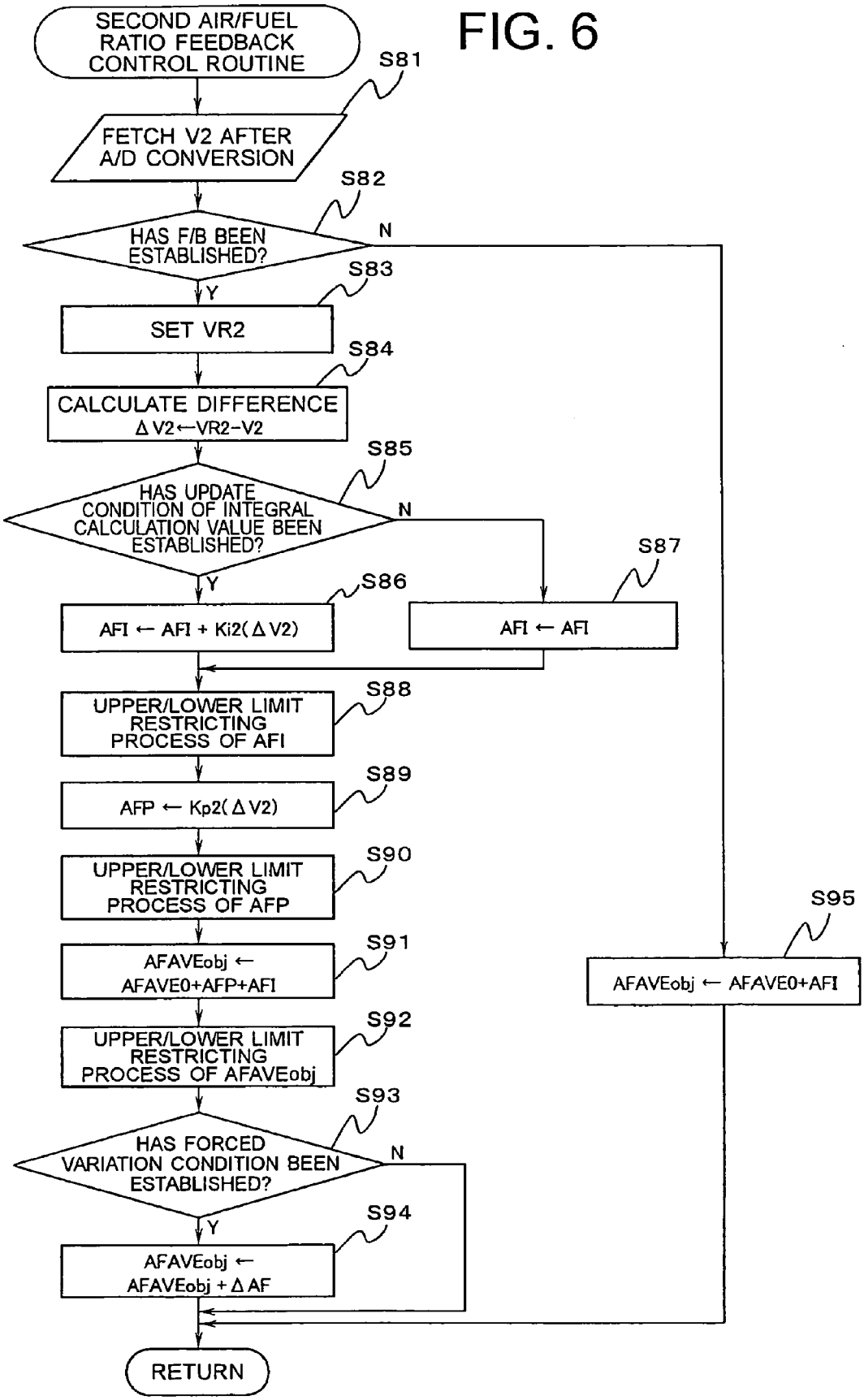
FIG. 6
SECOND AIR/FUEL RATIO FEEDBACK CONTROL ROUTINE
S81
FETCH V2 AFTER A/D CONVERSION
S82
HAS F/B BEEN ESTABLISHED?
N
Y
S83
SET VR2
S84
CALCULATE DIFFERENCE ΔV2←VR2−V2
S85
HAS UPDATE CONDITION OF INTEGRAL CALCULATION VALUE BEEN ESTABLISHED?
N
Y
S86
AFI ← AFI + Ki2(ΔV2)
S87
AFI ← AFI
S88
UPPER/LOWER LIMIT RESTRICTING PROCESS OF AFI
S89
AFP ← Kp2(ΔV2)
S90
UPPER/LOWER LIMIT RESTRICTING PROCESS OF AFP
S91
AFAVEobj ← AFAVE0+AFP+AFI
S92
UPPER/LOWER LIMIT RESTRICTING PROCESS OF AFAVEobj
S93
HAS FORCED VARIATION CONDITION BEEN ESTABLISHED?
N
Y
S94
AFAVEobj ← AFAVEobj + ΔAF
S95
AFAVEobj ← AFAVE0+AFI
RETURN

KIR/(KIR+KIL) = 0.2

KIR/(KIR+KIL) = 0.5

KIR/(KIR+KIL) = 0.8
RICH
V1
LEAN
F0
F1
FAF
A/F
VR1
CENTER
TDL
TDR
RICH
LEAN
KIR
KIL
RSL
RSR
AVERAGE AIR/FUEL RATIO IN ONE CONTROL CYCLE PERIOD
CONTROL AMOUNT
AMPLITUDE
AMPLI-TUDE
AVERAGE AIR/FUEL RATIO
CONTROL CYCLE

RSR/(RSR+RSL) = 0.2

RSR/(RSR+RSL) = 0.5

RSR/(RSR+RSL) = 0.8
RICH
V1
LEAN
VR1
RICH
F0
F1
TDL
TDR
RICH
LEAN
RICH
LEAN
CENTER
FAF
LEAN
RICH
KIR
KIL
RSL
RSR
CONTROL AMOUNT
AMPLITUDE
AMPLI-TUDE
CENTER
A/F
LEAN
AVERAGE AIR/FUEL RATIO
CONTROL CYCLE

VR1 = 0.25

VR1 = 0.45

VR1 = 0.65
RICH
V1
LEAN
VR1
F0
F1
RICH
FAF
LEAN
CENTER
RICH
A/F
LEAN
CENTER
TDL
RICH
LEAN
RICH
LEAN
TDR
RSL
KIR
RSR
KIL
CONTROL AMOUNT
AMPLITUDE
AMPLI-TUDE
AVERAGE AIR/FUEL RATIO
CONTROL CYCLE

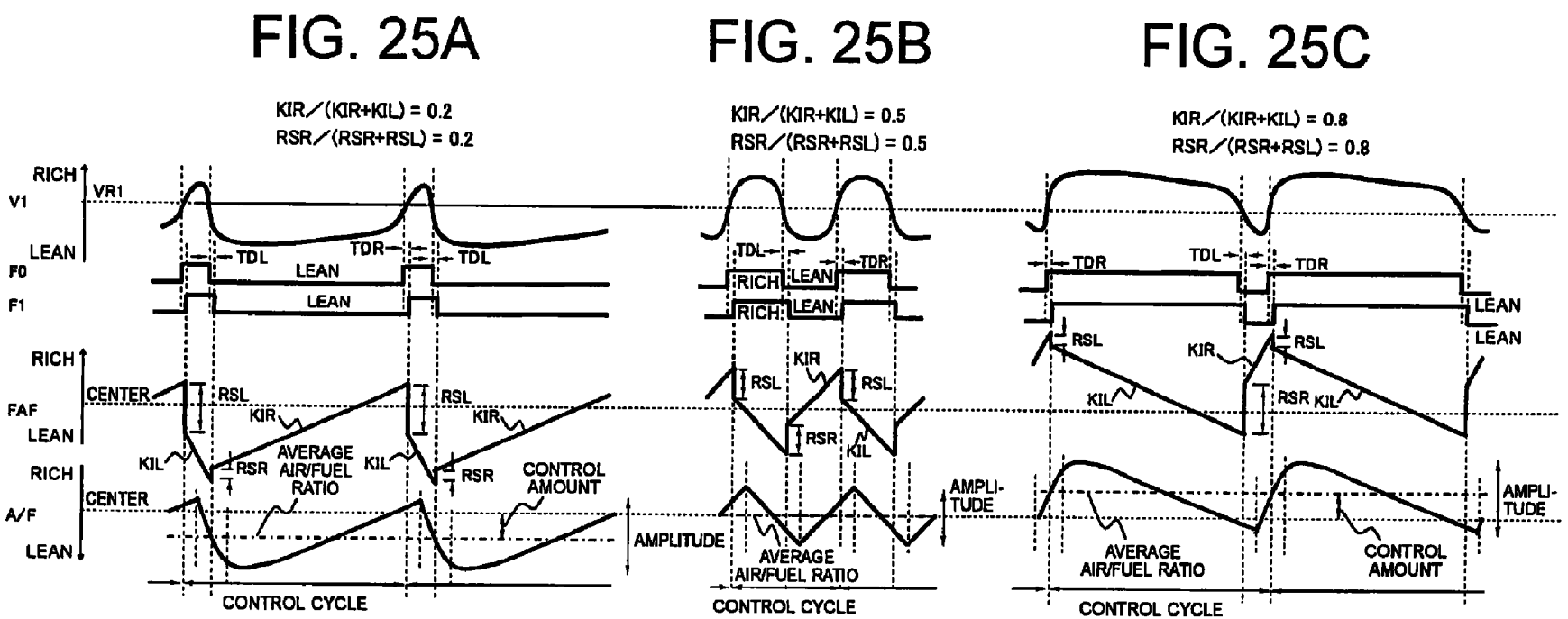
FIG. 25A
KIR/(KIR+KIL) = 0.2
RSR/(RSR+RSL) = 0.2
RICH
V1
VR1
LEAN
F0
F1
TDL
TDR
LEAN
LEAN
RSL
KIR
RSR
KIL
CENTER
RICH
FAF
LEAN
AVERAGE AIR/FUEL RATIO
CONTROL AMOUNT
RICH
A/F
LEAN
CONTROL CYCLE
FIG. 25B
KIR/(KIR+KIL) = 0.5
RSR/(RSR+RSL) = 0.5
TDL
TDR
RICH
LEAN
RICH
LEAN
RSL
KIR
RSR
KIL
AMPLITUDE
AVERAGE AIR/FUEL RATIO
CONTROL CYCLE
FIG. 25C
KIR/(KIR+KIL) = 0.8
RSR/(RSR+RSL) = 0.8
TDR
TDL
TDR
LEAN
LEAN
RSL
KIR
RSR
KIL
AMPLI-TUDE
CONTROL AMOUNT
AVERAGE AIR/FUEL RATIO
CONTROL CYCLE FIG. 34A
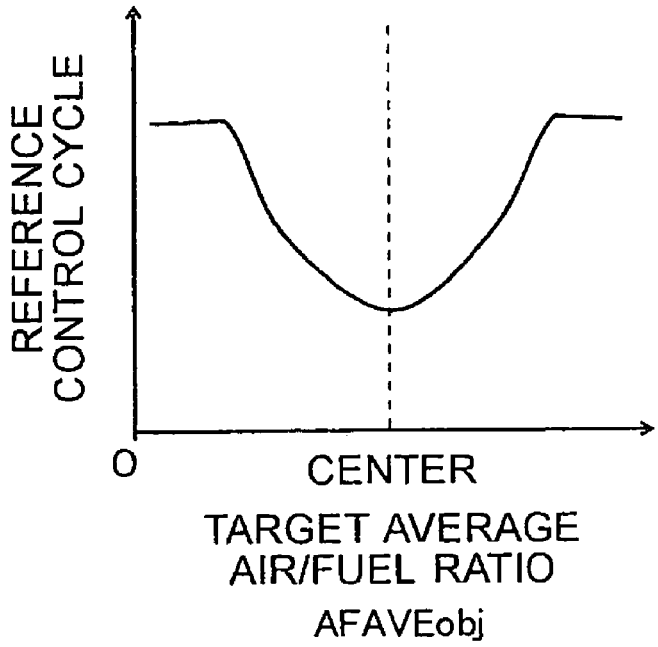
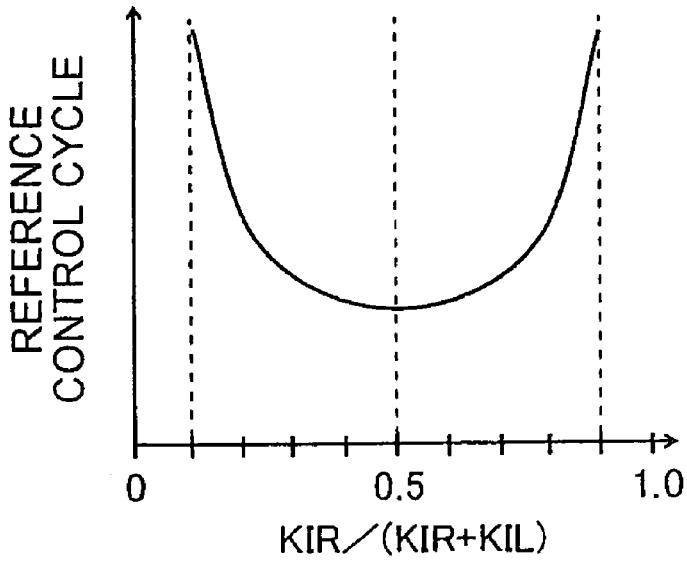
FIG. 34B

CONTROL DEVICE FOR INTERNAL COMBUSTION ENGINE

BACKGROUND OF THE INVENTION

1. Field of the Invention

The present invention relates to a control device for an internal combustion engine, for controlling an air/fuel ratio of an exhaust gas.

2. Related Background Art

In an exhaust path of a general internal combustion engine, a three-way catalyst for simultaneously cleaning HC, CO, and $NO_x$ contained in an exhaust gas is provided. The three-way catalyst exhibits a high cleaning rate for any of HC, CO, and $NO_x$ when an air/fuel ratio of the exhaust gas is in the vicinity of a stoichiometric air/fuel ratio.

Therefore, generally, an $O_2$ sensor (hereinafter, referred to as an "upstream $O_2$ sensor") is provided to an upstream side of the catalyst to perform feedback control based on an output from the upstream $O_2$ sensor so that the air/fuel ratio of the exhaust gas becomes closer to the stoichiometric air/fuel ratio.

However, the upstream $O_2$ sensor is provided in the exhaust path as close to a combustion chamber as possible, that is, is attached to a location where the exhaust manifolds are collectively provided. Therefore, the upstream $O_2$ sensor is exposed to the exhaust gas at a high temperature and is poisoned by various toxic substances. Moreover, since the exhaust gas is not sufficiently mixed at the location close to the combustion chamber, a variation occurs in air/fuel ratio of the exhaust gas.

Therefore, there is a problem in that the output from the upstream $O_2$ sensor greatly fluctuates, making it impossible to accurately control the air/fuel ratio of the exhaust gas.

In order to solve the above problem, a double-$O_2$ sensor system including an $O_2$ sensor (hereinafter, referred to as a "downstream $O_2$ sensor") provided to a downstream side of the catalyst in addition to the upstream $O_2$ sensor has been proposed.

In the double-$O_2$ sensor system, the feedback control is performed on the air/fuel ratio based on the output from the upstream $O_2$ sensor as described above. At the same time, the feedback control is also performed on the air/fuel ratio of the exhaust gas based on the output from the downstream $O_2$ sensor.

Although a response speed of the downstream $O_2$ sensor is lower than that of the upstream $O_2$ sensor, the passage of the exhaust gas through the catalyst lowers an exhaust temperature to reduce the effects of heat. In addition, toxic substances are absorbed by the catalyst to reduce the effects of the toxic substances. Moreover, since the exhaust gas is sufficiently mixed on the downstream side of the catalyst, the air/fuel ratio of the exhaust gas is equilibrated.

Therefore, the double-$O_2$ sensor system makes it possible to absorb an output fluctuation of the upstream $O_2$ sensor and keep high cleaning rate of catalyst by controlling the output of the downstream $O_2$ sensor to the target.

Moreover, oxygen storage capacity is imparted to the catalyst to absorb a temporary fluctuation in air/fuel ratio of the exhaust gas on the upstream side of the catalyst. The oxygen storage capacity plays a role of an integrator for taking in and storing oxygen in the exhaust gas when the air/fuel ratio of the exhaust gas is on the lean side of the stoichiometric air/fuel ratio and for releasing the stored oxygen when the air/fuel ratio of the exhaust gas is on the rich side of the stoichiometric air/fuel ratio.

Therefore, the fluctuations in air/fuel ratio on the upstream side of the catalyst are averaged in the catalyst, whereby an average air/fuel ratio acts on a catalyst cleaning state. Thus, in order to maintain a satisfactory cleaning rate of the catalyst, the output from the downstream $O_2$ sensor is used to control the average value of the air/fuel ratio of the exhaust gas on the upstream side of the catalyst.

A conventional air/fuel ratio control device for an internal combustion engine changes a controlling constant of feedback control using the output from the upstream $O_2$ sensor in accordance with the output from the downstream $O_2$ sensor to control the average air/fuel ratio on the upstream side (for example, see JP 63-195351 A).

In the above-described conventional device, as the controlling constant used for the feedback control (first air/fuel ratio feedback control means) using the output from the upstream $O_2$ sensor, at least one of a delay time, a skip amount, an integral constant, and a relative voltage is included. It is possible to control the average air/fuel ratio by setting each of the delay time, the skip amount, and the integral constant asymmetrically when air/fuel ratio is controlled on the rich side or the lean side, and also by changing the relative voltage.

Specifically, for example, by setting: the delay time on the rich side>the delay time on the lean side, the average air/fuel ratio shifts to the rich side. On the contrary, by setting: the delay time on the lean side>the delay time on the rich side, the average air/fuel ratio shifts to the lean side.

By setting: the skip amount on the rich side>the skip amount on the lean side, the average air/fuel ratio shifts to the rich side. On the contrary, by setting: the skip amount on the lean side>the skip amount on the rich side, the average air/fuel ratio shifts to the lean side.

In the same manner, by setting: the integral constant on the rich side>the integral constant on the lean side, the average air/fuel ratio shifts to the rich side. On the contrary, by setting: the integral constant on the lean side>the integral constant on the rich side, the average air/fuel ratio shifts to the lean side.

By increasing the relative voltage, the average air/fuel ratio shifts to the rich side. By decreasing the relative voltage, the average air/fuel ratio shifts to the lean side.

As described above, the above-described controlling constants are calculated based on the output from the downstream $O_2$ sensor to control the average air/fuel ratio of the exhaust gas on the upstream side of the catalyst for one control cycle.

Moreover, the simultaneous control of two or more of the above-described controlling constants to improve the controllability of the average air/fuel ratio has also been proposed.

In the above-described conventional device, however, a common management index is not set. Therefore, if merely two or more of the controlling constants are simultaneously controlled, a non-linear interaction occurs.

Therefore, when the air/fuel ratio of the exhaust gas on the upstream side of the catalyst is to be shifted to the lean side or the rich side, the control of the amount of shifting the average air/fuel ratio (a shift amount) becomes difficult even though the direction of shifting the average air/fuel ratio (a shift direction) can be controlled.

The above-mentioned non-linear interaction occurs by the mutual influences of changes of the controlling constants. Therefore, the shift amount of the average air/fuel ratio when two or more controlling constants are simultaneously controlled does not become equal to the result of a simple addition of the shift amounts when each of the controlling constants is controlled alone. The shift amount of the average air/fuel ratio is varied depending on the amount of control when each of the controlling constants is controlled, the combination and the points of operation of the controlling constants, the characteristics of a control target, which vary depending on operating conditions, or the like.

The non-linear interaction is also caused by the non-linear relation between the amount of control of each of the controlling constants and the shift amount of the average air/fuel ratio.

In the conventional control device for an internal combustion engine, the shift amount of the average air/fuel ratio varies depending on the amount of control of each of the controlling constants, the combination and the points of operation of the controlling constants, the operating conditions, and the like, which varies a gain of the feedback control.

Therefore, there arises a problem in that hunting or insufficient following occurs to destabilize the feedback control for controlling the average air/fuel ratio of the exhaust gas on the upstream side of the catalyst in accordance with the output of the downstream $O_2$ sensor.

Each controlling constants have each advantages and disadvantages for control of the average air/fuel ratio, such as, a control accuracy of the average air/fuel ratio, a control range of the average air/fuel ratio, a control cycle, control amplitude of the air/fuel ratio oscillation and the like.

It is conceivable to effectively combine the controlling constants to utilize each advantage and moderate each disadvantages.

In the conventional control device for an internal combustion engine, however, a common management index is not set.

Therefore, there is another problem in that the amount of control of the controlling constants or the combination of the constants cannot be determined in detail to maximize each advantage and suppress each disadvantage in accordance with the point of operation of the average air/fuel ratio.

SUMMARY OF THE INVENTION

The present invention has an object to solve the problems as described above and therefore to provide a control device for an internal combustion engine, which is capable of appropriately combining at least two or more controlling constants to stably and finely control an average air/fuel ratio of an exhaust gas on an upstream side of a catalyst.

A control device for an internal combustion engine according to an aspect of the present invention, includes: a catalyst provided in an exhaust system of the internal combustion engine, for cleaning an exhaust gas; a first air/fuel ratio sensor provided to an upstream side of the catalyst, for detecting an air/fuel ratio of the exhaust gas on the upstream side of the catalyst; a second air/fuel ratio sensor provided to a downstream side of the catalyst, for detecting an air/fuel ratio of the exhaust gas on the downstream side of the catalyst; a first air/fuel ratio feedback control means for controlling the air/fuel ratio of the exhaust gas on the upstream side of the catalyst based on an output value of the first air/fuel ratio sensor and a controlling constant group containing a plurality of controlling constants; a second air/fuel ratio feedback control means for calculating a target average air/fuel ratio corresponding to a target value of an average air/fuel ratio of the exhaust gas on the upstream side of the catalyst based on an output value of the second air/fuel ratio sensor and a predetermined output target value; and a conversion means for calculating at least two controlling constants by using the target average air/fuel ratio as a common index.

According to the control device for an internal combustion engine of the present invention, the second air/fuel ratio feedback control means calculates the target average air/fuel ratio corresponding to the target value of the average air/fuel ratio of the exhaust gas on the upstream side of the catalyst in accordance with the output value of the second air/fuel ratio sensor and the predetermined output target value, and the conversion means uses the target average air/fuel ratio as an index to calculate at least two controlling constants.

Therefore, the amount of control of the controlling constants or the combination thereof can be set in accordance with the target average air/fuel ratio, resulting in stable and accurate control of the air/fuel ratio of the exhaust gas on the upstream side of the catalyst.

By setting the controlling constants with the use of the target average air/fuel ratio as an index, appropriate controlling constants can be combined with each other in accordance with the point of operation of the average air/fuel ratio without changing the shift amount of the average air/fuel ratio to maximize the advantages of each of the controlling constants, such as a control accuracy of the average air/fuel ratio, a control range of the average air/fuel ratio, a control cycle, control amplitude of the air/fuel ratio oscillation.

BRIEF DESCRIPTION OF THE DRAWINGS

In the accompanying drawings:

FIG. 6 is a flowchart showing a control routine, in which a second air/fuel ratio feedback control means according to the first embodiment of the present invention calculates a target average air/fuel ratio in accordance with an output from the downstream $O_2$ sensor;

FIGS. 25A to 25C are timing charts showing the behavior of the first air/fuel ratio feedback control when the balance settings of the integral constants and the skip amounts according to the first embodiment of the present invention are simultaneously changed;

FIGS. 30A to 30D show characteristics of the integral constants with respect to the target average air/fuel ratio according to the first embodiment of the present invention, FIGS. 30E to 30H show characteristics of the delay times with respect to the target average air/fuel ratio according to the first embodiment of the present invention, and FIGS. 30I to 30K are explanatory views showing an actual average air/fuel ratio, the control cycle and the control amplitude of the air/fuel ratio for the target average air/fuel ratio according to the first embodiment of the present invention;

FIGS. 31A to 31D show characteristics of the integral constants with respect to the target average air/fuel ratio according to the first embodiment of the present invention, FIGS. 31E to 31H show characteristics of the delay times with respect to the target average air/fuel ratio according to the first embodiment of the present invention, and FIGS. 31I to 31K show the actual average air/fuel ratio, the control cycle and the control amplitude of the air/fuel ratio for the target average air/fuel ratio according to the first embodiment of the present invention;

FIGS. 32A to 32D show characteristics of the integral constants with respect to the target average air/fuel ratio according to the first embodiment of the present invention, FIGS. 32E to 32H show characteristics of the delay times with respect to the target average air/fuel ratio according to the first embodiment of the present invention, and FIGS. 32I to 32K show the actual average air/fuel ratio, the control cycle and the control amplitude of the air/fuel ratio for the target average air/fuel ratio according to the first embodiment of the present invention;

FIGS. 34A and 34B are explanatory views showing a reference control cycle calculated in Step S112 of FIG. 33;

DESCRIPTION OF THE PREFERRED EMBODIMENT

Figure 1:
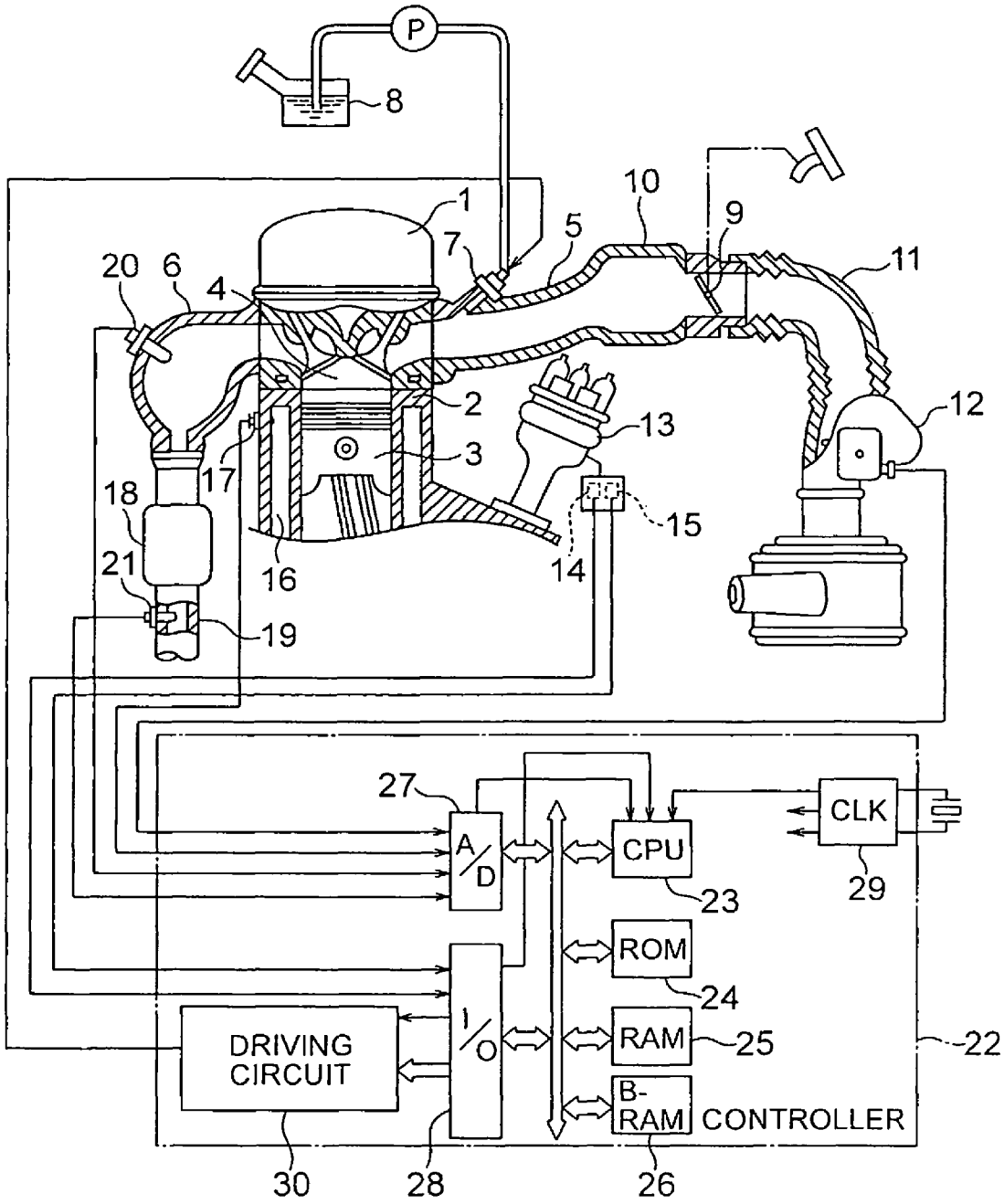
FIG. 1 is a configuration diagram showing the entire system including a control system for an internal combustion engine according to a first embodiment of the present invention.

Hereinafter, an embodiment of the present invention will be described with reference to the accompanying drawings. In each of the drawings, the same or corresponding members or parts are denoted by the same reference numerals for description.

In the following embodiment, the case where a control device for an internal combustion engine is installed on a vehicle will be described.

First Embodiment

FIG. 1 is a configuration diagram showing the entire system including a control device for an internal combustion engine according to the first embodiment of the present invention. Although a plurality of cylinders 2 are provided in a general internal combustion engine, only one of the cylinders 2 will be described in the following embodiment.

In FIG. 1, an engine main body 1 includes a combustion chamber 4 into which an air/fuel mixture is taken for combustion by a cylindrical cylinder 2 and a piston 3 connected to a crank shaft (not shown).

An intake port 5 for taking air into the cylinder 2 and an exhaust manifold 6 for exhausting an exhaust gas generated by the combustion of the air/fuel mixture in the combustion chamber 4 are connected to the cylinder 2. At the top of the cylinder 2, an ignition plug (not shown) for igniting the air/fuel mixture supplied to the combustion chamber 4 is attached.

On the downstream side of the intake port 5, a fuel injection valve 7 for injecting a fuel is attached. The fuel is supplied to the fuel injection valve 7 from a fuel tank 8 externally provided for the engine main body 1.

On the upstream side of the intake port 5, an intake manifold 10 for distributing air externally taken through a throttle valve 9 to each cylinder 2 is connected.

On the upstream side of the throttle valve 9, an intake path 11 through which the externally taken air passes is connected. On the downstream side of the throttle valve 9, a boost pressure sensor (not shown) for outputting a voltage signal in accordance with a boost pressure is provided.

An airflow meter 12 for detecting the quantity of externally taken air is provided for the intake path 11. The airflow meter 12 includes a hot wire to output an analog voltage signal proportional to an intake air quantity Aq.

A distributor 13 for distributing a high-voltage current to the ignition plug is provided for the cylinder 2. A rotor (not shown) of the distributor 13 is driven by a cam shaft (not shown).

A first crank angle sensor 14 for allowing the rotor to output a pulse signal for detecting a reference position at, for example, every 720 degrees of a crank angle and a second crank angle sensor 15 for allowing the rotor to output a pulse signal for detecting a reference position at every 30 degrees of a crank angle are provided for the distributor 13.

A water jacket 16 through which cooling water for cooling the engine main body 1 passes is provided for the cylinder 2. The water jacket 16 is provided with a water temperature sensor 17 for detecting a temperature of the cooling water. The water temperature sensor 17 outputs an analog voltage signal proportional to a cooling water temperature THW.

Downstream of the exhaust manifold 6, a catalytic converter (catalyst) 18 housing a three-way catalyst for cleaning the exhaust gas therein is provided. Downstream of the catalytic converter 18, an exhaust duct 19 for externally exhausting the exhaust gas is connected.

Upstream of the catalytic converter 18, that is, for the exhaust manifold 6, a first $O_2$ sensor (hereinafter, referred to as an "upstream $O_2$ sensor") 20 (first air/fuel ratio sensor) for outputting an analog voltage signal in accordance with the air/fuel ratio of the exhaust gas on the upstream side of the catalyst is provided.

Downstream of the catalytic converter 18, that is, for the exhaust duct 19, a second $O_2$ sensor (hereinafter, referred to as a "downstream $O_2$ sensor") 21 (second air/fuel ratio sensor) for outputting an analog voltage signal in accordance with the air/fuel ratio of the exhaust gas having passed through the catalytic converter 18 is provided.

Figure 2:
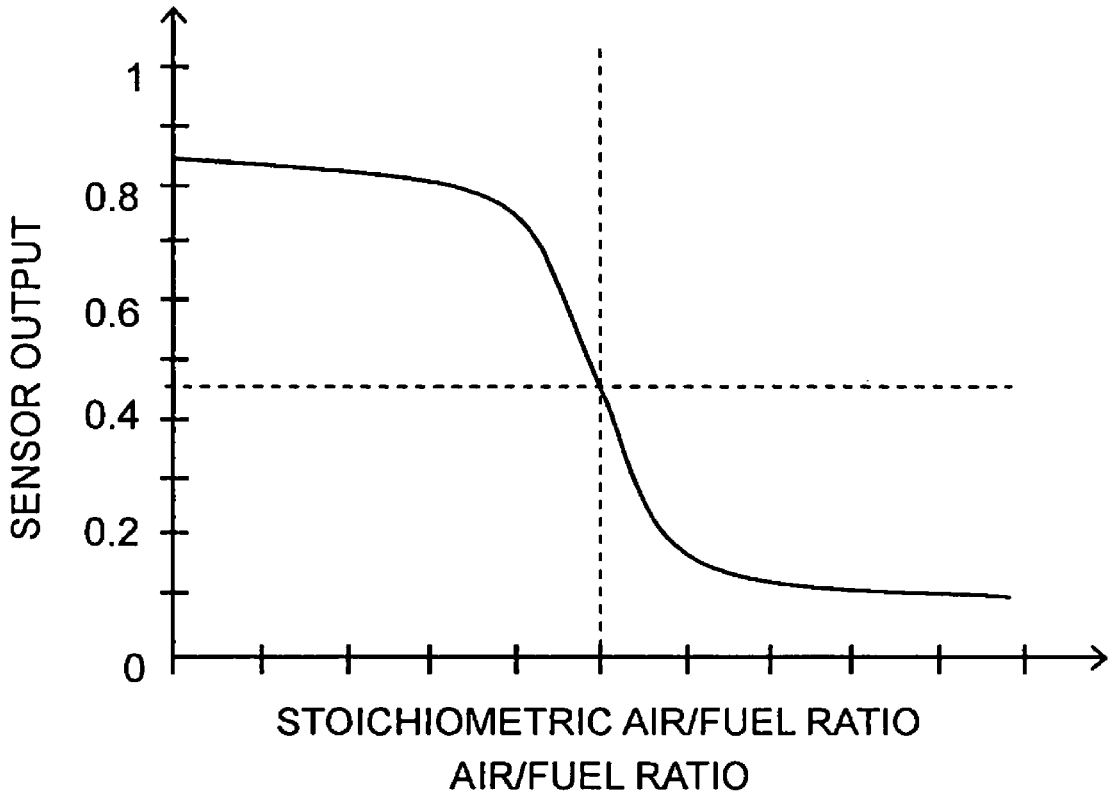
FIG. 2 is an explanatory view showing an output characteristic of an upstream $O_2$ sensor and a downstream $O_2$ sensor according to the first embodiment of the present invention.

Each of the first $O_2$ sensor 20 and the second $O_2$ sensor 21 is, as shown in FIG. 2, a $\lambda$-type $O_2$ sensor whose voltage suddenly changes in the vicinity of the stoichiometric air/fuel ratio AFS with respect to a change in air/fuel ratio to provide a binary output characteristic.

A fuel injection operation of the fuel injection valve 7 is controlled by a controller 22 constituting a principle part of the control device for the internal combustion engine.

The controller 22 is constituted by, for example, a microcomputer. The controller 22 includes: a CPU 23 for executing a calculation processing; a ROM 24 for storing program data or fixed-value data; a RAM 25 whose stored data is rewritable; a backup RAM 26 supplied with electric power from a battery (not shown) provided for a vehicle to be capable of keeping the stored content even if the power of the control device for the internal combustion engine is off; an A/D converter 27 including a multiplexer; an I/O interface 28 for inputting and outputting various signals; a clock generator circuit 29 for generating an interrupt signal; and a driving circuit 30 for driving the fuel injection valve 7.

Various voltage signals from the boost pressure sensor, the airflow meter 12, the water temperature sensor 17, the upstream $O_2$ sensor 20, and the downstream $O_2$ sensor 21 are input to the A/D converter 27 of the controller 22.

Pulse signals from the first crank angle sensor 14 and the second crank angle sensor 15 are input to the I/O interface 28. The pulse signal from the second crank angle sensor 15 is further input to an interrupt terminal provided for the CPU 23.

When a fuel supply quantity Qfuel to be described below is calculated based on the above-described inputs, a driving signal is output from the driving circuit 30 to the fuel injection valve 7 to allow the fuel injection valve 7 to inject a fuel in accordance with the fuel supply quantity Qfuel.

An interrupt by the CPU 23 occurs when the A/D conversion is completed by the A/D converter 27, when the I/O interface 28 receives the pulse signal from the second crank angle sensor 15, when the I/O interface 28 receives the interrupt signal from the clock generator circuit 29, and other occasions.

The CPU 23 calculates a rotational speed Ne for each reception of a pulse signal from the second crank angle sensor 15 and stores the calculated rotational speed Ne in a predetermined area of the RAM 25.

The intake air quantity Aq detected by the airflow meter 12 and the cooling water temperature THW detected by the water temperature sensor 17 are fetched into an A/D conversion routine executed at each predetermined time to be stored in a predetermined area of the RAM 25 in a similar manner. Specifically, the intake air quantity Aq and the cooling water temperature THW stored in the RAM 25 are updated at each predetermined time.

Figure 3:
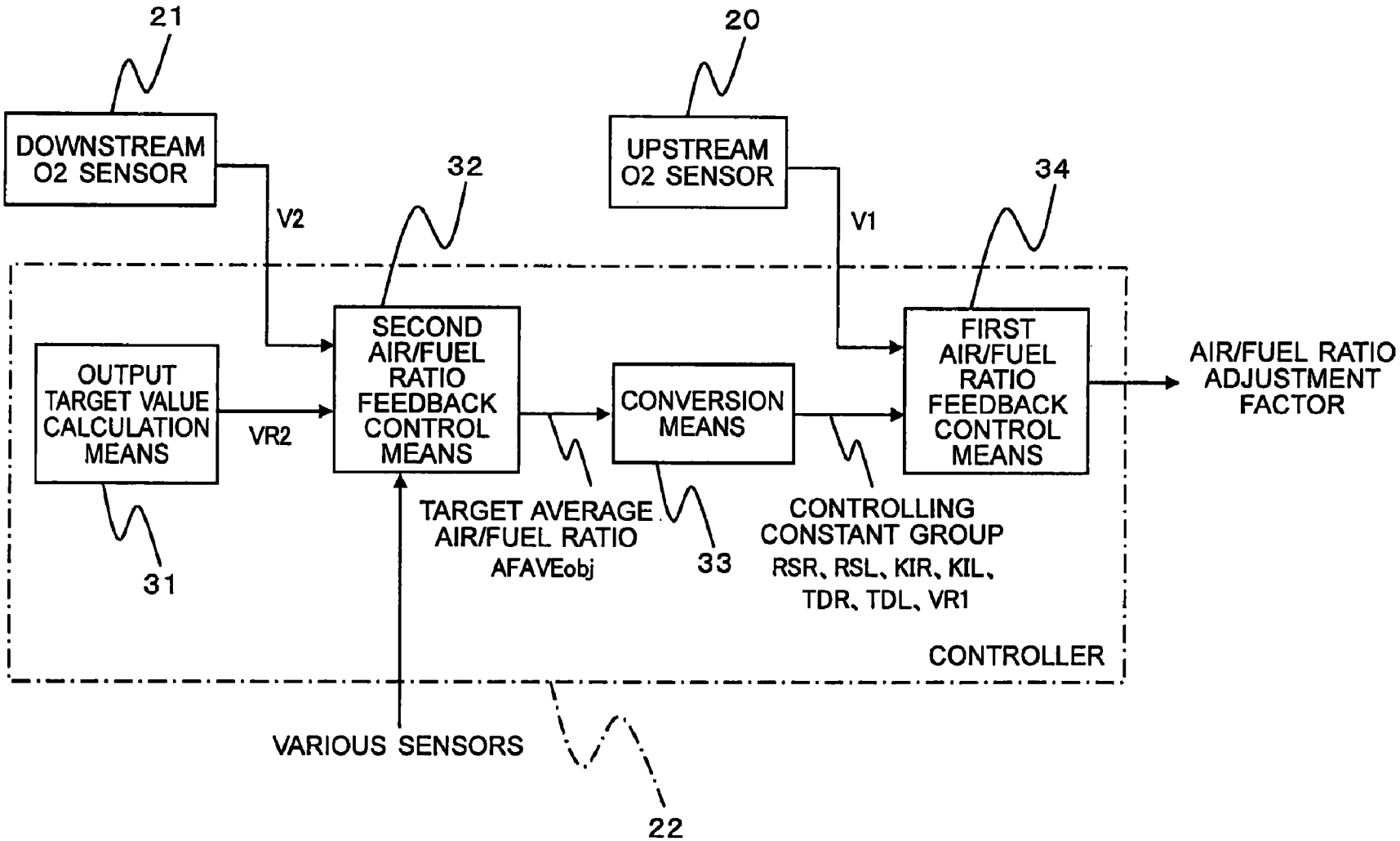
FIG. 3 is a block diagram showing a functional configuration of a controller according to the first embodiment of the present invention.

FIG. 3 is a block diagram showing a functional configuration of the controller 22 according to the first embodiment of the present invention. Each of the blocks other than the upstream $O_2$ sensor 20 and the downstream $O_2$ sensor 21 in FIG. 3 is stored in the ROM 24 as software.

In FIG. 3, the controller 22 includes: an output target value setting means 31; a second air/fuel ratio feedback control means 32; a conversion means 33; and a first air/fuel ratio feed back control means 34.

The output target value setting means 31 sets an output target value VR2 of the downstream $O_2$ sensor 21. The second air/fuel ratio feedback control means 32 executes second air/fuel ratio feedback control for calculating a target average air/fuel ratio AFAVEobj corresponding to a target value of an average air/fuel ratio AFAVE of the exhaust gas on the upstream side of the catalyst in accordance with a sensor output V2 from the downstream $O_2$ sensor 21 and the output target value VR2. Various sensors such as a vehicle speed sensor provided for the vehicle are connected to the second air/fuel ratio feedback control means 32.

The conversion means 33 calculates at least two controlling constants using the target average air/fuel ratio AFAVEobj as a common index. The first air/fuel ratio feedback control means 34 executes first air/fuel ratio feedback control for controlling the air/fuel ratio of the internal combustion engine in accordance with a sensor output V1 from the upstream $O_2$ sensor 20 and a controlling constant group containing a plurality of the above-described controlling constants.

The output target value VR2 is set to, for example, a predetermined voltage value in the vicinity of the stoichiometric air/fuel ratio AFS at which the cleaning capability of the three-way catalyst becomes high.

The controlling constants contain at least any two of the delay time, the skip amount, the integral constant, and the relative voltage.

Hereinafter, referring to a flowchart of FIG. 4 in addition to FIGS. 1 to 3, a first air/fuel ratio feedback control routine of the first air/fuel ratio feedback control means 34 for calculating a fuel adjustment factor FAF in accordance with the output from the upstream $O_2$ sensor 20 will be described.

The control routine is executed, for example, every five milliseconds.

First, the sensor output V1 from the upstream $O_2$ sensor 20 is subjected to the A/D conversion to be fetched in (Step S41). It is judged whether or not a closed-loop condition has been established to enable the execution of feedback control (Step S42).

The closed-loop condition is not established, for example, when the cooling water temperature THW is an arbitrary set predetermined value (for example, 60° C.) or lower, during the internal combustion engine start, during the increase in amount of fuel after the start of the internal combustion engine, during the increase in amount of fuel for warm-up, during the increase in power, in the case where the sensor output V1 from the upstream $O_2$ sensor 20 has never been inverted, during the stop of fuel supply, and the like. Otherwise, the closed-loop condition is established.

In Step S42, if it is judged that the closed-loop condition has been established (specifically, Yes), it is then judged whether or not the sensor output V1 from the upstream $O_2$ sensor 20 is equal to a relative voltage VR1 or lower (Step S43). Specifically, in this step, it is judged whether the air/fuel ratio of the exhaust gas on the upstream side of the catalytic converter 18 is on the rich side or the lean side with respect to the relative voltage VR1.

If it is judged in Step S43 that the sensor output V1 is equal to or lower than the relative voltage VR1 (specifically, Yes), it is judged whether the delay counter CDLY provided in the controller 22 indicates a rich delay time TDR (maximum value) or higher (Step S44).

Herein, the rich delay time (maximum value) is the rich delay time TDR for storing the determination that the sensor output V1 from the upstream $O_2$ sensor 20 is on the lean side even if the sensor output V1 is changed from the lean side to the rich side, and is defined as a positive number.

If it is judged in Step S44 that the delay counter CDLY indicates the rich delay time TDR (maximum value) or higher (specifically, Yes), the delay counter CDLY is set to "0" (Step S45). Then, a pre-delay air/fuel ratio flag F0 provided in the controller 22 is set to "0 (lean)" (Step S46). The process proceeds to Step S56.

On the other hand, if it is judged in Step S44 that the delay counter CDLY is smaller than the rich delay time TDR (maximum value) (specifically, No), it is then judged whether the pre-delay air/fuel ratio flag F0 is "0" or not (Step S47).

If it is judged in Step 47 that the pre-delay air/fuel ratio flag F0 is "0" (specifically, Yes), "1" is subtracted from the delay counter CDLY (Step S48). Then, the process proceeds to Step S56.

If it is judged in Step S47 that the pre-delay air/fuel ratio flag F0 is not "0" (specifically, No), "1" is added to the delay counter CDLY (Step S49). Then, the process proceeds to Step S56.

On the other hand, if it is judged in Step S43 that the sensor output V1 is higher than the relative voltage VR1 (specifically, No), it is then judged whether the delay counter CDLY is equal to or smaller than a minimum value TDLm (=−TDL) of the lean delay time TDL (Step S50).

The minimum value TDLm (=−TDL) of the lean delay time TDL is a lean delay time TDL for storing the judgment that the sensor output V1 from the upstream $O_2$ sensor 20 is on the rich side even if the sensor output V1 is changed from the rich side to the lean side, and is defined as a negative number.

If it is judged in Step S50 that the delay counter CDLY is equal to or smaller than the minimum value TDLm (specifically, Yes), the delay counter CDLY is set to "0" (Step S51). Then, after the pre-delay air/fuel ratio flag F0 is set to "1 (rich)" (Step S52), the process proceeds to Step S56.

On the other hand, if it is judged in Step S50 that the delay counter CDLY is larger than the minimum value TDLm (specifically, No), it is then judged whether the pre-delay air/fuel ratio flag F0 is "0" or not (Step S53).

If it is judged in Step S53 that the pre-delay air/fuel ratio flag F0 is "0" (specifically, Yes), "1" is subtracted from the delay counter CDLY (Step S54). Then, the process proceeds to Step S56.

If it is judged in Step S53 that the pre-delay air/fuel ratio flag F0 is not "0" (specifically, No), "1" is added to the delay counter CDLY (Step S55). Then, the process proceeds to Step S56.

Next, it is judged whether or not the delay counter CDLY is the minimum value TDLm or smaller (Step S56).

If it is judged in Step S56 that the delay counter CDLY is the minimum value TDLm or smaller (specifically, Yes), the delay counter CDLY is set to the minimum value TDLm (Step S57).

In Steps S56 and S57, the delay counter CDLY is guarded with the minimum value TDLm.

Subsequently, after setting a post-delay air/fuel ratio flag F1 provided in the controller 22 to "0" (Step S58), the process proceeds to Step S59.

On the other hand, if it is judged in Step S56 that the delay counter CDLY is larger than the minimum value TDLm (Specifically, No), the process immediately proceeds to Step S59.

Next, it is judged whether or not the delay counter CDLY is equal to or larger than the rich delay time TDR (maximum value) (Step S59).

If it is judged in Step S59 that the delay counter CDLY is equal to or larger than the rich delay time TDR (maximum value) (specifically, Yes), the delay counter CDLY is set to the rich delay time TDR (maximum value) (Step S60).

In this step, in Steps S59 and S60, the delay counter CDLY is guarded with the rich delay time TDR (maximum value).

Subsequently, after setting the post-delay air/fuel ratio flag F1 to "1" (Step S61), the process proceeds to Step S62.

On the other hand, if it is judged in Step S59 that the delay counter CDLY is smaller than the rich delay time TDR (maximum value) (specifically, No), the process immediately proceeds to Step S62.

Next, it is judged whether a sign of the post-delay air/fuel ratio flag F1 has been inverted or not (Step S62). Specifically, in this step, it is judged whether the air/fuel ratio after the delay process has been inverted or not.

If it is judged in Step S62 that the sign of the post-delay air/fuel ratio flag F1 has been inverted (specifically, Yes), it is then judged whether the post-delay air/fuel ratio flag F1 is "0" or not (Step S63). Specifically, it is judged in this step the inversion is performed from the rich side value to the lean side value or from the lean side value to the rich side value.

If it is judged in Step S63 that the post-delay air/fuel ratio flag F1 is "0" (specifically, Yes), a skip amount RSR is added to the fuel adjustment factor FAF (Step S64). Then, the process proceeds to Step S69.

On the other hand, if it is judged in Step S63 that the post-delay air/fuel ratio flag F1 is not "0" (specifically, No), a skip amount RSL is subtracted from the fuel adjustment factor FAF (Step S65). Then, the process proceeds to Step S69.

In this process, a skip process is executed using the skip amounts RSR and RSL.

On the other hand, if it is judged in Step S62 that the sign of the post-delay air/fuel ratio flag F1 has not been inverted (specifically, No), it is then judged whether the post-delay air/fuel ratio flag F1 is "0" or not (Step S66).

If it is judged in Step S66 that the post-delay air/fuel ratio flag F1 is "0" (specifically, Yes), an integral constant KIR is added to the fuel adjustment factor FAF (Step S67). Then, the process proceeds to Step S69.

On the other hand, if it is judged in Step S66 that the post-delay air/fuel ratio flag F1 is not "0" (specifically, No), an integral constant KIL is subtracted from the fuel adjustment factor FAF (Step S68). Then, the process proceeds to Step S69.

In this process, an integral process is executed using the integral constants KIR and KIL.

The integral constants KIR and KIL are set sufficiently smaller than the skip amounts RSR and RSL.

Therefore, the fuel adjustment factor FAF is gradually increased in a lean state in Step S67, whereas the fuel adjustment factor FAF is gradually degreased in a rich state in Step S68.

Next, it is judged whether or not the fuel adjustment factor FAF is smaller than "0.8" (Step S69).

If it is judged in Step S69 that the fuel adjustment factor FAF is smaller than "0.8" (specifically, Yes), the fuel adjustment factor FAF is set to "0.8" (Step S70). Then, the process proceeds to Step S71.

On the other hand, if it is judged in Step S69 that the fuel adjustment factor FAF is not smaller than "0.8" (specifically, No), the process immediately proceeds to Step S71.

In Steps S69 and S70, the minimum value of the fuel adjustment factor FAF is guarded with "0.8".

Subsequently, it is judged whether or not the fuel adjustment factor FAF is larger than "1.2" (Step S71).

If it is judged in Step S71 that the fuel adjustment factor FAF is larger than "1.2" (Specifically, Yes), the fuel adjustment factor FAF is set to "1.2" (Step S72) to be stored in the RAM 25. Then, the process shown in FIG. 4 is terminated (Step S80).

On the other hand, if it is judged in Step S71 that the fuel adjustment factor FAF is not larger than "1.2" (specifically, No), the fuel adjustment factor FAF is stored in the RAM 25. Then, the process shown in FIG. 4 is terminated (Step S80).

In Steps S71 and S72, the maximum value of the fuel adjustment factor FAF is guarded with "1.2".

The minimum value and the maximum value of the fuel adjustment factor FAF are guarded in Steps S69 to S72. As a result, if the fuel adjustment factor FAF becomes too small or too large for some reason, the air/fuel ratio of the exhaust gas on the upstream side of the catalytic converter 18 can be prevented from being overlean or overrich.

On the other hand, if it is judged in Step S42 that the closed-loop condition has not been established (specifically, No), the fuel adjustment factor FAF is set to "1.0" (Step S73). Then, the delay counter CDLY is set to "0" (Step S74). Subsequently, it is judged whether the sensor output V1 from the upstream $O_2$ sensor 20 is equal to or smaller than the relative voltage VR1 (Step S75).

If it is judged in Step S75 that the sensor output V1 is equal to or smaller than the relative voltage VR1 (specifically, Yes), the pre-delay air/fuel ratio flag F0 is set to "0" (Step S76). Then, after the post-delay air/fuel ratio flag F1 is set to "0" (Step S77), the fuel adjustment factor FAF is stored in the RAM 25 to terminate the process shown in FIG. 4 (Step S80).

On the other hand, if it is judged in Step S75 that the sensor output V1 is not equal to or smaller than the relative voltage VR1 (specifically, No), the pre-delay air/fuel ratio flag F0 is set to "1" (Step S78). After the post-delay air/fuel ratio flag F1 is set to "1" (Step S79), the fuel adjustment factor FAF is stored in the RAM 25 to terminate the process shown in FIG. 4 (Step S80).

Specifically, in Steps S73 to S79, the initial values obtained when the closed-loop condition is established are set.

Figure 4:
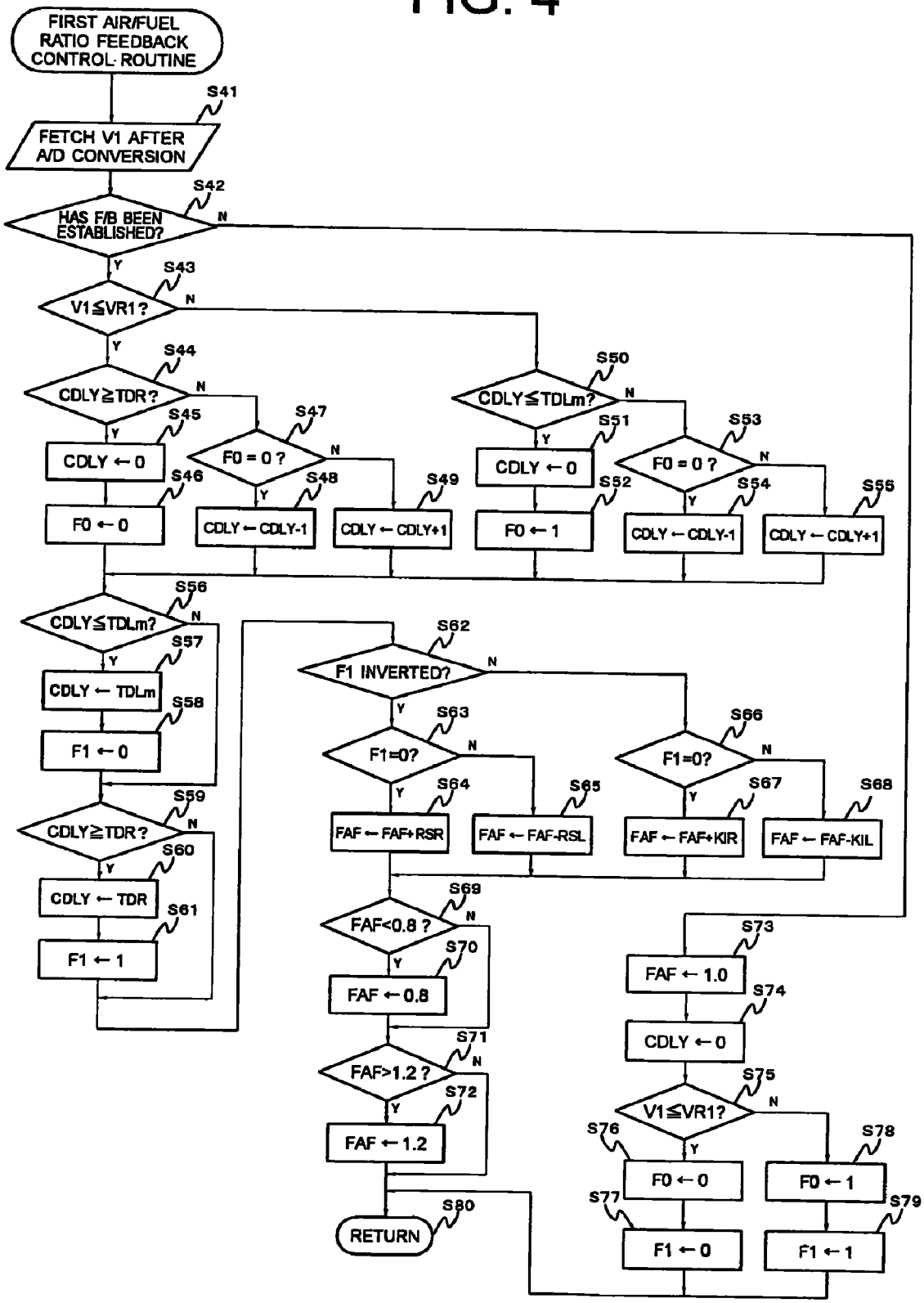
FIG. 4 is a flowchart showing a control routine, in which a first air/fuel ratio feedback control means according to the first embodiment of the present invention calculates an air/fuel ratio adjustment factor in accordance with an output from the upstream $O_2$ sensor.

FIGS. 5A to 5F are timing charts, each for complementarily explaining the first air/fuel ratio feedback control routine shown in the flowchart of FIG. 4.

Figures 5A, 5B, 5C, 5D, 5E, 5F:
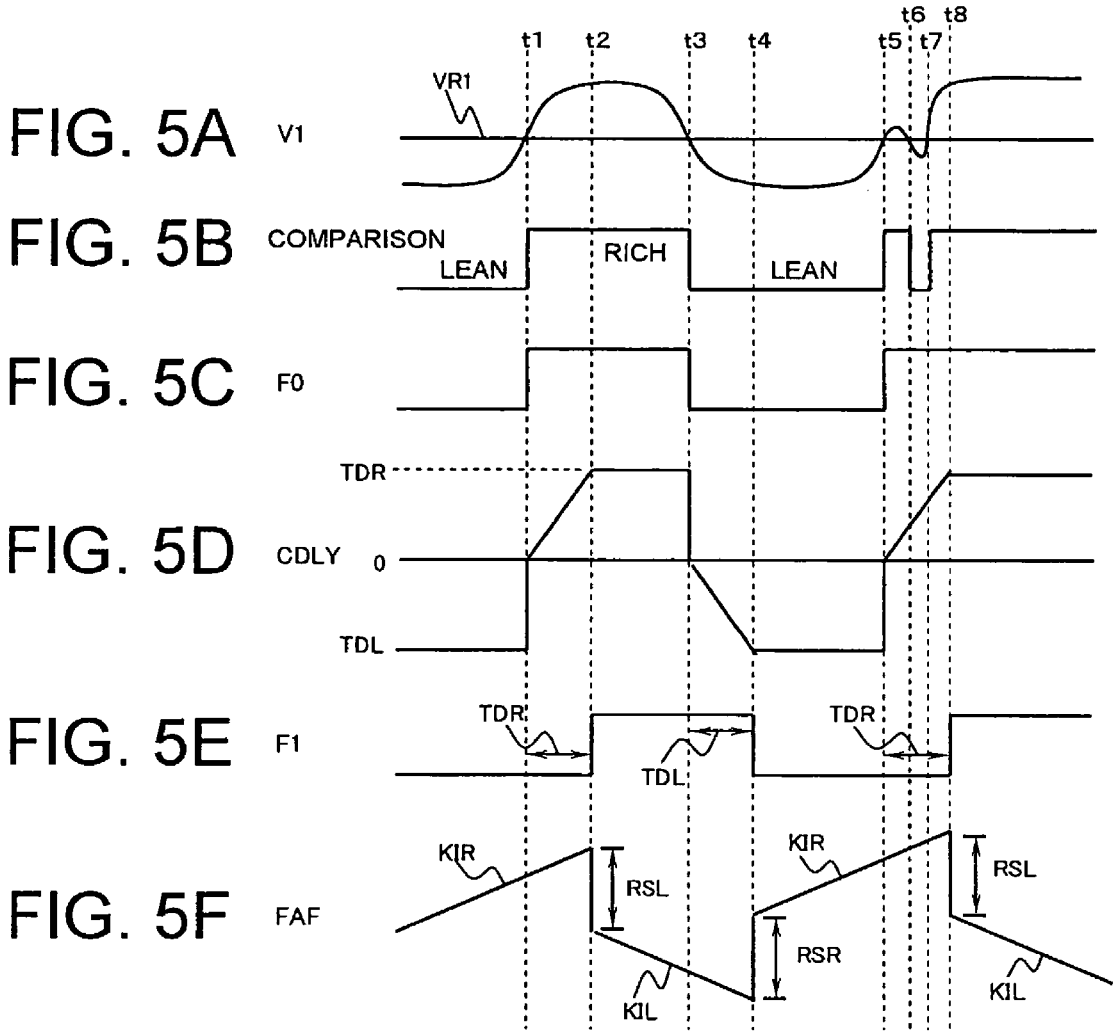
FIGS. 5A to 5E are timing charts, each complementarily explaining the control routine shown in the flowchart of FIG. 4.

From the sensor output V1 of the upstream $O_2$ sensor 20 shown in FIG. 5A, the result of comparison of the air/fuel ratio with respect to the relative voltage VR1, that is, on the rich side or on the lean side, is obtained as shown in FIG. 5B. When the result of comparison of the air/fuel ratio is obtained, the pre-delay air/fuel ratio flag F0 is changed to the rich state or the lean state as shown in FIG. 5C.

The delay counter CDLY is counted up when the pre-delay air/fuel ratio flag F0 is determined as being in the rich state, and is counted down when the pre-delay air/fuel ratio flag F0 is determined as being in the lean state as shown in FIG. 5D. As a result, the post-delay air/fuel ratio flag F1 changes as shown in FIG. 5E. Based on the post-delay air/fuel ratio flag F1, the fuel adjustment factor FAF is obtained as shown in FIG. 5F.

In FIGS. 5A to 5F, when the result of comparison of the air/fuel ratio is inverted from the lean side to the rich side at a time t1, the delay process is started. After being kept on the lean side for the rich delay time TDR, the post-delay air/fuel ratio flag F1 changes to the rich side at a time t2.

When the result of comparison of the air/fuel ratio is inverted from the rich side to the lean side at a time t3, the post-delay air/fuel ratio flag F1 is kept on the rich side for a time corresponding to the lean delay time TDL and then is changed to the lean side at a time t4.

Even if the result of comparison of the air/fuel ratio is inverted from the lean side to the rich side at a time t5 to start the delay process and then the result of comparison of the air/fuel ratio is inverted at a time t6 and a time t7 before elapse of the rich delay time TDR, the pre-delay air/fuel ratio flag F0 is not inverted during the delay process until the delay counter CDLY reaches the rich delay time TDR.

Subsequently, at a time t8 at which the rich delay time TDR has elapsed after the inversion of the result of comparison of the air/fuel ratio at the time t5, the post-delay air/fuel ratio flag F1 shifts to the rich side.

Specifically, since the pre-delay air/fuel ratio flag F0 is not affected by a temporary variation in air/fuel ratio, a stable output can be obtained as compared with the result of comparison of the air/fuel ratio. Moreover, based on the post-delay air/fuel ratio flag F1 obtained from the pre-delay air/fuel ratio flag F0, the stable fuel adjustment factor FAF can be calculated.

Next, referring to a flowchart of FIG. 6 in addition to FIGS. 1 to 3, a second air/fuel ratio feedback control routine of the second air/fuel ratio feedback control means 32 for calculating the target average air/fuel ratio AFAVEobj in accordance with the output from the downstream $O_2$ sensor 21 will be described.

The control routine is executed, for example, every five milliseconds.

First, the sensor output V2 from the downstream $O_2$ sensor 21 is subjected to A/D conversion to be fetched (Step S81). It is then judged whether or not the closed-loop condition has been established to enable the execution of the feedback control (Step S82).

Since the λ-type $O_2$ sensor having extremely high air/fuel ratio detection resolution in the vicinity of the stoichiometric air/fuel ratio AFS is used as the downstream $O_2$ sensor 21 as described above, control accuracy can be improved.

Moreover, a filter process such as a first-order lag filter may be performed on the sensor output V2 from the downstream $O_2$ sensor 21.

The closed-loop condition is not established, for example, during the internal combustion engine start, during the increase in amount of fuel after the starting of the internal combustion engine, during the increase in amount of fuel for warm-up, in an inactive status of the downstream $O_2$ sensor 21, during a failure of the downstream $O_2$ sensor 21, during the control to the rich air/fuel ratio or the lean air/fuel ratio not to try to keep high cleaning capability of the three-way catalyst, during the stop of fuel supply, and other occasions. Otherwise, the closed-loop condition is established.

In order to judge whether the downstream $O_2$ sensor 21 is in an active status or not, it suffices that it is judged whether or not the cooling water temperature THW detected by the water temperature sensor became a predetermined value or higher, or it is judged whether or not an output voltage from the downstream $O_2$ sensor 21 has been across a predetermined voltage once.

In Step S82, if it is judged that the closed-loop condition has been established (specifically, Yes), an output target value VR2 is set (Step S83).

The output target value VR2 is set to, for example, the vicinity of 0.45 V, which indicates a predetermined voltage value of the downstream $O_2$ sensor 21 corresponding to the range (cleaning window) where the cleaning capability of the three-way catalyst in the vicinity of the stoichiometric air/fuel ratio AFS becomes high.

The output target value VR2 may be set in the vicinity of 0.75 V at which the cleaning capability of the three-way catalyst for $NO_x$ becomes high, or may be set in the vicinity of 0.2 V at which the cleaning capability of the three-way catalyst for CO and HC becomes high.

The output target value VR2 may be varied depending on operating conditions. If the output target value VR2 is varied depending on the operating conditions, a filter process such as a first-order lag filter may be performed on the output target value VR2 to reduce a variation in air/fuel ratio due to a stepwise change upon modification of the output target value VR2.

The operating conditions are, for example, the number of revolutions of the engine main body 1 and a load thereon. A plurality of operation zones are determined based on the values of the number of revolutions and the load. The operating conditions are not limited to the number of revolutions of the engine main body 1 and the load thereon, but may include the cooling water temperature THW of the engine main body 1, acceleration and deceleration speeds of the vehicle, an idling status, an exhaust temperature, a temperature of the upstream $O_2$ sensor 20, an EGR opening, and the like.

Subsequently, a difference ΔV2 (=VR2−V2) between the sensor output V2 from the downstream $O_2$ sensor 21 and the output target value VR2 is calculated (Step S84).

The following Steps S85 to S92 correspond to PI control for executing a proportional (P) calculation and an integral (I) calculation in accordance with the difference ΔV2. The target average air/fuel ratio AFAVEobj corresponding to the target value of the average air/fuel ratio AFAVE of the exhaust gas on the upstream side of the catalyst is set so as to eliminate the difference ΔV2.

For example, if the sensor output V2 from the downstream $O_2$ sensor 21 is smaller than the output target value VR2 (lean state), the target average air/fuel ratio AFAVEobj is set on the rich side to control the sensor output V2 to become close to the output target value VR2.

The target average air/fuel ratio AFAVEobj is calculated by general PI control and is represented by the following Formula (1).

$$AFAVEobj = AFAVE0 + \Sigma(Ki2(\Delta V2)) + Kp2(\Delta V2) \quad (1)$$

In Formula (1), Ki2 is an integral gain, and Kp2 is a proportional gain. Moreover, AFAVE0 is an initial value set for each operating condition as a value corresponding to the stoichiometric air/fuel ratio AFS, and is stored in the ROM 24 as fixed-value data. In this case, for example, the initial value AFAVE0 is set to 14.53.

Since the integral calculation integrates the difference ΔV2 to generate an output, the integral calculation relatively slowly operates. Moreover, the integral calculation can eliminate a steady difference in the sensor output V2 from the downstream $O_2$ sensor 21 due to a variation in output characteristic of the upstream $O_2$ sensor 20.

As the integral gain Ki2 is increased, an absolute value of an integral shift amount Σ(Ki2(ΔV2)) becomes larger to increase the control speed. If the control speed becomes too high, a phase delay becomes large to destabilize the control system, thereby causing hunting.

For this reason, it is necessary to set the integral gain Ki2 to an appropriate value.

Since the proportional calculation generates an output in proportion to the difference ΔV2, the proportional calculation exhibits a relatively quick response to promptly eliminate the difference ΔV2.

As the proportional gain Kp2 is increased, an absolute value of the proportional shift amount Kp2 (ΔV2) becomes larger to increase the control speed. If the control speed becomes too high, the control system is destabilized to cause hunting.

For this reason, it is necessary to set the proportional gain Kp2 to an appropriate value.

Hereinafter, each of Steps S85 to S92 will be described.

First, it is judged whether or not an update condition of the integral calculation value has been established (Step S85).

The update condition is not established in the case where the vehicle performs the transient operation and in the case where an arbitrary predetermined period has not been elapsed after the termination of the transient operation. Otherwise, the update condition is established.

The transient operation includes: sudden acceleration and deceleration; the stop of fuel supply; the control to the rich air/fuel ratio or the lean air/fuel ratio not to try to keep high cleaning capability of the three-way catalyst; the stop of the second air/fuel ratio feedback control means 32; the stop of the first air/fuel ratio feedback control means 34; a forced variation in air/fuel ratio for failure diagnosis; forced driving of an actuator for failure diagnosis; and a sudden change in introduction of a transpiration gas.

In order to judge the execution or non-execution of sudden acceleration and deceleration, it suffices to judge whether or not the amount of change in throttle opening per unit time is a predetermined value or larger, or to judge whether or not the amount of change in intake air quantity Aq per unit time is a predetermined value or larger. In order to judge a sudden change in introduction of the transpiration gas, it suffices to judge whether or not the amount of change in valve opening for introducing the transpiration gas per unit time is a predetermined value or larger.

During the transient operation, the air/fuel ratio of the exhaust gas on the upstream side of the catalyst greatly fluctuates to correspondingly fluctuate the air/fuel ratio on the downstream side of the catalyst. If the integral calculation is carried out in such a state, a value containing the effect of a disturbance is integrated. Moreover, the integral calculation operates relatively slowly. Therefore, if the integral calculation is carried out during the transient operation, a value containing the effect of the disturbance remains for a while even after the termination of the transient operation to deteriorate the control performance.

Therefore, during the transient operation, the update of the integral calculation is temporarily stopped to keep the integral calculation value to prevent an erroneous integral calculation as described above.

Moreover, even after the termination of the transient operation, the effect of the disturbance remains for a while due to a delay of the control target. Therefore, by stopping the update of the integral calculation over a predetermined period even after the termination of the transient operation, an erroneous integral calculation can be similarly prevented.

In particular, the catalyst delay is large, and it increases the effect of a delay. A speed of the catalyst for recovering from the effect of the transient operation is proportional to the intake air quantity Aq for the oxygen storage capacity of the catalyst. Therefore, the above-described arbitrary predetermined period may be set to a period required for an integrated air quantity after the termination of the transient operation to reach a predetermined value.

Even in this case, an erroneous integral calculation can be prevented in a similar manner.

In addition to the above-described update condition, the update condition may be determined as being established for every predetermined number of times of execution of the control routine.

In this case, by changing the predetermined number of times of execution, the speed of the integral calculation can be adjusted to produce the same effect as that in the case where the integral gain Ki2 is adjusted.

If it is determined in Step S85 that the update condition of the integral calculation value has been established (specifically, Yes), an integral calculation value AFI is updated to a value obtained by adding an update amount Ki2(ΔV2) to the integral calculation value AFI (Step S86).

The integral calculation value AFI is stored in the backup RAM 26 for each of the operating conditions. The update amount Ki2 (ΔV2) may be simply calculated as the update amount Ki2(ΔV2)=Ki2×ΔV2 by using a predetermined integral gain Ki2, or may be nonlinearly calculated in accordance with the difference ΔV2 by using a variable integral gain Ki2 as shown in a one-dimensional map of FIG. 7.

Moreover, by repeatedly adding the update amount Ki2 (ΔV2) to the integral calculation value AFI, the integral shift amount Σ(Ki2(ΔV2)) represented by the Formula (1) is calculated.

A fluctuation in output characteristic of the upstream $O_2$ sensor 20 compensated by the integral calculation value AFI is varied depending on the operating conditions such as a temperature or a pressure of the exhaust gas.

Therefore, the integral calculation value AFI stored in the backup RAM 26 is read each time the operating conditions change to change the integral calculation value AFI. As a result, the effect due to a fluctuation in output characteristic of the upstream $O_2$ sensor 20 can be reduced.

Moreover, the integral calculation value AFI is stored in the backup RAM 26 for each operating condition. As a result, the integral calculation value AFI is reset upon stop or restart of the internal combustion engine to prevent the control performance from being deteriorated.

The integral gain Ki2 may be changed in accordance with the operating conditions.

As a result, the integral calculation value AFI can be calculated in accordance with a response delay in the second air/fuel ratio feedback control means 32, which changes depending on the operating conditions. Moreover, the integral calculation value AFI can be calculated to meet a requirement for drivability, which changes depending on the operating conditions.

Since the response delay from the upstream side of the catalyst to the downstream side of the catalyst changes in proportional to the intake air quantity Aq, in particular, depending on a distance/velocity lag of the exhaust gas and the oxygen storage capacity of the catalyst, it is suitable that the absolute value of the integral gain Ki2 be set in accordance with the intake air quantity Aq, for example, in proportional to the intake air quantity Aq.

Figure 8:
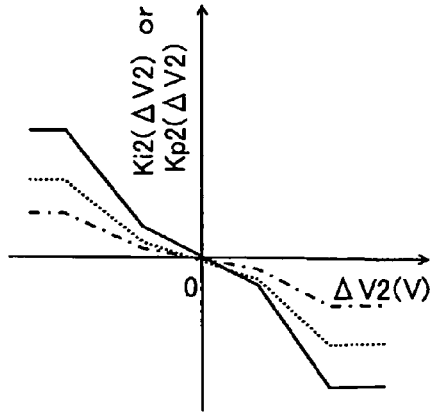
FIG. 8 is an explanatory view showing the relation between the difference and the update amount, and the shift amount according to the first embodiment of the present invention in accordance with an intake air quantity.

FIG. 8 is an explanatory view showing the relation between the difference ΔV2 and the update amount Ki2(ΔV2) according to the first embodiment of the present invention, in accordance with the intake air quantity Aq.

In FIG. 8, a solid line indicates the relation between the difference ΔV2 and the update amount Ki2(ΔV2) when the intake air quantity is large. A dot line indicates the relation between the difference ΔV2 and the update amount Ki2(ΔV2) when the intake air quantity is medium. A chain line indicates the relation between the difference ΔV2 and the update amount Ki2 (ΔV2) when the intake air quantity is small.

Instead of changing the absolute value of the integral gain Ki2, an update cycle may be changed. The update cycle corresponds to execution of the update of the integral calculation value AFI for every predetermined number of times of execution of the control routine, and can be changed by changing the predetermined number of times of execution.

Even in this case, the same effect as that in the case where the absolute value of the integral gain Ki2 is changed can be produced.

On the other hand, if it is judged in Step S85 that the update condition of the integral calculation value AFI has not been established (specifically, No), the integral calculation value AFI is maintained without being updated (Step S87). Then, the process proceeds to Step S88.

Subsequently, based on the following Formula (2), an upper/lower limit restricting process of the integral calculation value AFI is executed (Step S88).

$$AFImin<AFI<AFImax \quad (2)$$

In Formula (2), AFImim is the minimum value of the integral calculation value AFI, and AFImax is the maximum value of the integral calculation value AFI. The integral calculation minimum value AFImim and the integral calculation maximum value AFImax are stored in the ROM 24 as fixed-value data.

Since a fluctuation range of the output characteristic of the upstream $O_2$ sensor 20 can be obtained in advance, the integral calculation minimum value AFImim and the integral calculation maximum value AFImax, which allow the fluctuation range to be compensated, can be set.

By the upper/lower limit restricting process of the integral calculation value AFI, if the integral calculation value AFI is smaller than the integral calculation minimum value AFImim, the integral calculation value AFI is guarded with the integral calculation minimum value AFImim. If the integral calculation value AFI is larger than the integral calculation maximum value AFImax, the integral calculation value AFI is guarded with the integral calculation maximum value AFImax.

Therefore, an excessive operation of the air/fuel ratio can be prevented from occurring to prevent the drivability from being deteriorated.

Moreover, by limiting the integral calculation value AFI within the set fluctuation allowable range of the average air/fuel ratio AFAVE, the stability of the control system can be enhanced.

Moreover, the integral calculation minimum value AFImim and the integral calculation maximum value AFImax can be set for each of the operating conditions.

As a result, the integral calculation value AFI can be calculated in accordance with the thus set fluctuation allowable range of the average air/fuel ratio AFAVE, which varies depending on the operating conditions. Moreover, the integral calculation value AFI can be calculated in accordance with a requirement of drivability, which changes depending on the operating conditions.

Next, a proportional calculation value AFP is set to the proportional shift amount Kp2(ΔV2) (Step S89).

Figure 7:
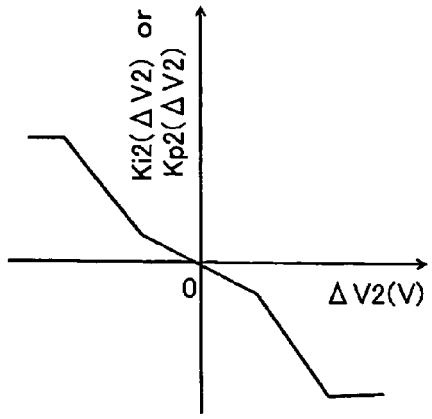
FIG. 7 is an explanatory view showing the relation between a difference and an update amount, and a shift amount according to the first embodiment of the present invention.

The proportional shift amount Kp2(ΔV2) may be simply calculated by using a predetermined proportional gain Kp2 as: the proportional shift amount Kp2 (ΔV2)=Kp2×ΔV2, or may be nonlinearly calculated by using the variable proportional gain Kp2 in accordance with the difference ΔV2 as shown in the one-dimensional map of FIG. 7.

The proportional gain Kp2 may be changed in accordance with the operating conditions as in the case of the integral gain Ki2.

As a result, the proportional calculation value AFP can be calculated in accordance with a response delay in the second air/fuel ratio feedback control means 32, which varies depending on the operating conditions. Moreover, the proportional calculation value AFP can be calculated in accordance with a requirement of drivability, which changes depending on the operating conditions.

The relation between the difference ΔV2 and the proportional shift amount Kp2(ΔV2) in the case where the proportional gain Kp2 is set in accordance with the intake air quantity Aq is shown in FIG. 8.

If it is judged in Step S85 that the update condition of the integral calculation value AFI has not been established (specifically, in the case where the vehicle performs the transient operation or in the case where a predetermined period has not been elapsed after the termination of the transient operation), the proportional gain Kp2 may be changed.

During the transient operation, a fluctuation occurs in the sensor output V2 from the downstream $O_2$ sensor 21 due to a disturbance. Therefore, if the proportional gain Kp2 is set to the same value as that during a normal operation, an excessive operation for the air/fuel ratio occurs. As a result, there arises a problem in that the drivability is deteriorated or, on the contrary, a shortage of the shift amount of the average air/fuel ratio AFAVE necessary for stabilizing the disturbance occurs.

Therefore, in accordance with the type of transient operation, the absolute value of the proportional gain Kp2 is set larger or smaller than that during the normal operation.

As the transient operation for setting the absolute value of the proportional gain Kp2 small, there are the forced variation in air/fuel ratio for failure diagnosis and the like. In this case, the prevention of degradation of the drivability and the maintenance of followability of the feedback control to the minimum level can be realized in a well-balanced manner.

On the other hand, as the transient operation for setting the absolute value of the proportional gain Kp2 large, there are sudden acceleration and deceleration, a sudden change in introduction of the transpiration gas, and the like. In this case, although the drivability is degraded, the followability of the feedback control can be improved.

Even for the integral gain Ki2, by setting an absolute value of the integral gain Ki2 smaller or larger than that during the normal operation depending on the type of transient operation, the same effect as in the case where the proportional gain Kp2 is changed can be produced.

For a predetermined period after the termination of the transient operation, the absolute value of the proportional gain Kp2 is set larger than that during the normal operation. After the elapse of the predetermined period, the absolute value of the proportional gain Kp2 is returned to that during the normal operation.

In this manner, a recovering speed of the cleaning capability of the catalyst, which has been deteriorated by the disturbance, is increased. At the same time, the occurrence of an excessive operation of the air/fuel ratio after the elapse of the predetermined period can be prevented to avoid the deterioration of drivability.

As in the case of the integral calculation, the speed of the catalyst for recovering from the effect of the transient operation is proportional to the intake air quantity Aq for the oxygen storage capacity of the catalyst. Therefore, the predetermined period may be set to a period required for the integral air quantity to reach a predetermined value after the termination of the transient operation.

Moreover, the predetermined period may be reduced by increasing the absolute value of the proportional gain Kp2. The reduction of the predetermined period can prevent the drivability during the normal operation from being deteriorated.

In this case, the transient operation further includes the case of stop of fuel supply.

Subsequently, based on the following Formula (3), the upper/lower limit restricting process of the proportional calculation value AFP is executed (Step S90).

$$AFPmin<AFP<AFPmax \quad (3)$$

In Formula (3), AFPmin is the minimum value of the proportional calculation value AFP, and AFPmax is the maximum value of the proportional calculation value AFP. The proportional calculation minimum value AFPmin and the proportional calculation maximum value AFPmax are stored in the ROM 24 as fixed-value data.

The proportional calculation minimum value AFPmin and the proportional calculation maximum value AFPmax can prevent the drivability from being deteriorated and can enhance the stability of the control system as in the case of the integral calculation minimum value AFImin and the integral calculation maximum value AFImax.

By the upper/lower limit restricting process, the proportional calculation value AFP is guarded with the proportional calculation minimum value AFPmin when the proportional calculation value AFP is smaller than the proportional calculation minimum value AFPmin. When the proportional calculation value AFP is larger than the proportional calculation maximum value AFPmax, the proportional calculation value AFP is guarded with the proportional calculation maximum value AFPmax.

Therefore, an excessive operation of the air/fuel ratio can be prevented from occurring to prevent the deterioration of drivability.

Moreover, by limiting the proportional calculation value AFP within the designed fluctuation allowable range of the average air/fuel ratio AFAVE, the stability of the control system can be enhanced.

For the proportional calculation minimum value AFPmin and the proportional calculation maximum value AFPmax, values while the vehicle is normally operated, values while the vehicle is performing the transient operation, and values in the case where the predetermined period has not been elapsed after the termination of the transient operation are set and stored in the ROM 24.

As a result, while the vehicle is normally operated, the drivability can be prevented from being deteriorated. On the other hand, while the vehicle is performing the transient operation and in the case where the predetermined period has not been elapsed after the termination of the transient operation, the followability of the feedback control can be improved.

The proportional calculation minimum value AFPmin and the proportional calculation maximum value AFPmax may be set for each of the operating conditions.

As a result, the proportional calculation value AFP can be calculated in accordance with the designed fluctuation allowable range of the average air/fuel ratio AFAVE, which varies depending on the operating conditions. Moreover, the proportional calculation value AFP can be calculated in accordance with a requirement of the drivability, which changes depending on the operating conditions.

Next, based on the following Formula (4), the PI calculation values are summed to calculate the target average air/fuel ratio AFAVEobj (Step S91). Formula (4) is similar to Formula (1) described above.

$$AFAVEobj=AFAVE0+AFP+AFI \quad (4)$$

Subsequently, based on the following Formula (5), the upper/lower limit restricting process of the target average air/fuel ratio AFAVEobj is executed (Step S92).

$$AFAVEobjmin<AFAVEobj<AFAVEobjmax \quad (5)$$

In Formula (5), AFAVEobjmin is the minimum value of the target average air/fuel ratio AFAVEobj, and AFAVEobjmax is the maximum value of the target average air/fuel ratio AFAVEobj. The target average air/fuel ratio minimum value AFAVEobjmin and the target average air/fuel ratio maximum value AFAVEobjmax are stored in the ROM 24 as fixed-value data.

By the upper/lower limit restricting process of the target average air/fuel ratio AFAVEobj, when the target average air/fuel ratio AFAVEobj is smaller than the target average air/fuel ratio minimum value AFAVEobjmin, the target average air/fuel ratio AFAVEobj is guarded with the target average air/fuel ratio minimum value AFAVEobjmin. On the other hand, when the target average air/fuel ratio AFAVEobj is larger than the target average air/fuel ratio maximum value AFAVEobjmax, the target average air/fuel ratio AFAVEobj is guarded with the target average air/fuel ratio maximum value AFAVEobjmax.

Therefore, an excessive operation of the air/fuel ratio can be prevented from occurring to prevent the deterioration of drivability.

Moreover, by limiting the target average air/fuel ratio AFAVEobj within the designed fluctuation allowable range of the average air/fuel ratio AFAVE, the stability of the control system can be enhanced.

Moreover, the target average air/fuel ratio minimum value AFAVEobjmin and the target average air/fuel ratio maximum value AFAVEobjmax may be set for each of the operating conditions.

As a result, the target average air/fuel ratio AFAVEobj can be calculated in accordance with the fluctuation allowable range of the designed average air/fuel ratio AFAVE, which changes depending on the operating conditions. Moreover, the target average air/fuel ratio AFAVEobj can be calculated in accordance with a requirement of drivability, which changes depending on the operating conditions.

As in the case of the proportional calculation minimum value AFPmin and the proportional calculation maximum value AFPmax, for the target average air/fuel ratio minimum value AFAVEobjmin and the target average air/fuel ratio maximum value AFAVEobjmax, values while the vehicle is normally operated, values while the vehicle is performing the transient operation, and values in the case where the predetermined period has not elapsed after the termination of the transient operation may be set and stored in the ROM 24.

As a result, while the vehicle is normally operated, the drivability can be prevented from being deteriorated. On the other hand, while the vehicle is performing the transient operation and in the case where the predetermined period has not been elapsed after the termination of the transient operation, the followability of the feedback control can be improved.

Subsequently, it is judged whether a forced variation condition for forcing the target average air/fuel ratio AFAVEobj to be varied has been established or not (Step S93).

The forced variation condition is established during failure diagnosis, upon improvement of the cleaning characteristic of the catalyst, and the like.

The failure diagnosis includes that for the catalytic converter 18 or the downstream $O_2$ sensor 21. The failure diagnosis can be carried out by monitoring a waveform of the sensor output V2 from the downstream $O_2$ sensor 21 upon application of a forced variation on the target average air/fuel ratio AFAVEobj.

The improvement of the cleaning characteristic of the catalyst can be implemented by changing a control amplitude of the air/fuel ratio on the upstream side of the catalyst or a control cycle.

The time of implementing the failure diagnosis and the improvement of the cleaning characteristic of the catalyst can be determined based on the operating conditions such as the number of revolutions of the engine main body 1, the load, the cooling water temperature THW, and the acceleration and deceleration.

In Step S93, if it is judged that the forced variation condition has been established (specifically, Yes), a forced variation amplitude ΔA/F is added to the target average air/fuel ratio AFAVEobj (Step S94) to terminate the process shown in FIG. 6.

A positive/negative sign of the forced variation amplitude ΔA/F is switched, for example, between ΔA/F="+0.25" and ΔA/F="−0.25", in a predetermined switching cycle.

Figure 9:
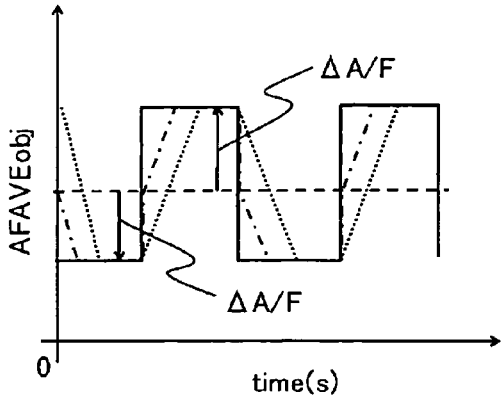
FIG. 9 is an explanatory view showing the target average air/fuel ratio to which a forced variation amplitude according to the first embodiment of the present invention is applied thereto.

FIG. 9 is an explanatory view showing the target average air/fuel ratio AFAVEobj when the forced variation amplitude ΔA/F according to the first embodiment of the present invention is applied.

In FIG. 9, a solid line indicates the target average air/fuel ratio AFAVEobj when the forced variation amplitude ΔA/F is switched in a stepwise manner. Each of a dot line and a chain line indicates the target average air/fuel ratio AFAVEobj when the forced variation amplitude ΔA/F is applied with a certain inclination.

The forced variation amplitude ΔA/F and the predetermined switching cycle are set for each of the operating conditions.

As a result, the forced variation can be implemented in accordance with a response delay in the second air/fuel ratio feedback control means 32, a requirement of drivability, and a requirement for the cleaning characteristic of the catalyst, which change depending on the operating conditions.

For the failure diagnosis of the catalytic converter 18, the response delay changes in inverse proportion to the intake air quantity Aq, in particular, depending on the oxygen storage capacity of the catalyst. Therefore, it is recommended that the forced variation amplitude ΔA/F and the predetermined switching cycle be set in inverse proportion to the intake air quantity Aq.

Moreover, during a period of the application of the forced variation, the proportional gain Kp2 or the integral gain Ki2 may be changed from its normal value.

On the other hand, if it is judged in Step S93 that the forced variation condition has not been established (specifically, No), the process shown in FIG. 6 is immediately terminated.

If it is judged in Step S82 that the closed-loop condition has not been established (specifically, No), the target average air/fuel ratio AFAVEobj is set based on the following Formula (6) to terminate the process shown in FIG. 6.

$$AFAVEobj = AFAVE0 + AFI \quad (6)$$

In Step S95, for example, depending on a predetermined condition, a predetermined value may be added to or subtracted from the result of the addition of the initial value AFAVE0 and the integral calculation value AFI.

As a result, for example, for inhibiting $NO_x$ exhaustion, a predetermined value can be subtracted to shift the target average air/fuel ratio AFAVEobj to the rich side on the predetermined condition such as the high load. On the other hand, for inhibiting HC and CO exhaustion, a predetermined value can be added to shift the target average air/fuel ratio AFAVEobj to the lean side on the predetermined condition such as the low load, or just after engine start.

Next, in accordance with the fuel adjustment factor FAF calculated by the first air/fuel ratio feedback control routine shown in the flowchart of FIG. 4, an operation of calculating the fuel supply quantity Qfuel supplied to the engine main body 1 will be described.

First, the fuel supply quantity Qfuel is represented by the following Formula (7).

$$Qfuel = Qfuel0 \times FAF \quad (7)$$

In Formula (7), Qfuel0 is a base fuel supply quantity and is represented by the following Formula (8).

$$Qfuel0 = Aacyl/AFS \quad (8)$$

In Formula (8), Aacyl is an air supply quantity to the engine main body 1, which is calculated based on the intake air quantity Aq output from the airflow meter 12.

The basic fuel supply quantity Qfuel0 may be calculated by feed forward control using the target average air/fuel ratio AFAVEobj as represented by the following Formula (9).

$$Qfuel0 = Aacyl/AFAVEobj \quad (9)$$

In this embodiment, the air/fuel ratio of the exhaust gas on the upstream side of the catalyst is managed by the target average air/fuel ratio AFAVEobj serving as an index. Therefore, the feed forward control as described above is made possible. A following delay of the feedback control upon change of the target average air/fuel ratio AFAVEobj can be improved, whereas the fuel adjustment factor FAF can be maintained in the vicinity of the middle.

Moreover, learning control for absorbing a time variation of the first air/fuel ratio feedback control means 34 or a variation in production is carried out based on the fuel adjustment factor FAF, so the accuracy of the learning control is improved in the case where the fuel adjustment factor FAF is stabilized by the feedforward control.

The intake air quantity Aq may be calculated in accordance with the rotational speed Ne and the output of the boost pressure sensor provided on the downstream side of the throttle valve 9 or the opening of the throttle valve 9 and the rotational speed Ne.

Figure 10:
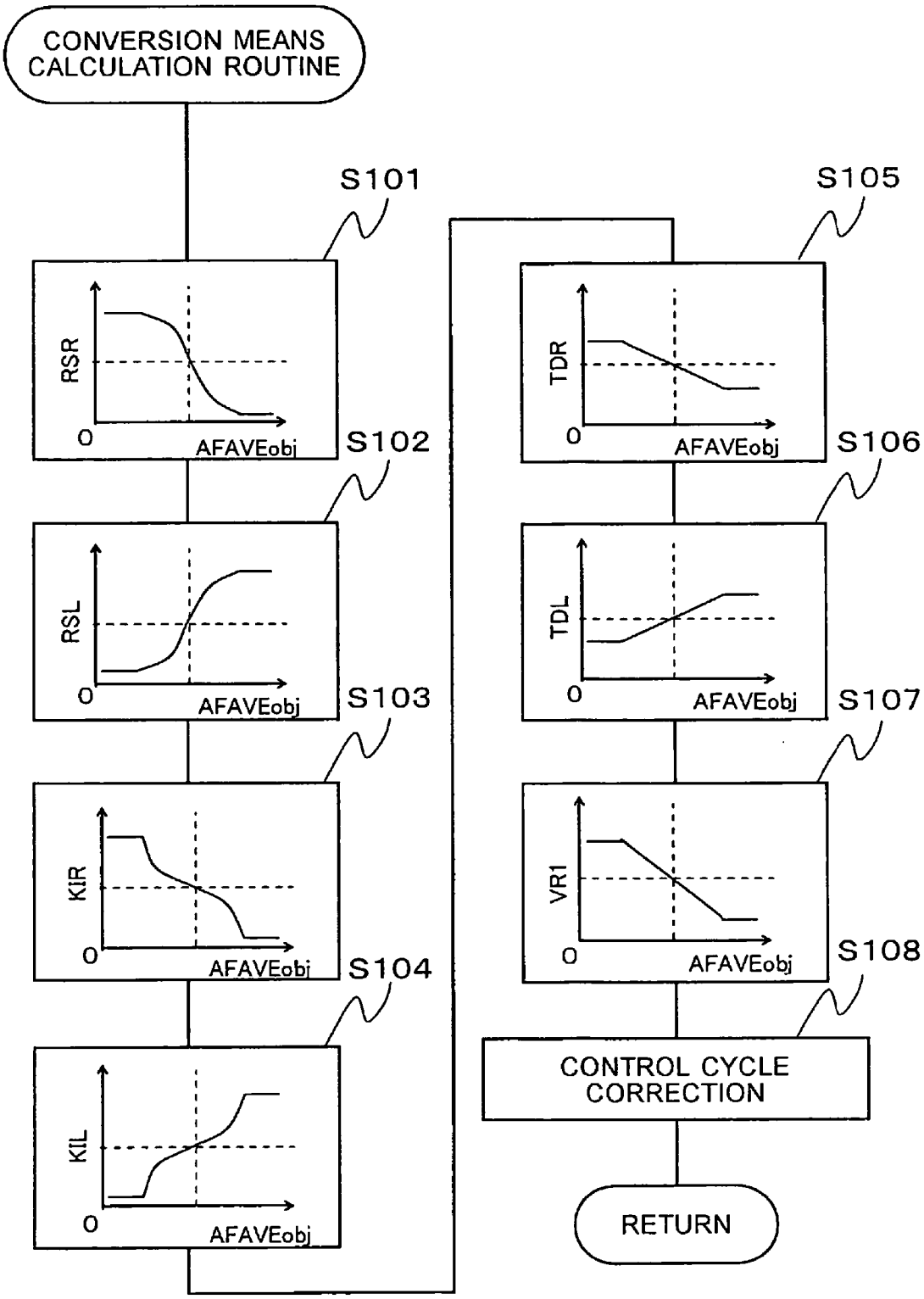
FIG. 10 is a flowchart showing a conversion means calculation routine, in which a conversion means according to the first embodiment of the present invention calculates controlling constants.

Next, referring to a flowchart of FIG. 10 in addition to FIG. 3, a converter calculation routine, in which the conversion means 33 calculates the skip amounts RSR and RSL, the integral constants KIR and KIL, the delay times TDR and TDL and the reference voltage VR1 using the target average air/fuel ratio AFAVEobj as a common index, will be described.

The calculation routine is executed, for example, every five milliseconds.

First, based on the target average air/fuel ratio AFAVEobj, the skip amount RSR is calculated from the one-dimensional map (Step S101).

In this step, the skip amount RSR is preset in the one-dimensional map based on a desk calculation or an experiment described below. In accordance with the input target average air/fuel ratio AFAVEobj, the corresponding skip amount RSR is output as the result of search through the map.

A plurality of the one-dimensional maps are provided for each of operating conditions. The one-dimensional maps are switched in accordance with a change in the operating conditions to calculate the skip amount RSR.

The operating conditions in this step are those for the responsiveness or the characteristics of the first air/fuel ratio feedback control means 34 and the like as described above. For example, a plurality of one-dimensional maps can be created using the operating conditions as a plurality of operation zones, each being determined for a predetermined number of revolutions, a predetermined load and a predetermined water temperature.

It is not necessarily required to use the one-dimensional map. The same effect is produced by employing means for representing the relation between inputs and outputs such as an approximation, a high-order dimensional map corresponding to a larger number of inputs and a high-dimensional function.

Subsequently, based on the target average air/fuel ratio AFAVEobj, the skip amount RSL is calculated in the same manner as in Step S101 (Step S102).

Then, based on the target average air/fuel ratio AFAVEobj, the integral constants KIR and KIL, the delay times TDR and TDL, and the reference voltage VR1 are calculated in the same manner as in Step S101 (Steps S103 to S107).

Next, control cycle correction described below is implemented (Step S108) to terminate the process shown in FIG. 10.

As described above, each of the skip amounts RSR and RSL, the integral constants KIR and KIL, the delay times TDR and TDL, and the reference voltage VR1 corresponding to the controlling constants is calculated in accordance with the target average air/fuel ratio AFAVEobj.

A value set in the one-dimensional map for each of the controlling constants is preset based on the desk calculation or the experimental value so that the actual average air/fuel ratio AFAVE of the exhaust gas on the upstream side of the catalyst becomes the target average air/fuel ratio AFAVEobj corresponding to the input.

Moreover, by changing the value set in the one-dimensional map depending on the operating conditions, the values of the target average air/fuel ratio AFAVEobj and the actual average air/fuel ratio AFAVE on the upstream side of the catalyst can be set to be identical with each other regardless of the operating conditions.

Hereinafter, the relation between the controlling constants and the average air/fuel ratio AFAVE will be described.

As described above, a shift amount of the average air/fuel ratio AFAVE when two or more controlling constants are simultaneously controlled does not become equal to the result of a simple addition of shift amounts when the controlling constants are controlled separately. The shift amount varies depending on a control amount when each of the controlling constants is controlled, the combination of controlling constants, and the point of operation, characteristics of a control target, which varies depending on the operating conditions or the like.

Therefore, by calculating the skip amounts RSR and RSL, the integral constants KIR and KIL, the delay times TDR and TDL and the reference voltage VR1 using the target average air/fuel ratio AFAVEobj as a common index, the average air/fuel ratio AFAVE of the exhaust gas on the upstream side of the catalyst can be finely controlled.

First, the behavior of the average air/fuel ratio AFAVE when each of the controlling constants is controlled separately will be described.

A broad tendency of the relation between the controlling constants and the average air/fuel ratio AFAVE can be grasped by physically modeling the first air/fuel ratio feedback control means 34 to perform a desk numerical calculation.

Figure 11:
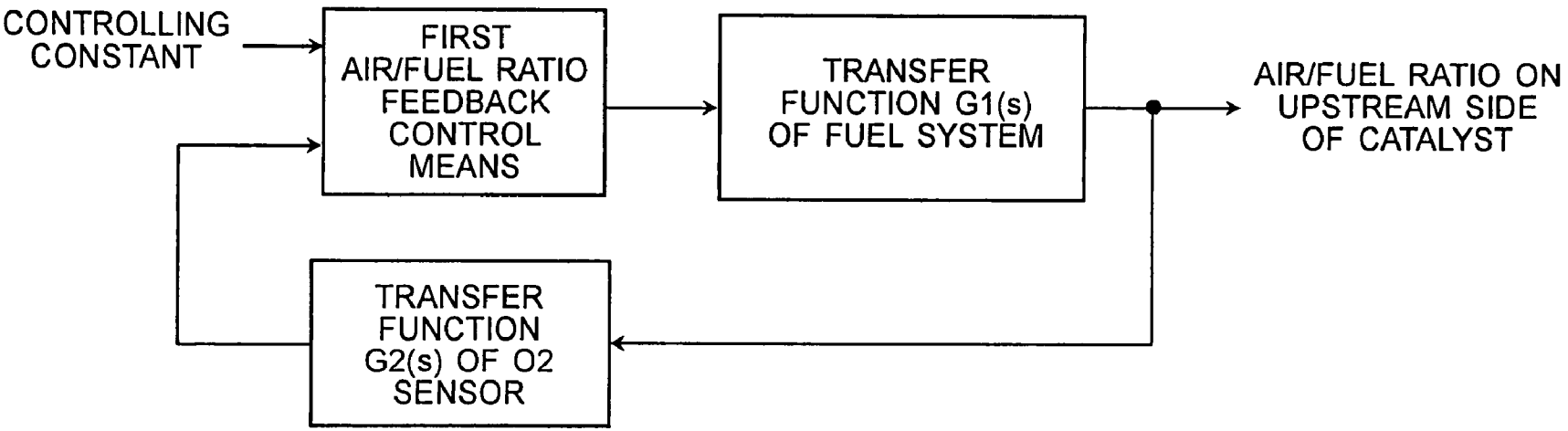
FIG. 11 is an explanatory view showing the physically modeled first air/fuel ratio feedback control means according to the first embodiment of the present invention.

FIG. 11 is an explanatory view showing the physically modeled first air/fuel ratio feedback control means 34 according to the first embodiment of the present invention.

In FIG. 11, when a transfer function G1($s$) of the fuel system from the fuel adjustment by the first air/fuel ratio feedback control means 34 to the air/fuel ratio on the upstream side of the catalyst is approximated by: a dead time+a first-order lag, the transfer function G1($s$) is represented by the following Formula (10).

$$G1(s)=e\hat{}(-Lf\cdot s)\times 1/(Tf\cdot s+1) \tag{10}$$

In Formula (10), Lf is a dead time of the fuel system, and Tf is a time constant of the fuel system. Both Lf and Tf vary depending on the operating conditions.

When a transfer function G2($s$) of the $O_2$ sensor from the air/fuel ratio on the upstream side of the catalyst to the upstream $O_2$ sensor 20 is approximated by: a first-order lag+a sensor static characteristic, the transfer function is G2($s$) is represented by the following Formula (11).

$$G2(s)=1/(To\cdot s+1)*f(u) \tag{11}$$

In Formula (11), To is a time constant of the upstream $O_2$ sensor 20, and f($u$) is a static characteristic of the upstream $O_2$ sensor 20. The characteristic of f($u$) is as that shown in FIG. 2 above.

The time constant To of the upstream $O_2$ sensor 20 varies, for example, depending on the point of operation of the reference voltage VR1. Therefore, it is desirable to set the time constant To(VR1) as a time constant varying depending on the reference voltage VR1. The static characteristics of the upstream $O_2$ sensor 20 varies in accordance with an element temperature varying depending on the operating conditions.

By experimentally identifying each of the constants of the physical model in accordance with the operating conditions, a broad tendency can be grasped through desk numerical calculation and analysis.

However, since the physical model approximates an actual phenomenon, a modeling error is generated in practice.

Specifically, for example, the transfer function G1($s$) of the fuel system is approximated by: the dead time+the first-order lag. In practice, however, the transfer function G1($s$) is a higher-order transfer function. Moreover, the time constant Tf of the fuel system is slightly changed depending on the point of operation of the air/fuel ratio and therefore is hard to be completely identical.

For this reason, it is necessary to ultimately confirm the time constant Tf through an experiment.

Hereinafter, referring to FIGS. 12 to 22, description will be made of the air/fuel ratio, the control cycle, and the control amplitude of the air/fuel ratio when the controlling constants are separately controlled.

Figure 12A:
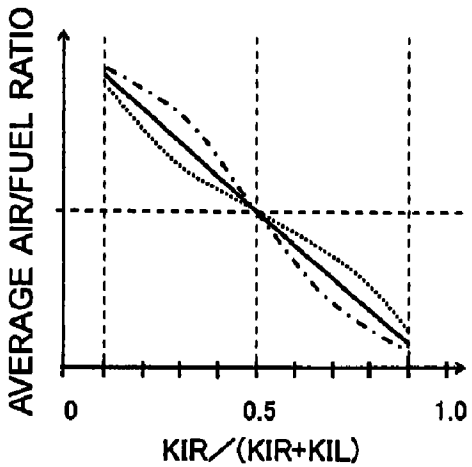
FIGS. 12A to 12C are explanatory views showing an average air/fuel ratio, a control cycle and a control amplitude of an air/fuel ratio when integral constants according to the first embodiment of the present invention are separately controlled.
Figure 12B:
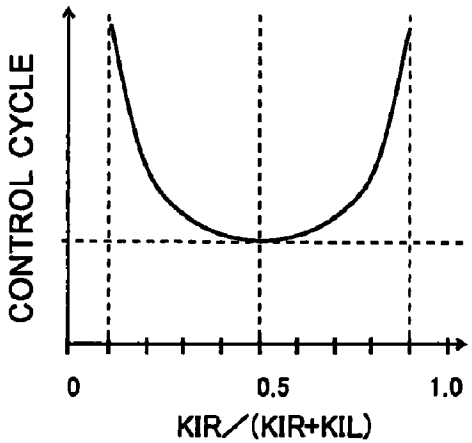
Figure 12C:
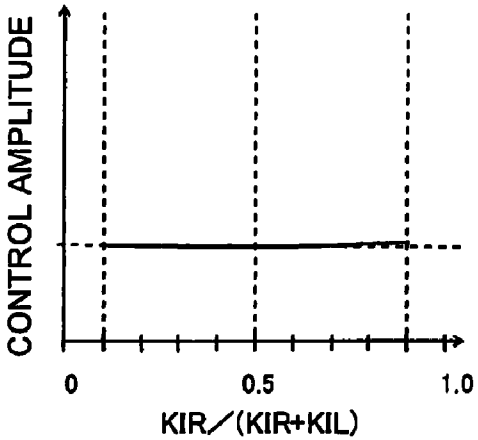

FIGS. 12A to 12C respectively show the average air/fuel ratio AFAVE (FIG. 12A), the control cycle (FIG. 12B), and the control amplitude of the air/fuel ratio (FIG. 12C) when the integral constants KIR and KIL according to the first embodiment of the present invention are controlled alone.

In FIGS. 12A to 12C, by changing balance setting KIR/(KIR+KIL) of the integral constants KIR and KIL, the actual average air/fuel ratio AFAVE changes in a monotonically decreasing manner. By changing the operating conditions, the average air/fuel ratio AFAVE is changed as indicated by a solid line, a dot line and a chain line to normally exhibit a nonlinear characteristic.

The control cycle increases in a quadratic-function manner as the balance setting KIR/(KIR+KIL) increases or decreases when the center of the symmetry of the balance setting KIR/(KIR+KIL) is set to "0.5". The control amplitude of the air/fuel ratio is scarcely changed by the balance setting KIR/(KIR+KIL).

Figure 13:
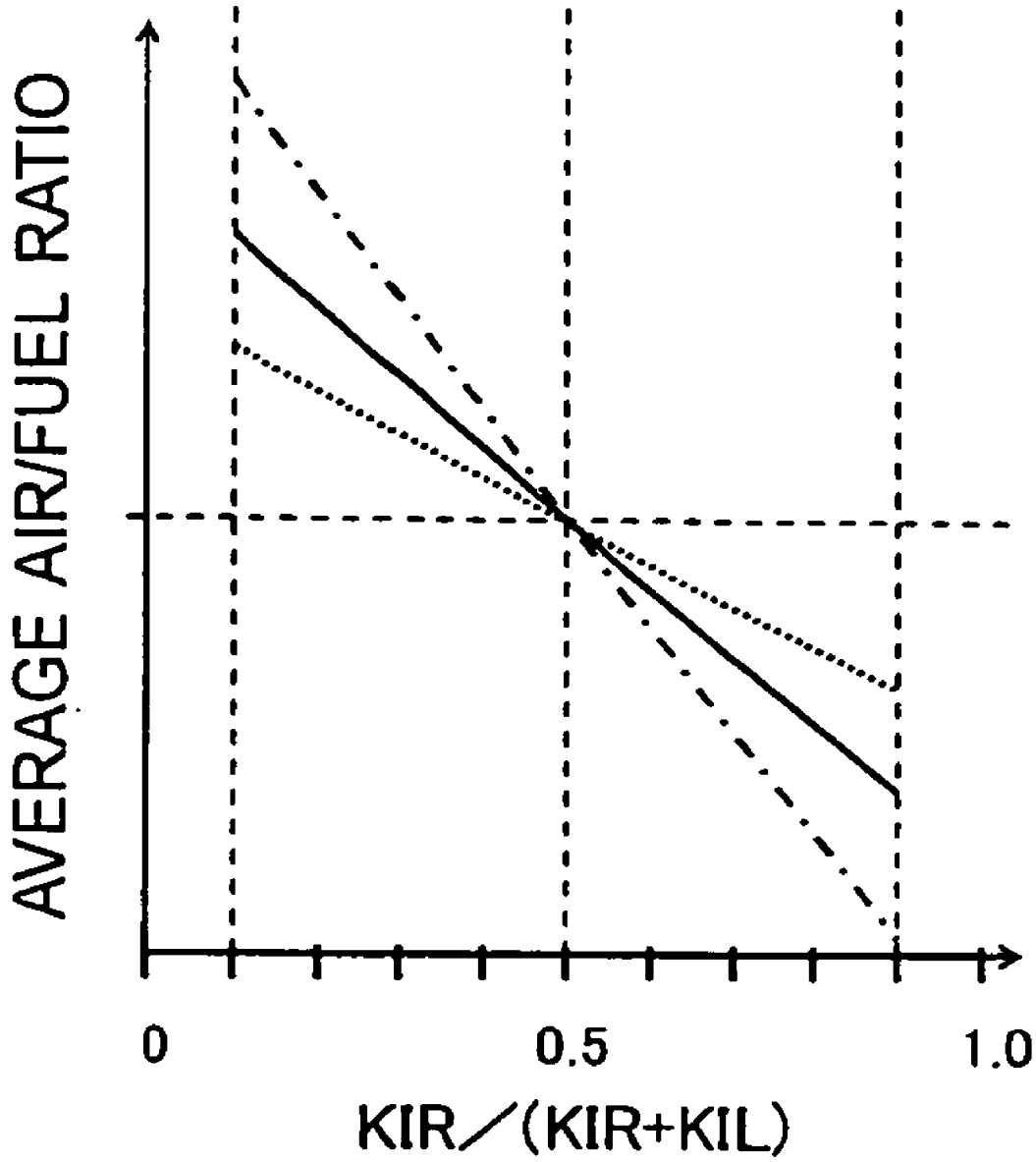
FIG. 13 is another explanatory view showing the average air/fuel ratio when the integral constants according to the first embodiment of the present invention are separately controlled.

FIG. 13 is another explanatory view showing the average air/fuel ratio AFAVE when the integral constants KIR and KIL according to the first embodiment of the present invention are controlled alone.

In FIG. 13, even for the same balance setting KIR/(KIR+KIL), by changing each of the sum of the integral constants KIR+KIL, the sum of the skip amounts RSR+RSL, the sum of the delay times TDR+TDL, the dead time of the fuel system Lf, the time constant of the fuel system Tf and the time constant of the $O_2$ sensor To, the effect produced by the balance setting KIR/(KIR+KIL) is increased or decreased to increase or decrease the shift amount of the average air/fuel ratio AFAVE as indicated by a solid line, a dot line and a chain line.

As described above, by changing the balance setting KIR/(KIR+KIL), the average air/fuel ratio AFAVE can be operated by the nonlinear monotone decreasing. At the same time, although the control cycle increases in a quadratic function manner as the asymmetry setting increases, a characteristic with the control amplitude being scarcely changed can be obtained.

Figures 14A, 14B, 14C:
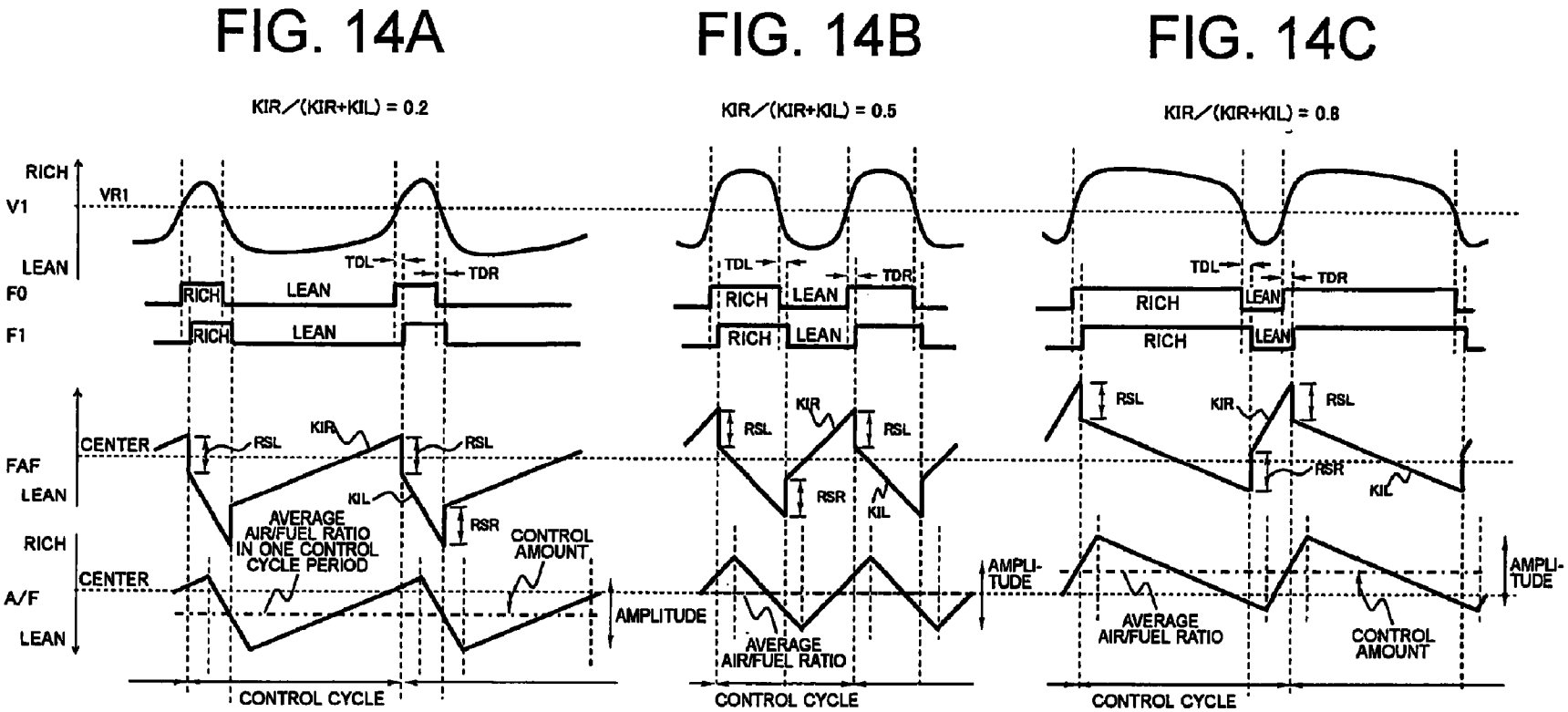
FIGS. 14A to 14C are timing charts showing behavior of a first air/fuel ratio feedback control when balance setting of the integral constants according to the first embodiment of the present invention is changed.

FIGS. 14A to 14C are timing charts showing the behavior of the first air/fuel ratio feedback control when the balance setting KIR/(KIR+KIL) according to the first embodiment of the present invention is changed to "0.2", "0.5", and "0.8", respectively.

In FIGS. 14A to 14C, by changing the balance setting KIR/(KIR+KIL), each of ratios of residence times and residence amounts of the air/fuel ratio A/F on the rich side and on the lean side becomes asymmetric with respect to the air/fuel ratio A/F corresponding to the reference voltage VR1 as the center. As a result, the average air/fuel ratio AFAVE for one control cycle can be controlled to the rich side or to the lean side when the center of the symmetry of the balance setting KIR/(KIR+KIL) is "0.5".

In this case, one control cycle is one feedback control cycle of a so-called limit cycle in which the rich side and the lean side are regularly repeated. One control cycle serves as an interval in which the post-delay air/fuel ratio flag F1 is inverted in the same direction or an interval of adding the skip amount RSR.

A phase of the air/fuel ratio A/F is delayed with respect to the fuel adjustment factor FAF due to a delay of the fuel system caused by: the dead time+the first-order lag described above.

Figure 15A:
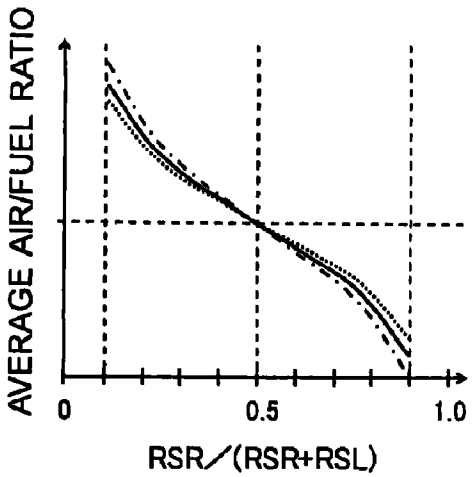
FIGS. 15A to 15C are explanatory views showing the average air/fuel ratio, the control cycle and the control amplitude of the air/fuel ratio when skip amounts according to the first embodiment of the present invention are separately controlled.
Figure 15B:
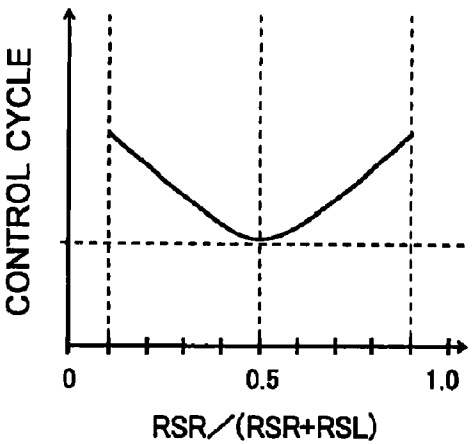
Figure 15C:
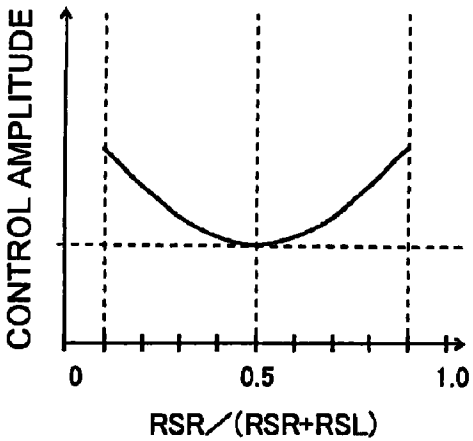

FIGS. 15A to 15C are explanatory views showing the average air/fuel ratio AFAVE, the control cycle and the control amplitude of the air/fuel ratio when the skip amounts RSR and RSL according to the first embodiment of the present invention are controlled alone.

In FIGS. 15A to 15C, by changing balance setting RSR/(RSR+RSL) of the skip amounts RSR and RSL, the actual average air/fuel ratio AFAVE changes in a monotonically decreasing manner. By changing the operating conditions, the average air/fuel ratio AFAVE is changed as indicated by a solid line, a dot line and a chain line to normally exhibit a nonlinear characteristic.

The control cycle increases in a linear-function manner as the balance setting RSR/(RSR+RSL) increases or decreases when the center of the symmetry of the balance setting RSR/(RSR+RSL) is set to "0.5". The control amplitude of the air/fuel ratio also increases in a linear-function manner as the balance setting RSR/(RSR+RSL) increases or decreases.

Figure 16:
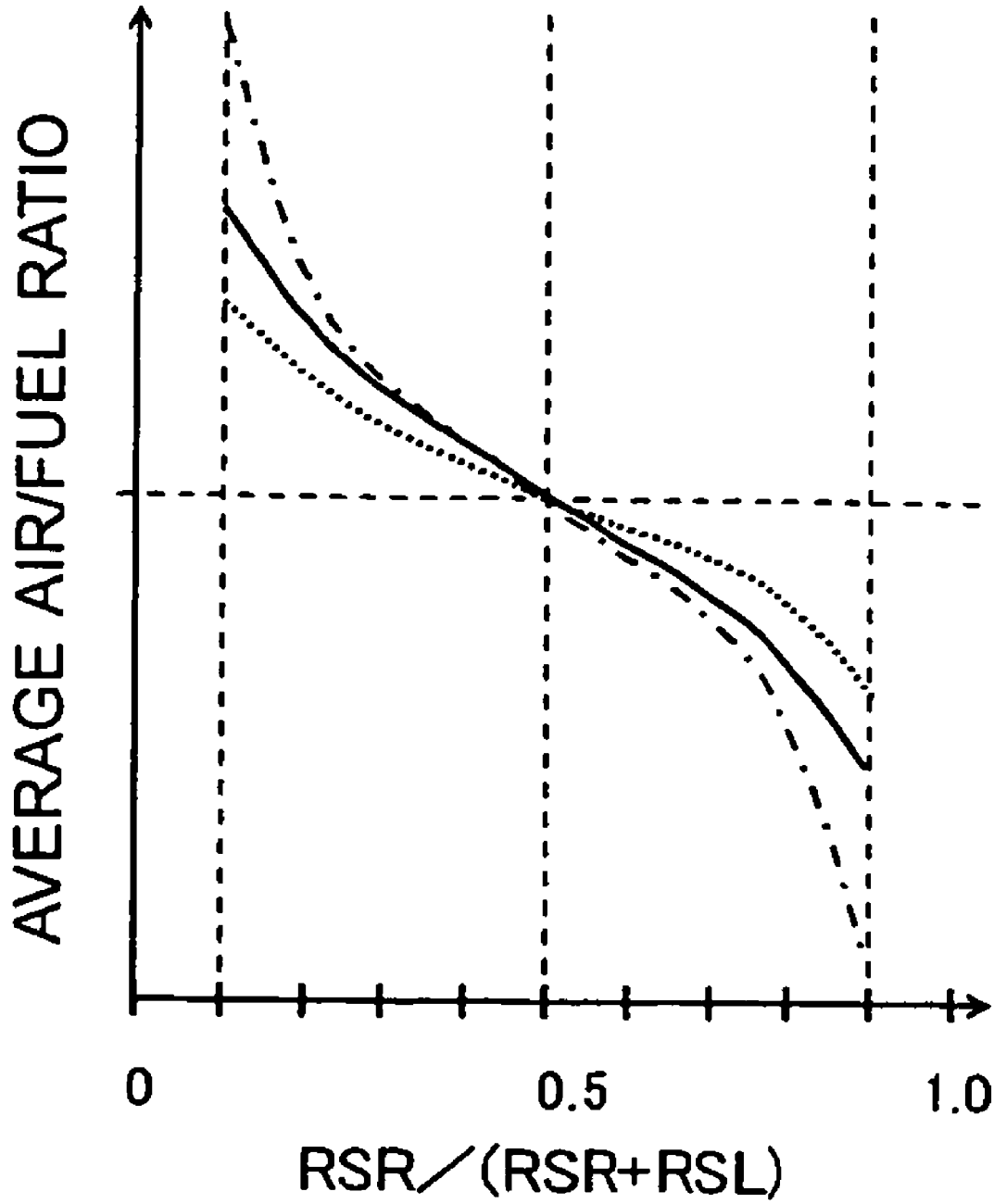
FIG. 16 is another explanatory view showing the average air/fuel ratio when the skip amounts according to the first embodiment of the present invention are controlled alone.

FIG. 16 is another explanatory view showing the average air/fuel ratio AFAVE when the skip amounts RSR and RSL according to the first embodiment of the present invention are controlled alone.

In FIG. 16, even for the same balance setting RSR/(RSR+RSL), by changing each of the sum of the integral constants KIR+KIL, the sum of the skip amounts RSR+RSL, the sum of the delay times TDR+TDL, the dead time of the fuel system Lf, the time constant of the fuel system Tf and the time constant of the $O_2$ sensor To, the effect produced by the balance setting RSR/(RSR+RSL) is increased or decreased to increase or decrease the shift amount of the average air/fuel ratio AFAVE as indicated by a solid line, a dot line and a chain line.

As described above, by changing the balance setting RSR/(RSR+RSL), the average air/fuel ratio AFAVE can be controlled by the nonlinear monotone decreasing. At the same time, a characteristic of the control cycle and the control amplitude, which increase in a linear-function manner as the asymmetry setting becomes larger, can be obtained.

Figures 17A, 17B, 17C:
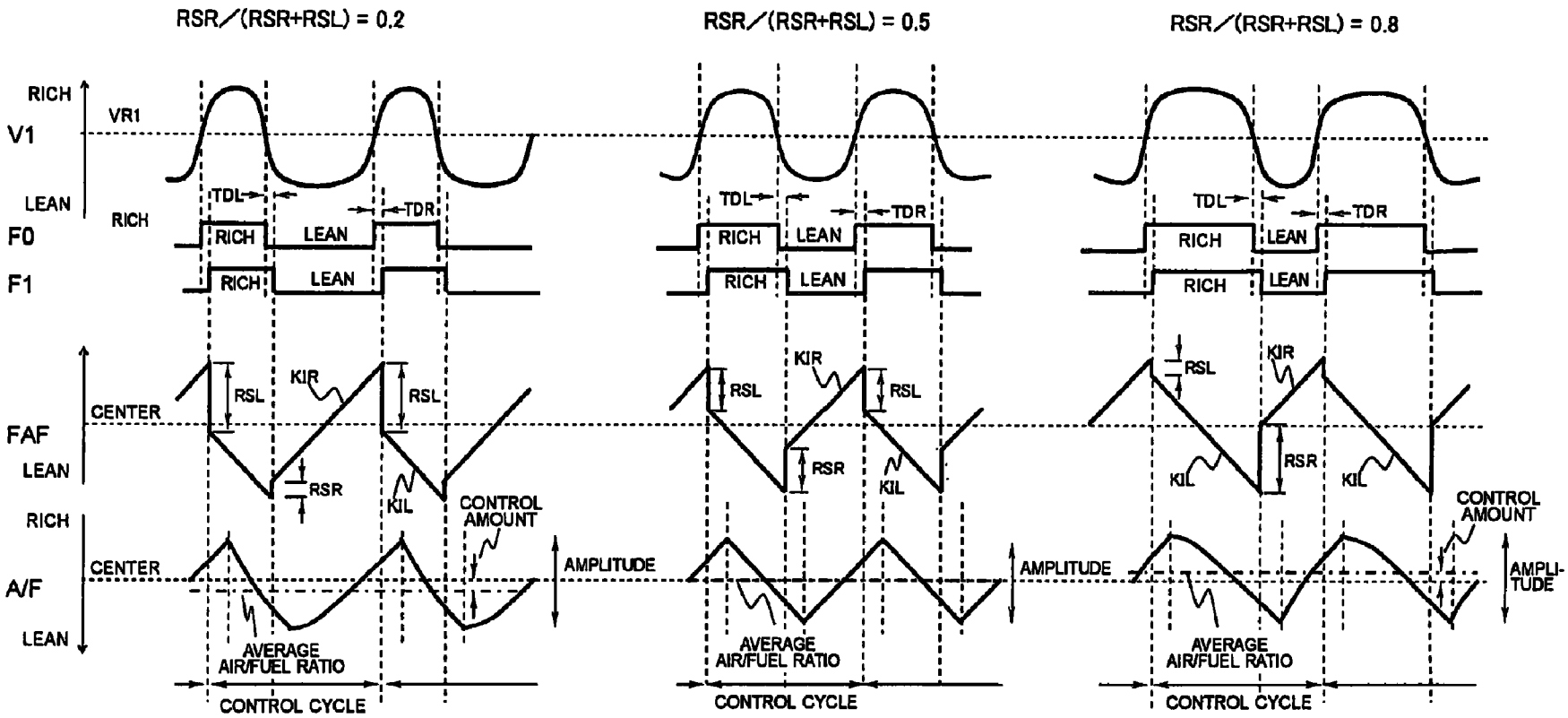
FIGS. 17A to 17C are timing charts showing the behavior of the first air/fuel ratio feedback control when balance setting of the skip amounts according to the first embodiment of the present invention is changed.

FIGS. 17A to 17C are timing charts showing the behavior of the first air/fuel ratio feedback control when the balance setting RSR/(RSR+RSL) according to the first embodiment of the present invention is changed to "0.2", "0.5" and "0.8", respectively.

In FIGS. 17A to 17C, by changing the balance setting RSR/(RSR+RSL), each of ratios of residence times and residence amounts of the air/fuel ratio A/F on the rich side and on the lean side becomes asymmetric with respect to the air/fuel ratio A/F corresponding to the reference voltage VR1 as the center. As a result, the average air/fuel ratio AFAVE for one control cycle can be controlled to the rich side or to the lean side when the center of the symmetry of the balance setting RSR/(RSR+RSL) is "0.5".

Figure 18A:
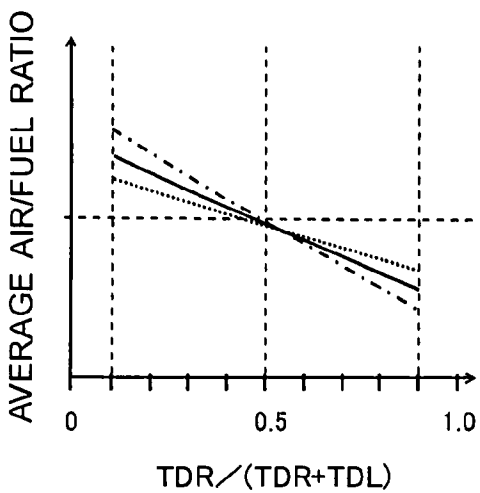
FIGS. 18A to 18C are explanatory views showing the average air/fuel ratio, the control cycle and the control amplitude of the air/fuel ratio when delay times according to the first embodiment of the present invention are controlled alone.
Figure 18B:
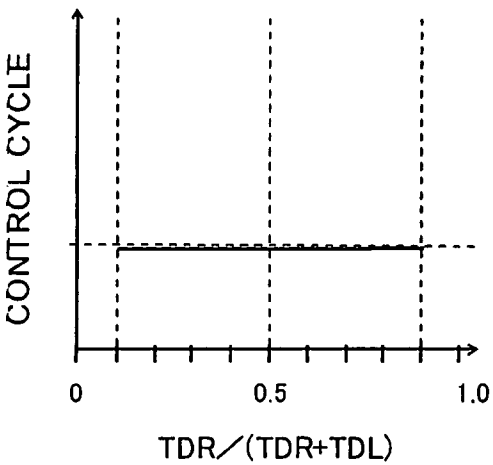
Figure 18C:
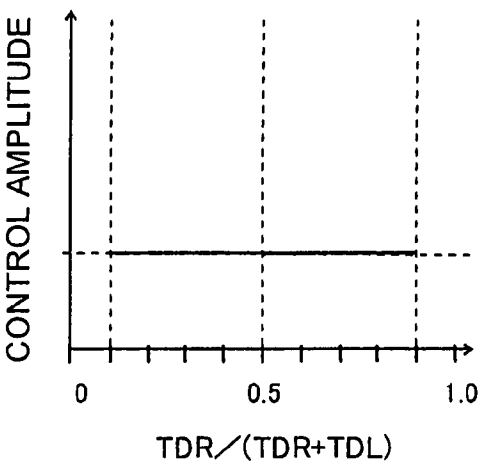

FIGS. 18A to 18C are explanatory views showing the average air/fuel ratio AFAVE, the control cycle and the control amplitude of the air/fuel ratio when the delay times TDR and TDL according to the first embodiment of the present invention are controlled alone.

In FIGS. 18A to 18C, by changing balance setting TDR/(TDR+TDL) between the delay times TDR and TDL, the actual average air/fuel ratio AFAVE changes in a monotonically decreasing manner. By changing the operating conditions, the average air/fuel ratio AFAVE is changed as indicated by a solid line, a dot line and a chain line to normally exhibit an approximately linear characteristic.

The control cycle is scarcely changed even if the balance setting TDR/(TDR+TDL) is changed when the center of the symmetry of the balance setting TDR/(TDR+TDL) is set to "0.5". The control amplitude of the air/fuel ratio is scarcely changed by the balance setting TDR/(TDR+TDL).

Figure 19:
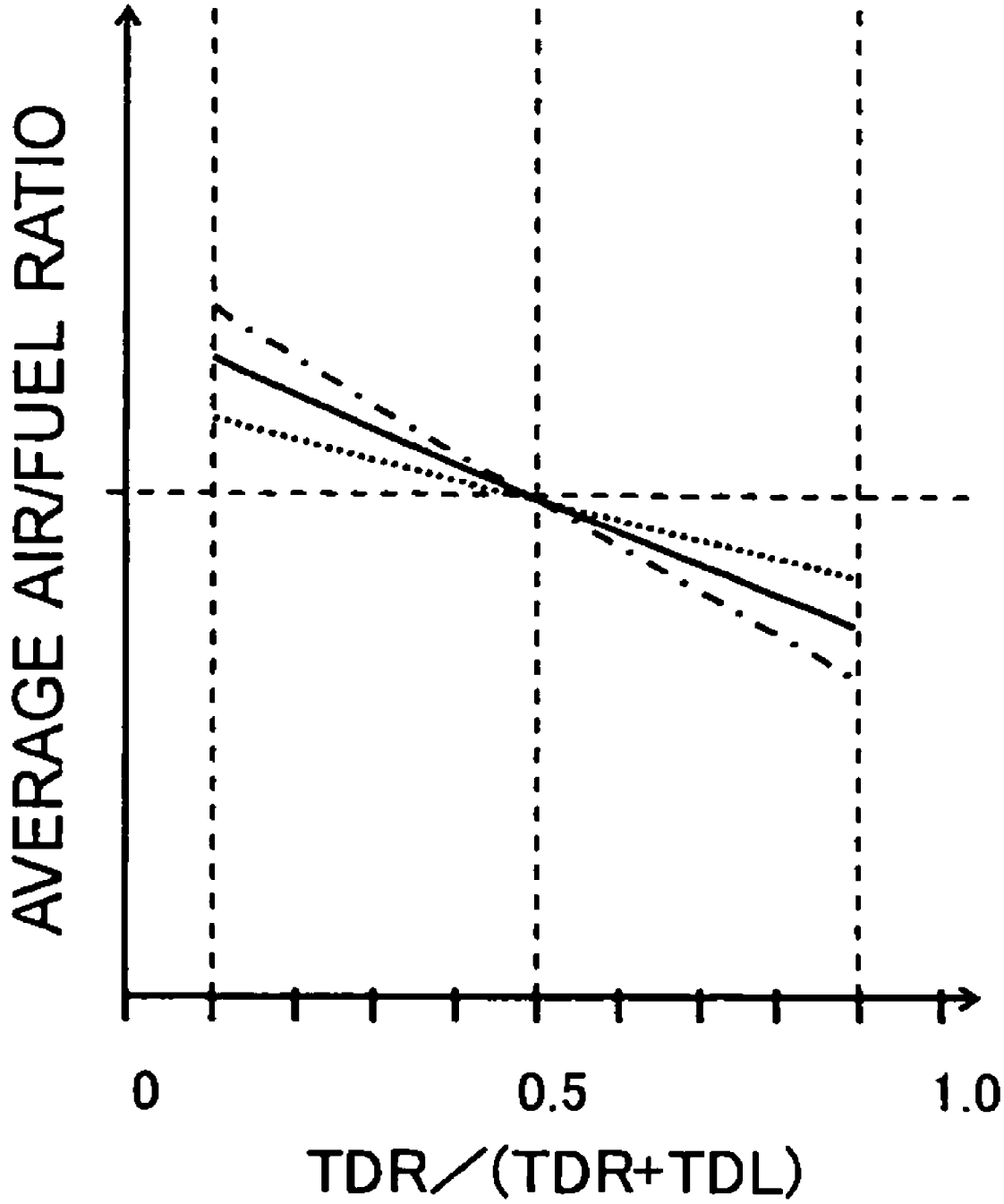
FIG. 19 is another explanatory view showing the average air/fuel ratio when the delay times according to the first embodiment of the present invention are controlled alone.

FIG. 19 is another explanatory view showing the average air/fuel ratio AFAVE when the delay times TDR and TDL according to the first embodiment of the present invention are controlled alone.

In FIG. 19, even for the same balance setting TDR/(TDR+TDL), by changing each of the sum of the integral constants KIR+KIL, the sum of the skip amounts RSR+RSL, the sum of the delay times TDR+TDL, the dead time of the fuel system Lf, the time constant of the fuel system Tf, and the time constant of the $O_2$ sensor To, the effect produced by the balance setting TDR/(TDR+TDL) is increased or decreased to increase or decrease the shift amount of the average air/fuel ratio AFAVE as indicated by a solid line, a dot line and a chain line.

As described above, by changing the balance setting TDR/(TDR+TDL), the average air/fuel ratio AFAVE can be controlled by the nonlinear monotone decrease. At the same time, such a characteristic that the control cycle and the control amplitude are scarcely changed can be obtained.

Figures 20A, 20B, 20C:
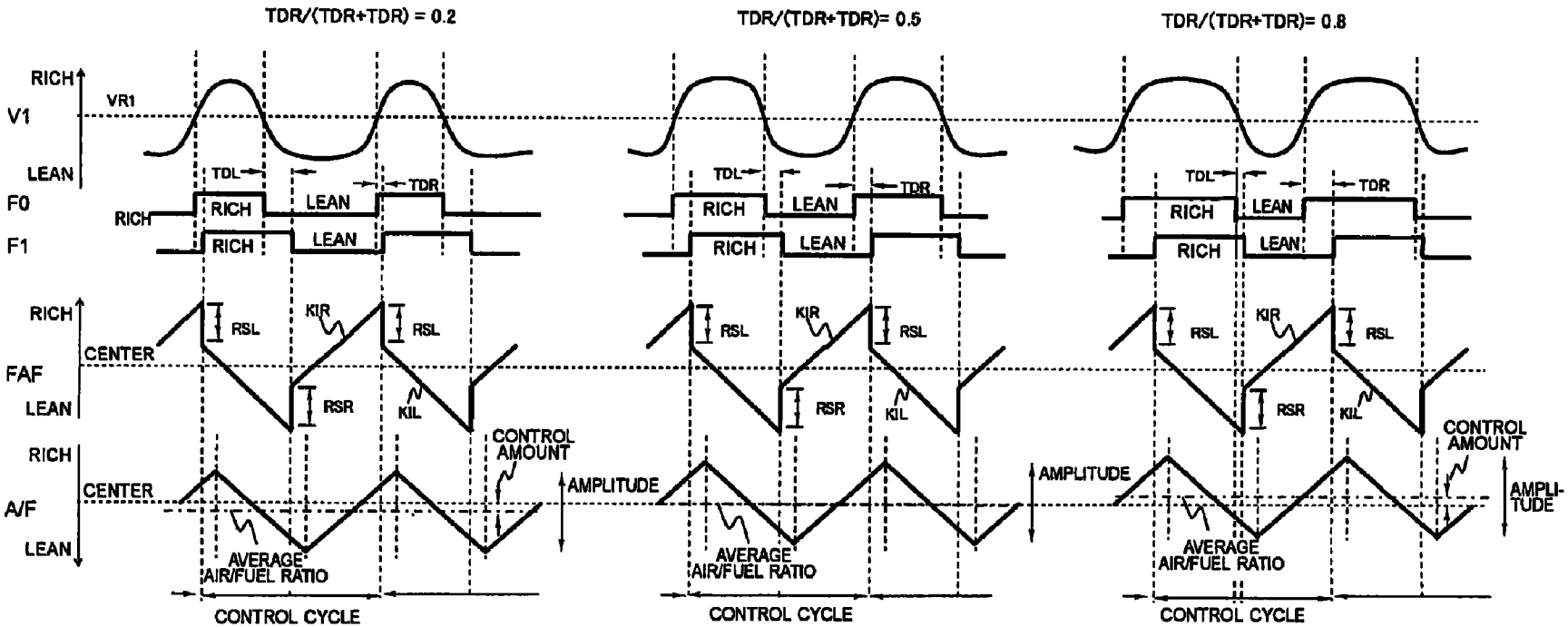
FIGS. 20A to 20C are timing charts showing the behavior of the first air/fuel ratio feedback control when balance setting of the delay times according to the first embodiment of the present invention is changed.

FIGS. 20A to 20C are timing charts showing the behavior of the first air/fuel ratio feedback control when the balance setting TDR/(TDR+TDL) according to the first embodiment of the present invention is changed to "0.2", "0.5" and "0.8", respectively.

In FIGS. 20A to 20C, by changing the balance setting TDR/(TDR+TDL), each of the ratios of residence times and residence amounts of the air/fuel ratio A/F on the rich side and on the lean side becomes asymmetric with respect to the air/fuel ratio A/F corresponding to the reference voltage VR1 as the center. As a result, the average air/fuel ratio AFAVE for one control cycle can be controlled to the rich side or to the lean side when the center of the symmetry of the balance setting TDR/(TDR+TDL) is "0.5".

Figure 21A:
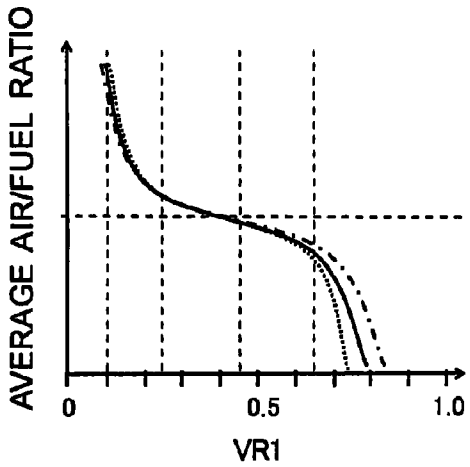
FIGS. 21A to 21C are explanatory views showing the average air/fuel ratio, the control cycle and the control amplitude of the air/fuel ratio when a reference voltage according to the first embodiment of the present invention is controlled alone.
Figure 21B:
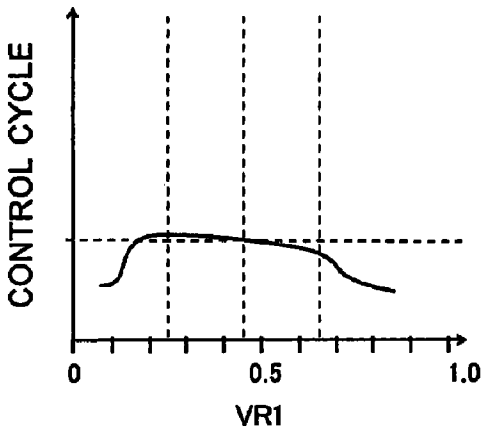
Figure 21C:
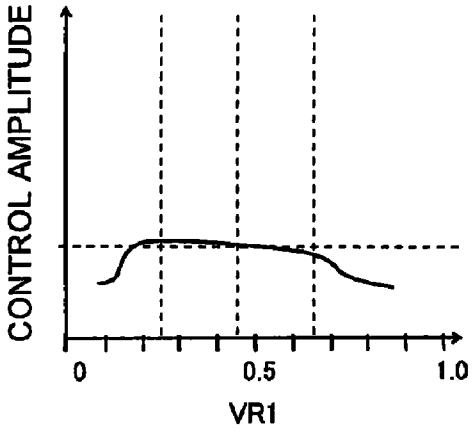

FIGS. 21A to 21C are explanatory views showing the average air/fuel ratio AFAVE, the control cycle and the control amplitude of the air/fuel ratio when the reference voltage VR1 according to the first embodiment of the present invention is controlled alone.

In FIGS. 21A to 21C, by changing the reference voltage VR1, the actual average air/fuel ratio AFAVE changes in a monotonically decreasing manner in accordance with the output characteristic of the upstream $O_2$ sensor shown in FIG. 2. Specifically, the relation between the reference voltage VR1 and the average air/fuel ratio AFAVE becomes almost equal to the static characteristic of the upstream $O_2$ sensor 20.

By changing the operating conditions, the average air/fuel ratio AFAVE is changed as indicated by a solid line, a dot line and a chain line. However, when the reference voltage VR1 indicates a value between 0.25V to 0.65V, the average air/fuel ratio AFAVE normally exhibits a characteristic close to a linear one.

Generally, when the reference voltage VR1 is 0.45V, the center of symmetry is set in the vicinity of the stoichiometric air/fuel ratio AFS. By varying the reference voltage VR1 with respect to 0.45V as the center, the balance setting of the reference voltage VR1 is changed.

The control cycle scarcely changes when the reference voltage VR1 indicates a value between 0.25V to 0.65V. However, once the reference voltage VR1 gets out of the above range, the control cycle gradually decreases. The control amplitude of the air/fuel ratio also scarcely changes when the reference voltage VR1 indicates a value between 0.25V to 0.65V. However, once the reference voltage VR1 gets out of the above range, the control amplitude gradually decreases.

A change in the control cycle and the control amplitude is caused by a change in response delay of the upstream $O_2$ sensor 20 in accordance with the point of operation of the reference voltage VR1.

As described above, by changing the reference voltage VR1 from 0.45V corresponding to the center of symmetry, the average air/fuel ratio AFAVE can be controlled in accordance with the output characteristic of the upstream $O_2$ sensor 20. At the same time, such a characteristic that the control cycle and the control amplitude gradually decrease once the reference voltage VR1 gets out of the range of 0.25V to 0.65V can be obtained.

Figures 22A, 22B, 22C:
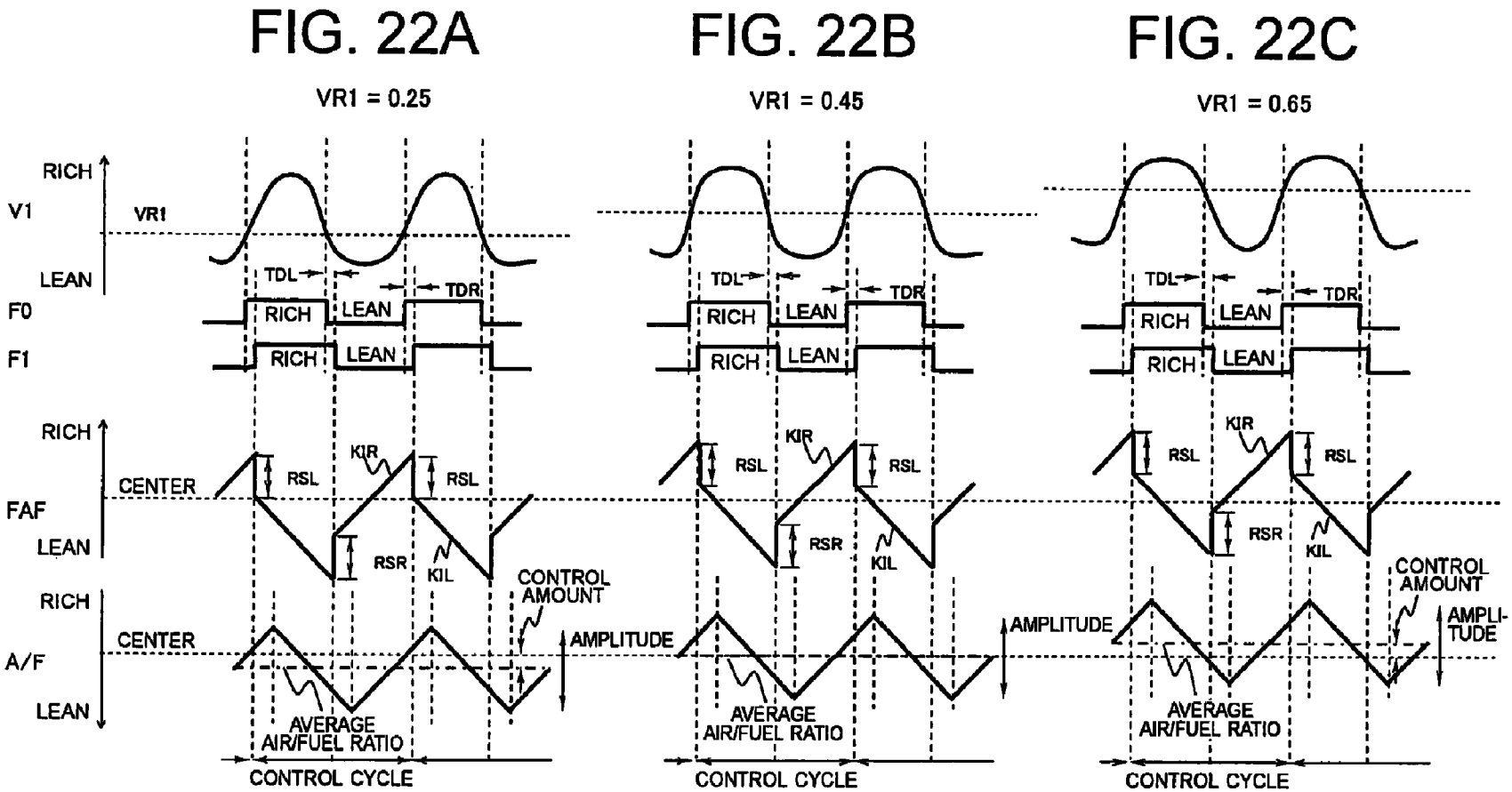
FIGS. 22A to 22C are timing charts showing the behavior of the first air/fuel ratio feedback control when the reference voltage according to the first embodiment of the present invention is changed.

FIGS. 22A to 22C are timing charts showing the behavior of the first air/fuel ratio feedback control when the reference voltage VR1 according to the first embodiment of the present invention is changed to 0.25V, 0.45V and 0.65V.

In FIGS. 22A to 22C, by changing the balance setting of the reference voltage VR1, the average air/fuel ratio AFAVE for one control cycle can be controlled to the rich side or to the lean side with respect to the center of the symmetry of the reference voltage VR1, which is set to 0.45V.

A shift range ΔAFAVE of the average air/fuel ratio AFAVE when each of the controlling constants is controlled alone will be described.

First, for the integral constants KIR and KIL, the shift range ΔAFAVE of the average air/fuel ratio AFAVE varies depending on set values of the controlling constants or the operating conditions. However, within the range where the balance setting KIR/(KIR+KIL) does not become excessive, for example, within the range of "0.3" to "0.7", the shift range ΔAFAVE of the average air/fuel ratio AFAVE becomes about "0.3".

Even for the skip amounts RSR and RSL, as in the case of the integral constants KIR and KIL, the shift range ΔAFAVE of the average air/fuel ratio AFAVE becomes about "0.3".

Also for the delay times TDR and TDL, as in the case of the integral constants KIR and KIL, the shift range ΔAFAVE of the average air/fuel ratio AFAVE becomes about "0.05".

For the reference voltage VR1, as long as the reference voltage VR1 indicates a value between 0.25V and 0.65V, the shift range ΔAFAVE of the average air/fuel ratio AFAVE becomes about "0.1".

If the shift range ΔAFAVE of the average air/fuel ratio AFAVE can be increased, the control performance of the second air/fuel ratio feedback control by the downstream $O_2$ sensor 21 can be improved. Therefore, it is desirable that the shift range ΔAFAVE be set as large as possible. In this case, for example, the shift range ΔAFAVE is set to "0.5".

If the shift range ΔAFAVE=0.5 is to be realized, it is found that this shift range cannot be realized by merely controlling the controlling constants alone; it is necessary to control two or more controlling constants.

If the balance setting of each of the controlling constants becomes excessive, the control cycle and the control amplitude of the air/fuel ratio become large to increase a strain of behavior. It is therefore desirable that the balance setting be as small as possible. By controlling as many controlling constants as possible, the necessary shift range ΔAFAVE of the average air/fuel ratio AFAVE can be realized without excessive balance setting of each of the controlling constants.

As described above, however, the shift amount of the average air/fuel ratio AFAVE when two or more controlling constants are simultaneously controlled does not become equal to the result of a simple addition of the shift amounts when each of the controlling constants is controlled alone.

Hereinafter, the behavior of the average air/fuel ratio AFAVE when two or more controlling constants are simultaneously controlled will be described.

Figure 23A:
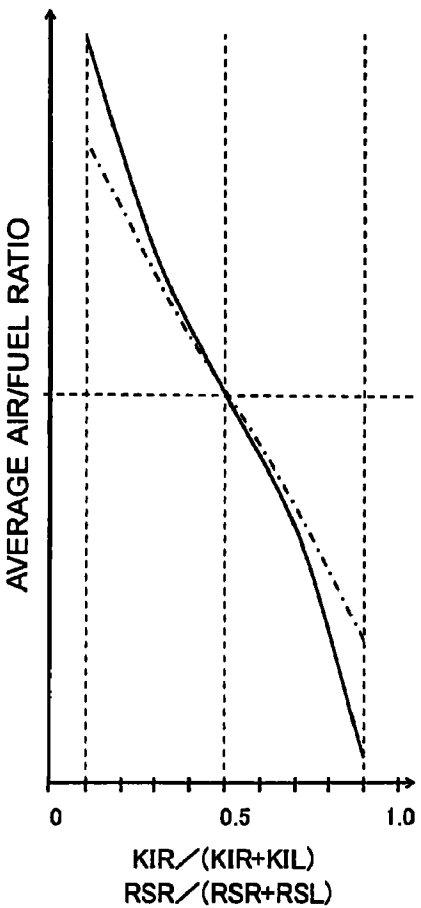
FIGS. 23A to 23C are explanatory views showing the average air/fuel ratio, the control cycle and the control amplitude of the air/fuel ratio when the integral constants and the skip amounts according to the first embodiment of the present invention are simultaneously controlled, and when the integral constants and the skip amounts are separately controlled and the results are simply added, in comparison with each other.
Figure 23B:
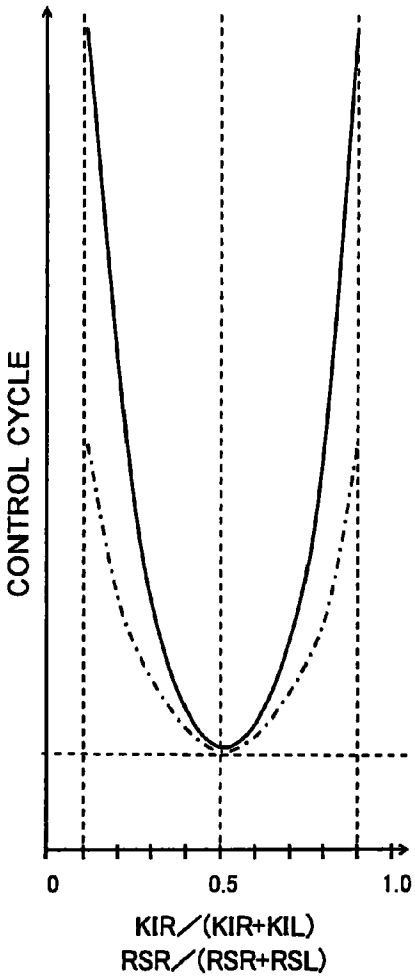
Figure 23C:
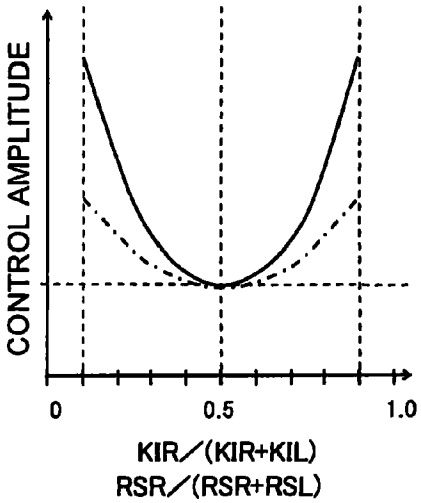

FIGS. 23A to 23C are explanatory views showing the average air/fuel ratio AFAVE (FIG. 23A), the control cycle (FIG. 23B), and the control amplitude of the air/fuel ratio (FIG. 23C) in the case where the integral constants KIR and KIL and the skip amounts RSR and RSL according to the first embodiment of the present invention are simultaneously controlled (solid lines), and in the case where the integral constants KIR and KIL and the skip amounts RSR and RSL are controlled separately and the results are simply added (chain lines), in comparison with each other.

In FIGS. 23A to 23C, it is found that each of the average air/fuel ratio AFAVE, the control cycle, and the control amplitude of the air/fuel ratio is increased by an interaction when the integral constants KIR and KIL and the skip amounts RSR and RSL are simultaneously controlled.

Figure 24:
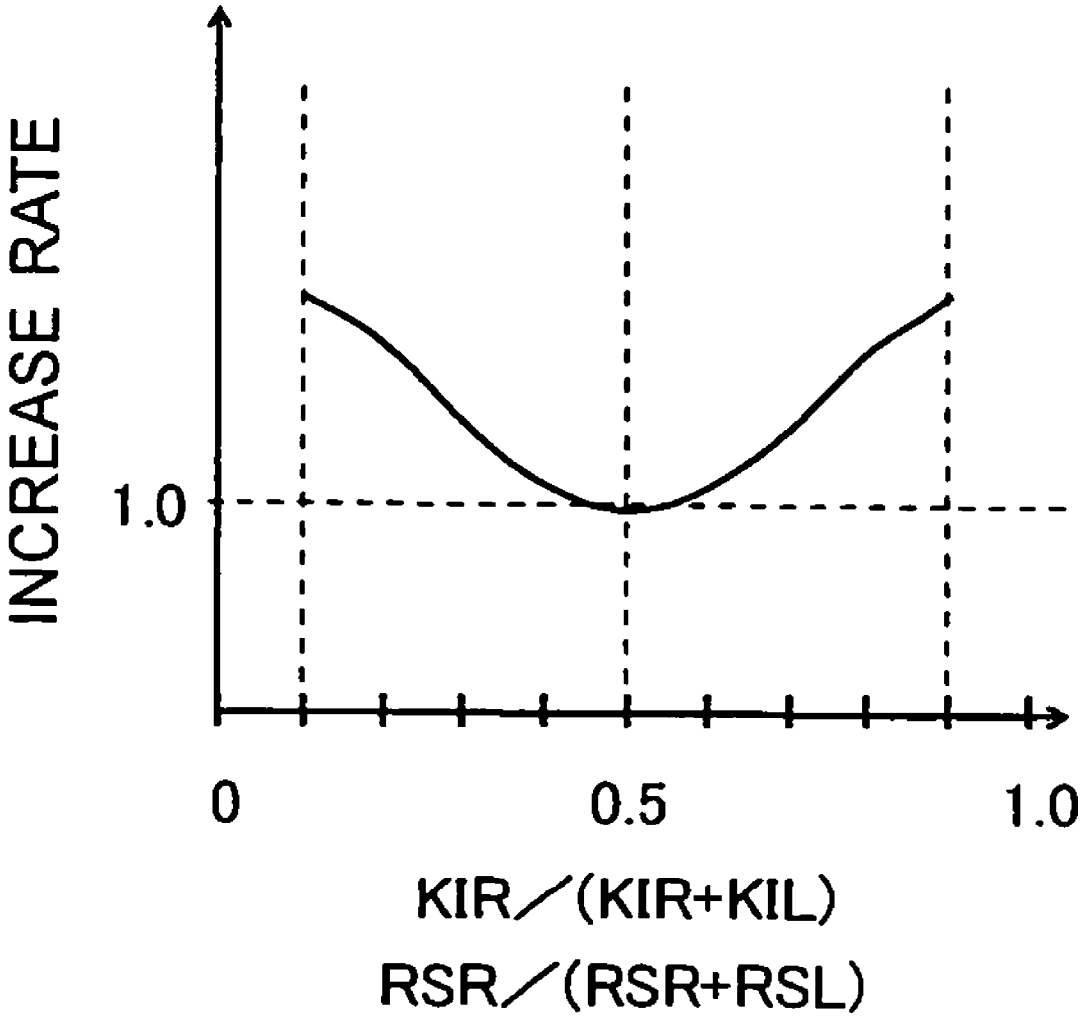
FIG. 24 is an explanatory view showing an increase rate of the average air/fuel ratio when the integral constants and the skip amounts according to the first embodiment of the present invention are simultaneously controlled, and when the integral constants and the skip amounts are separately controlled and the results are simply added.

FIG. 24 is an explanatory view showing an increase rate of the average air/fuel ratio when the integral constants KIR and KIL and the skip amounts RSR and RSL according to the first embodiment are controlled simultaneously and when the integral constants KIR and KIL, and the skip amounts RSR and RSL are separately controlled and the results are simply added.

In FIG. 24, the increase rate of the average air/fuel ratio AFAVE nonlinearly increases and decreases by the points of operation of the balance setting KIR/(KIR+KIL) and the balance setting RSR/(RSR+RSL).

An increase/decrease in shift amount of the average air/fuel ratio AFAVE by the interaction varies depending on the sum of the integral constants KIR+KIL, the sum of the skip amounts RSR+RSL, the sum of the delay times TDR+TDL, the point of operation of the reference voltage VR1, the point of operation of the balance setting, the responsiveness of the control target and the operating conditions.

FIGS. 25A to 25C are timing charts showing the behavior of the first air/fuel ratio feedback control when the balance setting KIR/(KIR+KIL) and the balance setting RSR/(RSR+RSL) according to the first embodiment of the present invention are simultaneously changed to "0.2", "0.5" and "0.8".

In FIGS. 25A to 25C, by simultaneously changing the balance setting KIR/(KIR+KIL) and the balance setting RSR/(RSR+RSL), the asymmetry of the residence times of the air/fuel ratio A/F on the rich side and the lean side and that of the ratio of the residence amounts greatly increase. At the same time, a nonlinear strain of the behavior of the air/fuel ratio A/F greatly increases.

Figure 26A:
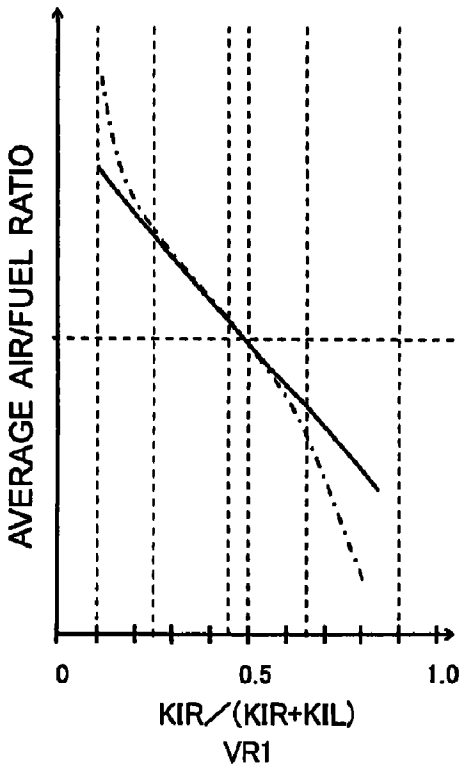
FIGS. 26A to 26C are explanatory views showing the average air/fuel ratio, the control cycle and the control amplitude of the air/fuel ratio when the integral constants and the reference voltage according to the first embodiment of the present invention are simultaneously controlled, and when the integral constants and the reference voltage are separately controlled and the results are simply added, in comparison with each other.
Figure 26B:
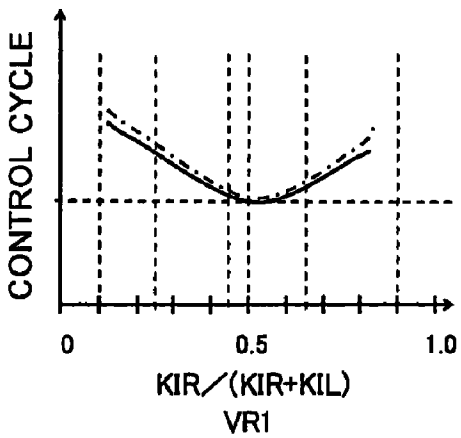
Figure 26C:
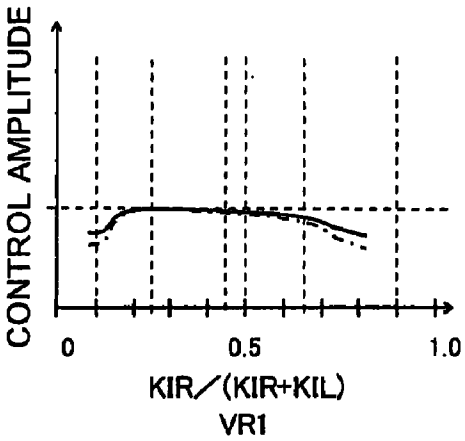

FIGS. 26A to 26C are explanatory views showing the average air/fuel ratio AFAVE (FIG. 26A), the control cycle (FIG. 26B), and the control amplitude of the air/fuel ratio (FIG. 26C) in the case where the integral constants KIR and KIL and the reference voltage VR1 according to the first embodiment of the present invention are simultaneously controlled (solid lines), and in the case where the integral constants KIR and KIL and the reference voltage VR1 are controlled separately and the results are simply added (chain lines) in comparison with each other.

In FIGS. 26A to 26C, it is found that the control cycle and the control amplitude of the air/fuel ratio gradually decrease once the reference voltage VR1 gets out of the range of 0.25V to 0.65V where the reference voltage VR1 exhibits a characteristic close to a linear one. Therefore, the effect by the balance setting KIR/(KIR+KIL) is lowered to decrease the shift amount of the average air/fuel ratio AFAVE. As a result, each of the average air/fuel ratio AFAVE, the control cycle and the control amplitude of the air/fuel ratio is decreased by an interaction.

Figure 27:
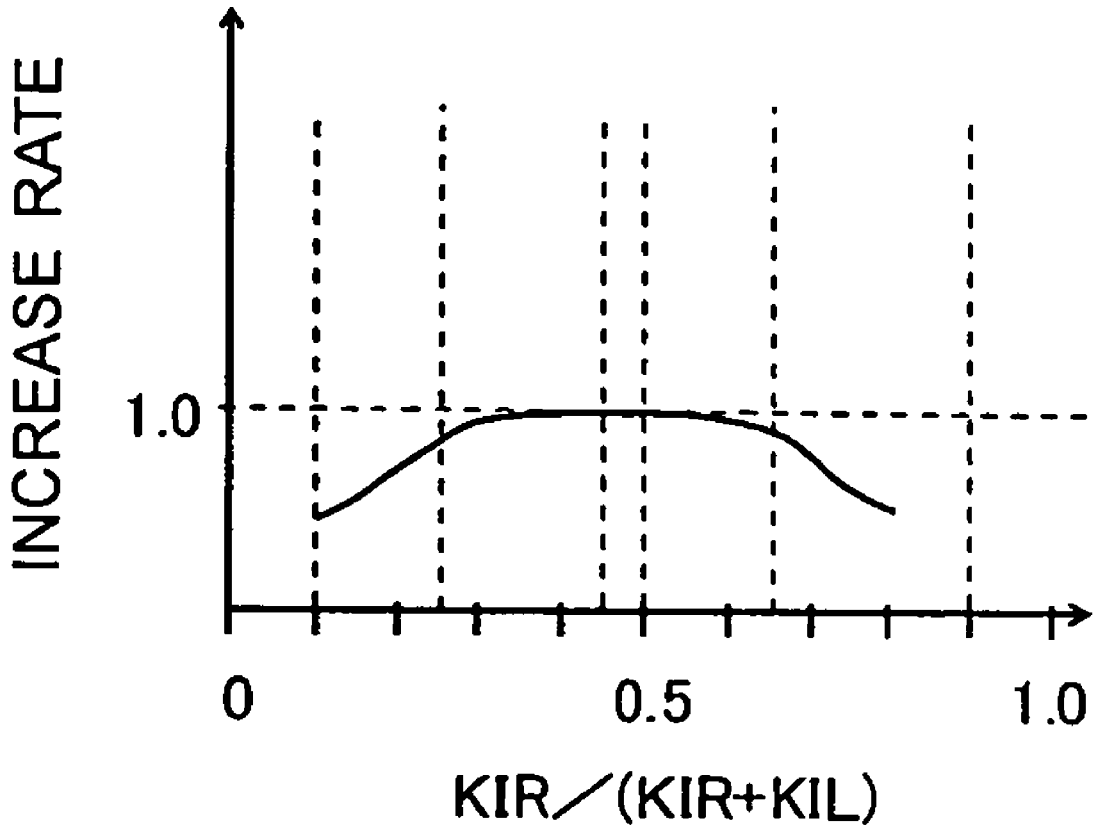
FIG. 27 is an explanatory view showing an increase rate of the average air/fuel ratio when the integral constants and the reference voltage according to the first embodiment of the present invention are simultaneously controlled, and when the integral constants and the reference voltage are separately controlled and the results are simply added.

FIG. 27 is an explanatory view showing an increase rate of the average air/fuel ratio AFAVE when the integral constants KIR and KIL and the reference voltage VR1 according to the first embodiment of the present invention are controlled simultaneously and when the integral constants KIR and KIL, and the reference voltage VR1 are separately controlled and the results are simply added.

In FIG. 27, the increase rate of the average air/fuel ratio AFAVE nonlinearly increases and decreases by the points of operation of the balance setting KIR/(KIR+KIL) and the reference voltage VR1.

An increase/decrease in shift amount of the average air/fuel ratio AFAVE by the interaction varies depending on the sum of the integral constants KIR+KIL, the sum of the skip amounts RSR+RSL, the sum of the delay times TDR+TDL, the point of operation of the reference voltage VR1, the point of operation of the balance setting, the responsiveness of the control target and the operating conditions.

Figure 28A:
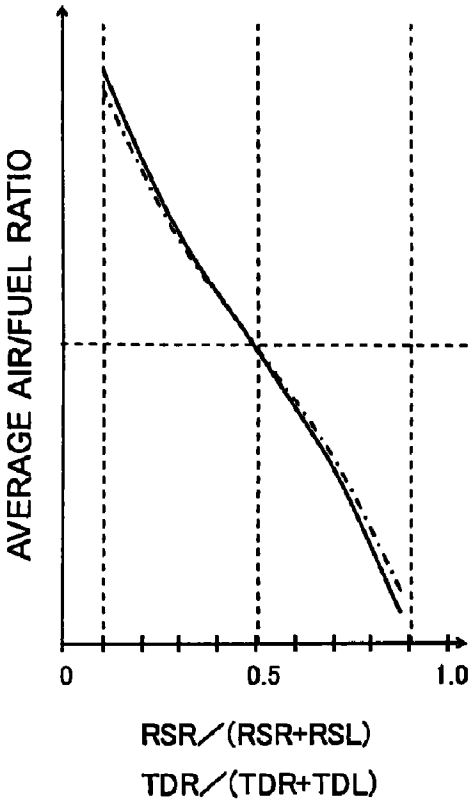
FIGS. 28A to 28C are explanatory views showing the average air/fuel ratio, the control cycle and the control amplitude of the air/fuel ratio when the skip amounts and the delay times according to the first embodiment of the present invention are simultaneously controlled, and when the skip amounts and the delay times are separately controlled and the results are simply added in comparison with each other.
Figure 28B:
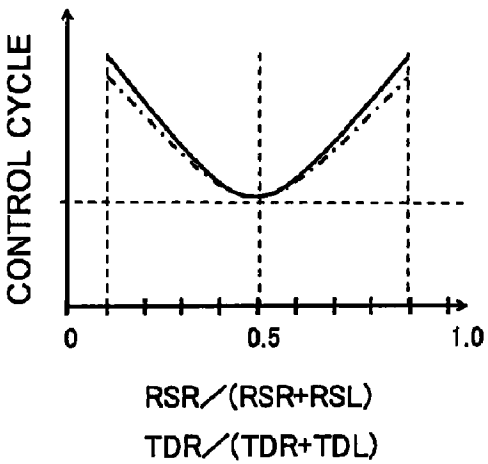
Figure 28C:
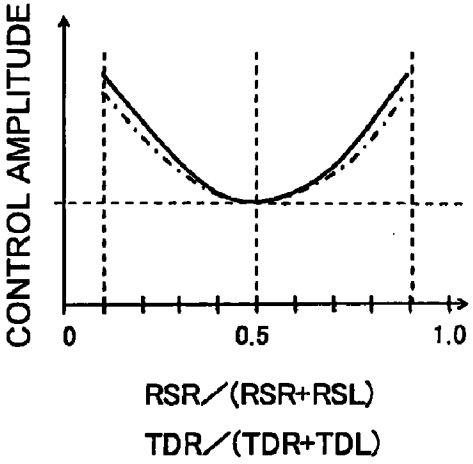

FIGS. 28A to 28C are explanatory views showing the average air/fuel ratio AFAVE (FIG. 28A), the control cycle (FIG. 28B), and the control amplitude of the air/fuel ratio (FIG. 28C) in the case where the skip amounts RSR and RSL and the delay times TDR and TDL according to the first embodiment of the present invention are simultaneously controlled (solid lines) and in the case where the skip amounts RSR and RSL and the delay times TDR and TDL are controlled separately and the results are simply added (chain lines), in comparison with each other.

In FIGS. 28A to 28C, it is found that each of the average air/fuel ratio AFAVE, the control cycle and the control amplitude of the air/fuel ratio is increased by an interaction when the skip amounts RSR and RSL and the delay times TDR and TDL are simultaneously controlled.

Figure 29:
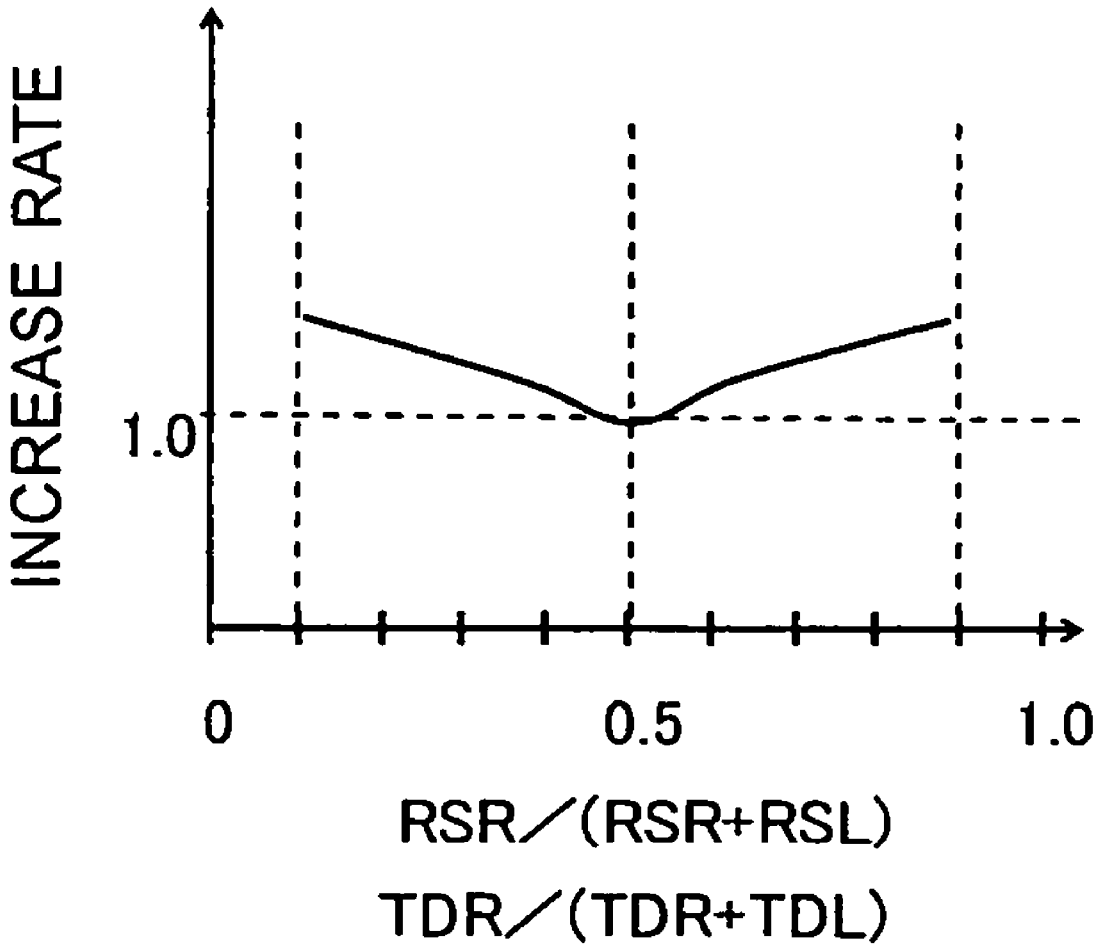
FIG. 29 is an explanatory view showing an increase rate of the average air/fuel ratio when the skip amounts and the delay times according to the first embodiment of the present invention are simultaneously controlled, and when the skip amounts and the delay times are separately controlled and the results are simply added.
Figure 30A:
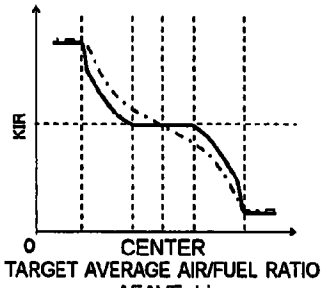
FIGS. 30A to 30K are first explanatory views where
Figure 30B:
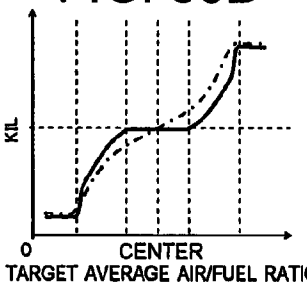
Figure 30C:
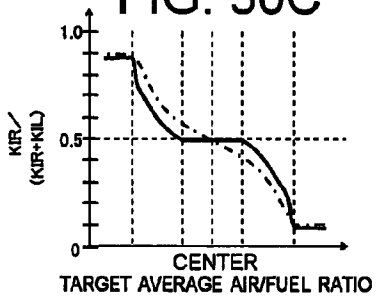
Figure 30D:
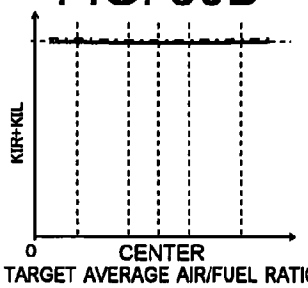
Figure 30E:
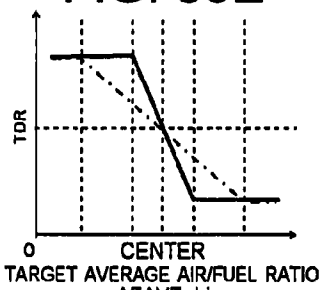
Figure 30F:
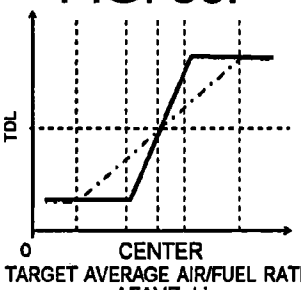
Figure 30G:
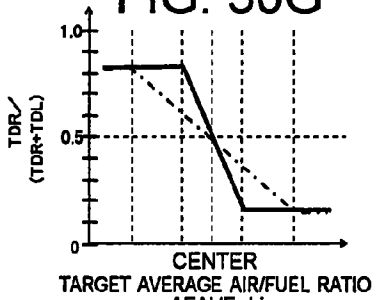
Figure 30H:
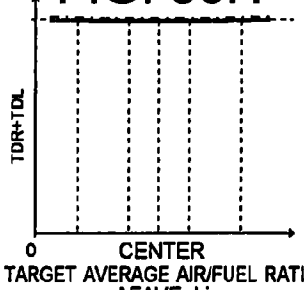
Figure 30I:
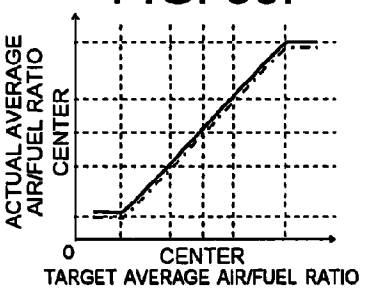
Figure 30J:
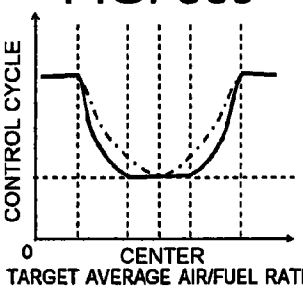
Figure 30K:
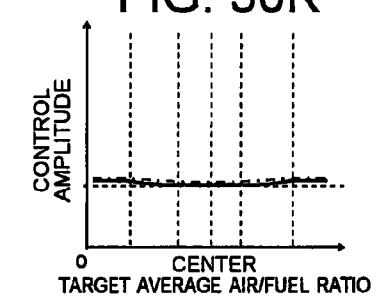
Figure 31A:
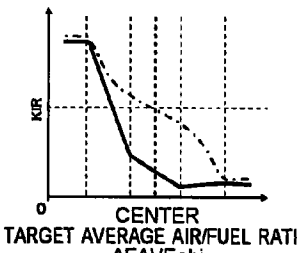
FIGS. 31A to 31K are second explanatory views where
Figure 31B:
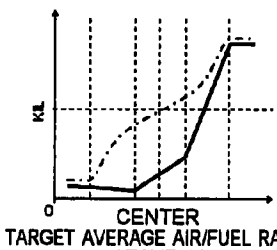
Figure 31C:
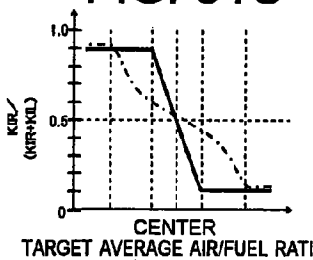
Figure 31D:
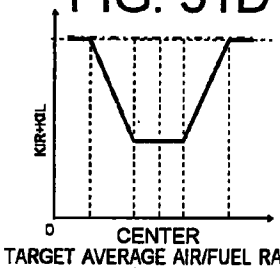
Figure 31E:
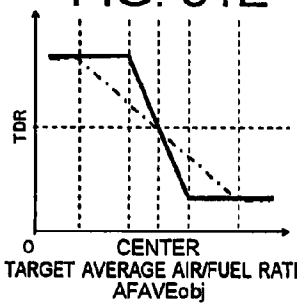
Figure 31F:
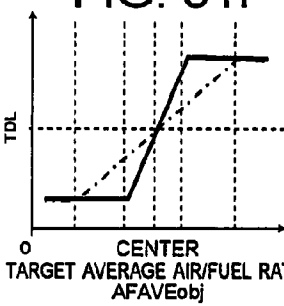
Figure 31G:
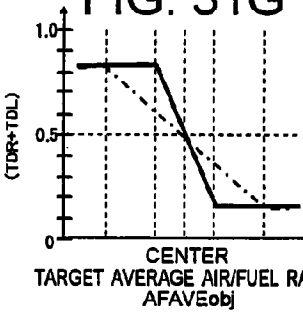
Figure 31H:
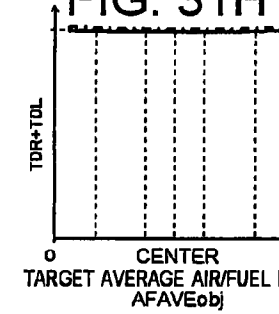
Figure 31I:
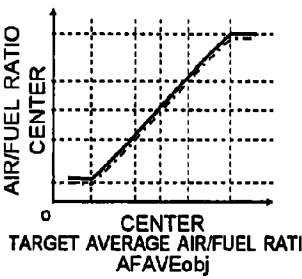
Figure 31J:
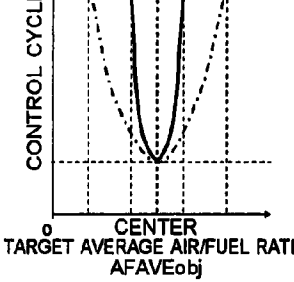
Figure 31K:
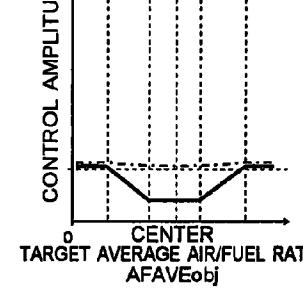
Figure 32A:
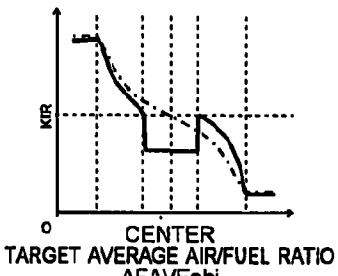
FIGS. 32A to 32K are third explanatory views where
Figure 32B:
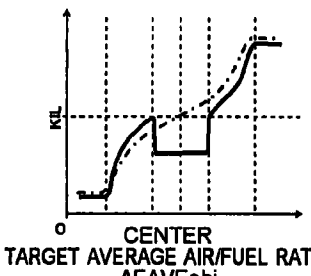
Figure 32C:
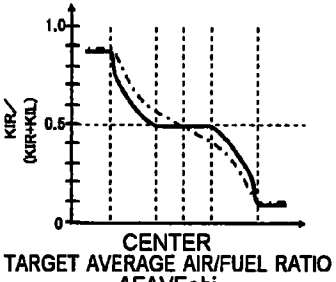
Figure 32D:
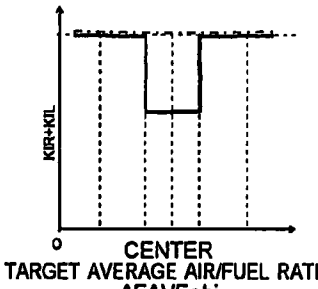
Figure 32E:
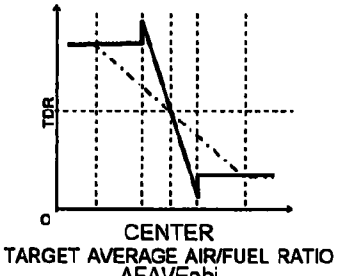
Figure 32F:
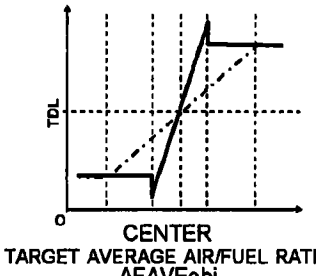
Figure 32G:
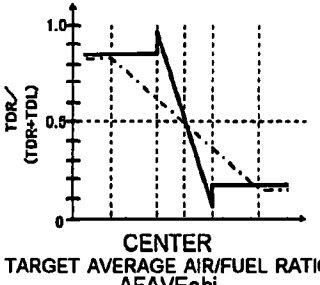
Figure 32H:
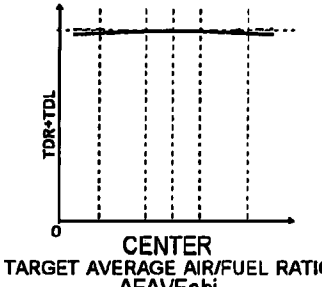
Figure 32I:
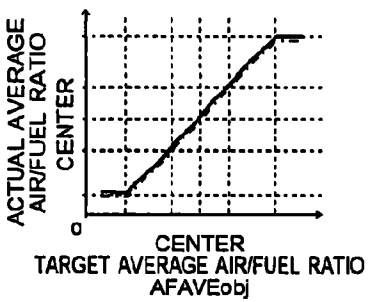
Figure 32J:
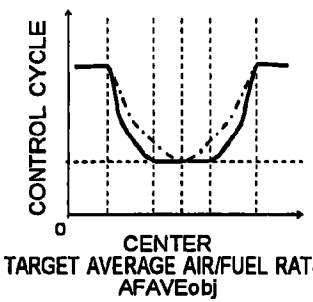
Figure 32K:
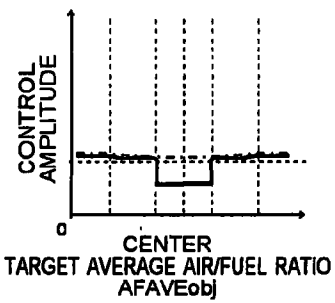

FIG. 29 is an explanatory view showing an increase rate of the average air/fuel ratio AFAVE when the skip amounts RSR and RSL and the delay times TDR and TDL according to the first embodiment of the present invention are controlled simultaneously, and when the skip amounts RSR and RSL and the delay times TDR and TDL are separately controlled and the results are simply added.

In FIG. 29, the increase rate of the average air/fuel ratio AFAVE nonlinearly increases and decreases by the points of operation of the balance setting RSR/(RSR+RSL) and the balance setting TDR/(TDR+TDL).

An increase/decrease in shift amount of the average air/fuel ratio AFAVE by the interaction varies depending on the sum of the integral constants KIR+KIL, the sum of the skip amounts RSR+RSL, the sum of the delay times TDR+TDL, the point of operation of the reference voltage VR1, the point of operation of the balance setting, the responsiveness of the control target and the operating conditions.

As described above, when two or more controlling constants are simultaneously controlled, the changes of the controlling constants affect each other to cause an interaction.

Moreover, as the number of controlling constants to be simultaneously controlled increases to increase the shift range ΔAFAVE of the average air/fuel ratio, the interaction becomes more complex.

Therefore, it is necessary to manage the controlling constants by using the same index.

Next, the setting of the controlling constants in accordance with the target average air/fuel ratio AFAVEobj will be described.

The controlling constants for realizing the target average air/fuel ratio AFAVEobj can be set by a desk numerical calculation using a physical model or an experimental technique.

For example, after a constant is preset by a desk numerical calculation, the ultimate error may be corrected by using an experimental technique. In any case, the target average air/fuel ratio AFAVEobj and the actual average air/fuel ratio AFAVE can be made identical with each other by a relatively simple error correction method.

In this embodiment, first, an appropriate initial value is preset for each of one-dimensional maps for calculating the controlling constant from the target average air/fuel ratio AFAVEobj. Based on the converter calculation routine shown in FIG. 10, the controlling constant is calculated for each target average air/fuel ratio AFAVEobj. At the same time, the actual average air/fuel ratio AFAVE is obtained by a desk numerical calculation or an experimental technique.

Subsequently, an error from the actual average air/fuel ratio AFAVE is obtained for each target average air/fuel ratio AFAVEobj. The obtained error is multiplied by an appropriate constant to correct the set value in the one-dimensional map for each target average air/fuel ratio AFAVEobj so as to reduce the error.

For example, the one-dimensional map of the reference voltage VR1 or the delay times TDR and TDL, in which the shift range ΔAFAVE of the average air/fuel ratio AFAVE is relatively small, is fixed to a preset value. The one-dimensional map of the integral constants KIR and KIL or the skip amounts RSR and RSL, in which the shift range ΔAFAVE is relatively large, is corrected or the like. By such a modification, the error can be corrected in a simpler manner.

Moreover, by setting the controlling constants by using the target average air/fuel ratio AFAVEobj as a common index, appropriate controlling constants can be combined with each other so as to obtain the maximum advantage of each of the controlling constants in accordance with the point of operation of the average air/fuel ratio AFAVE while keeping the shift amount of the average air/fuel ratio AFAVE. As a result, the shift amount of the average air/fuel ratio AFAVE can be finely controlled.

FIGS. 30A to 30K are first explanatory views showing characteristics of the integral constants KIR and KIL with respect to the target average air/fuel ratio AFAVEobj (FIG. 30A to 30D), characteristics of the delay times TDR and TDL with respect to the target average air/fuel ratio AFAVEobj (FIGS. 30E to 30H), and the actual average air/fuel ratio (FIG. 30I), the control cycle (FIG. 30J), and the control amplitude of the air/fuel ratio (FIG. 30K) with respect to the target average air/fuel ratio AFAVEobj according to the first embodiment of the present invention.

In FIGS. 30A to 30K, as indicated by solid lines, while the shift amount of the average air/fuel ratio AFAVE is small, the balance setting of the delay times TDR and TDL, for which the shift range ΔAFAVE is relatively small and changes in the control cycle and the control amplitude are small, is made large. At this time, the balance setting of the integral constants KIR and KIL, for which the shift range ΔAFAVE is relatively large, is made small.

Chain lines indicate normal setting. If the balance setting of the reference voltage VR1 is made large instead of making the balance setting of the delay times TDR and TDL large, the same effect can be produced. Moreover, if the balance setting of the skip amounts RSR and RSL is made small instead of making the balance setting of the integral constants KIR and KIL small, the same effect can be produced.

By setting the controlling constants as described above, the shift amount of the average air/fuel ratio AFAVE can be finely controlled to improve the control accuracy of the average air/fuel ratio AFAVE in the vicinity of the stoichiometric air/fuel ratio AFS. At the same time, an increase in control cycle can be reduced to prevent the stabilization performance for the disturbance from being deteriorated.

On the other hand, as the shift amount of the average air/fuel ratio AFAVE increases, the balance setting of the integral constants KIR and KIL or the skip amounts RSR and RSL, for which the shift range ΔAFAVE is relatively large, is increased to ensure the shift amount of the average air/fuel ratio AFAVE.

FIGS. 31A to 31K are second explanatory views showing characteristics of the integral constants KIR and KIL with respect to the target average air/fuel ratio AFAVEobj (FIG. 31A to 31D), characteristics of the delay times TDR and TDL with respect to the target average air/fuel ratio AFAVEobj (FIGS. 31E to 31H), and the actual average air/fuel ratio (FIG. 31I), the control cycle (FIG. 31J), and the control amplitude of the air/fuel ratio (FIG. 31K) with respect to the target average air/fuel ratio AFAVEobj according to the first embodiment of the present invention.

In FIGS. 31A to 31K, as indicated by solid lines, while the shift amount of the average air/fuel ratio AFAVE is small, the sum of the integral constants KIR+KIL is set small.

Chain lines indicate normal setting. If the sum of the skip amounts RSR+RSL is set small while the sum of the integral constants KIR+KIL is set small, the same effect can be produced.

If the sum of the integral constants KIR+KIL, and the sum of the skip amounts RSR+RSL are set small, the shift amount of the average air/fuel ratio AFAVE becomes smaller even with the same balance setting. Therefore, in order to ensure the same shift amount, the balance setting is made large.

On the other hand, as the shift amount of the average air/fuel ratio AFAVE becomes larger, the sum of the integral constants KIR+KIL, and the sum of the skip amounts RSR+RSL are increased.

As a result, the shift amount can be increased even with the same balance setting.

By setting the controlling constants as described above, the control cycle in the vicinity of the stoichiometric air/fuel ratio AFS becomes large and the disturbance stabilization performance is deteriorated. However, since the control amplitude can be set small, a torque variation amount becomes small to prevent the drivability from being deteriorated.

On the other hand, as the shift amount of the average air/fuel ratio AFAVE becomes larger, the sum of the integral constants KIR+KIL, and the sum of the skip amounts RSR+RSL are set larger to ensure the shift amount of the average air/fuel ratio AFAVE.

FIGS. 32A to 32K are third explanatory views showing characteristics of the integral constants KIR and KIL with respect to the target average air/fuel ratio AFAVEobj (FIG. 32A to 32D), characteristics of the delay times TDR and TDL with respect to the target average air/fuel ratio AFAVEobj (FIGS. 32E to 32H), and the actual average air/fuel ratio (FIG. 32I), the control cycle (FIG. 32J), and the control amplitude of the air/fuel ratio (FIG. 32K) with respect to the target average air/fuel ratio AFAVEobj according to the first embodiment of the present invention.

In FIGS. 32A to 32K, while the shift amount of the average air/fuel ratio AFAVE is small, the balance setting of the delay times TDR and TDL is made large whereas the balance setting of the integral constants KIR and KIL is made small. Moreover, the sum of the integral constants KIR+KIL is set small.

On the other hand, as the shift amount of the average air/fuel ratio AFAVE becomes larger, the balance setting of the integral constants KIR and KIL is made large whereas the sum of the integral constants KIR+KIL is set large.

By setting the controlling constants as described above, the control accuracy of the average air/fuel ratio AFAVE in the vicinity of the stoichiometric air/fuel ratio AFS can be improved. At the same time, changes in the control cycle and the control amplitude can be reduced in a well-balanced manner to prevent the drivability from being deteriorated.

Moreover, as the shift amount of the average air/fuel ratio AFAVE increases, the shift amount of the average air/fuel ratio AFAVE can be ensured.

The setting that takes advantage of the freedom of the controlling constants as described above is changed depending on the operating conditions.

Specifically, for example, during idling, the control amplitude is reduced in the vicinity of the stoichiometric air/fuel ratio AFS as shown in FIG. 31 to set the controlling constants so as to place importance on the drivability with a small torque variation. With a middle load, the control cycle and the control amplitude are reduced in the vicinity of the stoichiometric air/fuel ratio AFS as shown in FIG. 32 to set the controlling constants so as to improve the stabilization performance for the disturbance and the drivability in a well-balanced manner. With a large load, the cleaning responsibility of the catalyst becomes higher. Therefore, a large number of controlling constants are controlled to enhance the control accuracy of the average air/fuel ratio AFAVE over the entire range of the points of operation of the average air/fuel ratio AFAVE. At the same time, the controlling constants are set to continuously change with respect to a change in the average air/fuel ratio AFAVE.

As a result, in accordance with the operating conditions, appropriate controlling constants can be combined with each other to maximize the advantage of each of the controlling constants.

Next, referring to the flowchart of FIG. 33 in addition to FIG. 10, a control cycle correction calculation routine for calculating control cycle correction shown in Step S108 in FIG. 10 will be described.

The calculation routine is executed, for example, every five milliseconds.

When a response delay in the first air/fuel ratio feedback control means 34 is varied by a time variation or a production variation, a change occurs in shift amount of the average air/fuel ratio AFAVE even if the balance setting of each of the controlling constants remains unchanged. As a changing response delay, there are a response delay of the fuel system from the fuel adjustment to the air/fuel ratio on the upstream side of the catalyst, which is caused by a change in the dead time Lf or the time constant. Tf of the fuel system, and a response delay of the $O_2$ sensor from the air/fuel ratio on the upstream side of the catalyst to the upstream $O_2$ sensor 20, which is caused by a change in the time constant To of the upstream $O_2$ sensor 20.

A change in response delay of the fuel system is caused by a change in delay from the adhesion of the injected fuel to a wall surface of the combustion chamber 4 to its evaporation or the like. A change in response delay of the ° 2 sensor is caused by a time variation, a production variation or the like. The upstream $O_2$ sensor 20 has a relatively large time variation due to a high-temperature atmosphere, poisoning or the like and therefore has a relatively large change in response delay.

A change in response delay can be detected by a change in control cycle. Specifically, when the response delay becomes larger, the delay in the feedback control also becomes large to increase the control cycle. The change amount in response delay can be calculated by the comparison between a measured control cycle and a reference control cycle.

Therefore, by correcting the controlling constants in accordance with the change amount in response delay, a change in shift amount of the average air/fuel ratio AFAVE can be prevented from occurring.

First, the control cycle is measured (Step S111).

The control cycle corresponds to an interval of switching the shift direction of the average air/fuel ratio AFAVE between the rich side and the lean side, specifically, an interval for adding the skip amount RSL, an interval for adding the skip amount RSR, or an interval between t2 and t8 shown in FIG. 5. The control cycle is measured by a timer (not shown) provided in the controller 22.

Subsequently, the reference control cycle is calculated (Step S112).

The reference control cycle is a control cycle when there is no time variation or production variation, and can be experimentally set.

Since the control cycle varies in accordance with the balance setting of the controlling constants, it is necessary to set the reference control cycle in consideration of the balance setting of the controlling constants.

Although the balance setting of the controlling constants is determined in accordance with the target average air/fuel ratio AFAVEobj, the reference control cycle is stored in accordance with the target average air/fuel ratio AFAVEobj or the balance setting as shown in FIGS. 34A and 34B. Specifically, for example, a one-dimensional map is provided for each operating condition for which the controlling constants are set to determine the balance setting.

Next, it is judged whether the update condition of the control cycle change amount has been established or not (Step S113).

The update condition of the control cycle change amount is established when the first air/fuel ratio feedback control is steadily executed. For example, the update condition of the control cycle change amount is established in the case where a predetermined control cycle has elapsed after the start of the first air/fuel ratio feedback control, in the case where a predetermined control cycle has elapsed after the switching of the operating condition for which the controlling constants are set, in the case where the cooling water temperature THW is a predetermined temperature or higher, or the like.

In these cases, the predetermined control cycle and the predetermined temperature are arbitrary set.

In Step S113, if it is judged that the update condition of the control cycle change amount has been established (specifically, Yes), the control cycle change amount is updated (Step S114).

In this step, the reference control cycle and the measured control cycle are compared with each other to calculate the change amount. The change amount is calculated from a ratio of the control cycles or a difference between the control cycles. Since the first air/fuel ratio feedback control is always affected by various disturbances, the measured control cycle is temporarily varied to temporarily vary the control cycle change amount. Therefore, in order to reduce the temporary variation, a filter process or learning control is performed on the change amount.

The change in response delay varies depending on the operating conditions. Therefore, a filter process value or a learning value is stored in the backup RAM 26 for each of the operating conditions. The filter process value or the learning value is switched to another value in accordance with the switching of the operating conditions.

As a result, the filter process value or the learning value is reset upon stop or restart of the internal combustion engine to prevent the control performance from being deteriorated.

The filter process value or the learning value serves as the control cycle change amount.

On the other hand, in Step S113, if it is judged that the update condition of the control cycle change amount has not been established (specifically, No), the process immediately proceeds to Step S115.

Subsequently, a correction amount of each of the controlling constants is calculated (Step S115).

In this step, a correction amount of each of the controlling constants is calculated in accordance with the control cycle change amount. For example, a one-dimensional map is provided for each of the operating conditions for which the controlling constants are set so as to set the correction amount of each of the controlling constants.

The correction amount is set to eliminate the shift amount of the average air/fuel ratio AFAVE, which changes in accordance with the control cycle. For example, a change is forcibly generated in response delay to obtain a change amount of the control cycle and a change in shift amount of the average air/fuel ratio AFAVE for each target average air/fuel ratio AFAVEobj, thereby obtaining the correction amount of the controlling constant.

The correction amount can also be obtained from the simply measured ratio of the average air/fuel ratio AFAVE and the target average air/fuel ratio AFAVEobj or the difference therebetween. Such a correction amount can be confirmed through an experiment or a numerical calculation using a physical model to be finely adjusted.

The controlling constant to be corrected and the controlling constant not to be corrected may be determined in advance to set the correction amount only for the controlling constant to be corrected.

Figure 33:
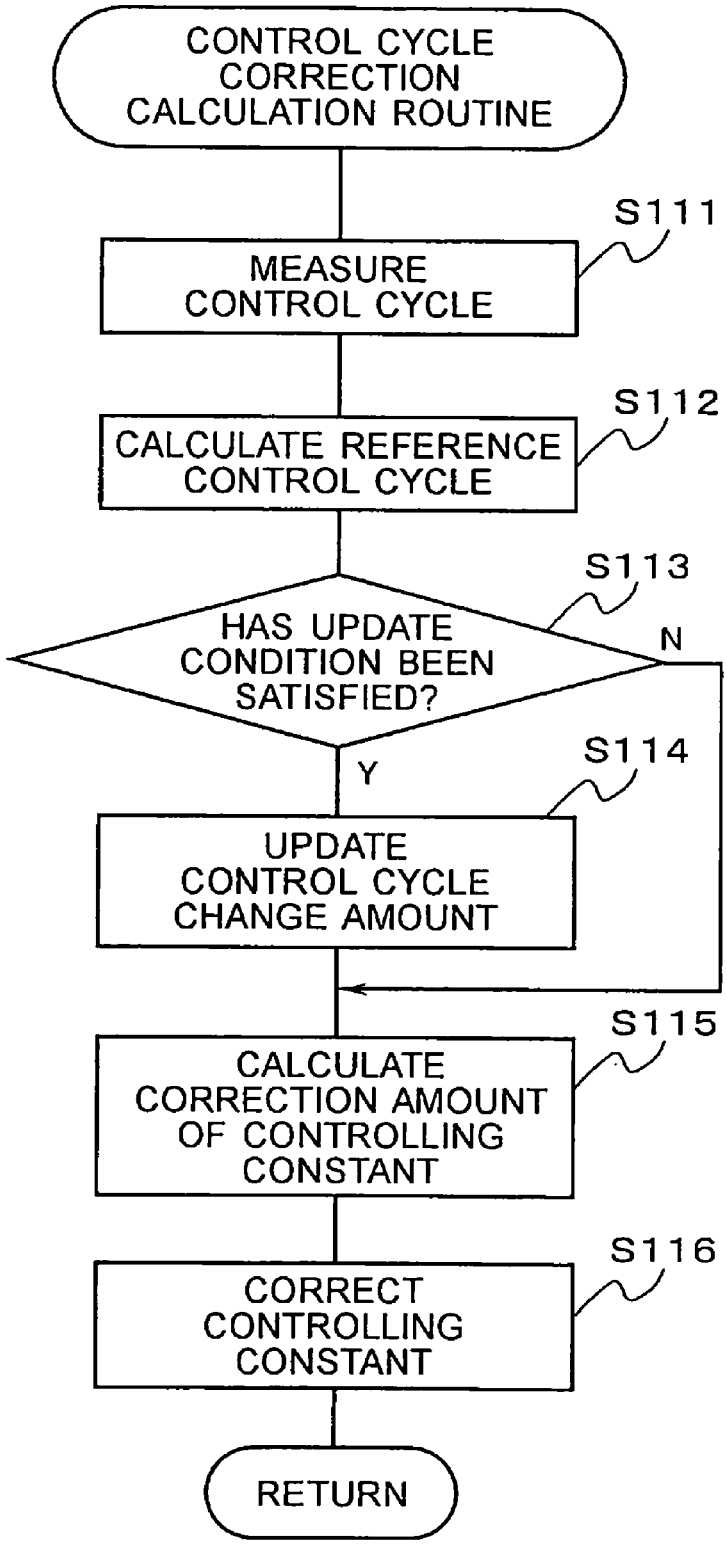
FIG. 33 is a flowchart showing a control cycle correction calculation routine for calculating control cycle correction shown in Step S108 of FIG. 10.

Next, each of the controlling constants is corrected by using the correction amount of the controlling constant by four arithmetic operations such as multiplication or addition (Step S116) to terminate the process shown in FIG. 33.

In Steps S115 and S116 described above, the correction amount of the controlling constant is calculated to correct the controlling constant based on the correction amount. However, these steps are not limited thereto. In Steps S115 and S116, the correction amount of the target average air/fuel ratio AFAVEobj may be calculated.

Even when the target average air/fuel ratio AFAVEobj is to be corrected, the controlling constants can be changed so as to eliminate the shift amount of the average air/fuel ratio AFAVE. Therefore, the same effect as in the case of correction of the controlling constants can be produced.

Hereinafter, referring to FIGS. 35 to 38, the behavior of the average air/fuel ratio AFAVE according to this embodiment will be described in comparison with the related art.

First, as shown in a timing chart of FIG. 35, with the use of the second air/fuel ratio feedback control means 32 as a PI controller, the behavior of the average air/fuel ratio AFAVE in the case where the proportional gain Kp2 and the integral gain Ki2 are simple fixed gains will be described.

Specifically, a proportional shift amount Kp2 (ΔV2) is obtained by Kp2×ΔV2, whereas an integral shift amount Σ(Ki2 (ΔV2)) is obtained by Σ(Ki2×ΔV2).

Figure 35:
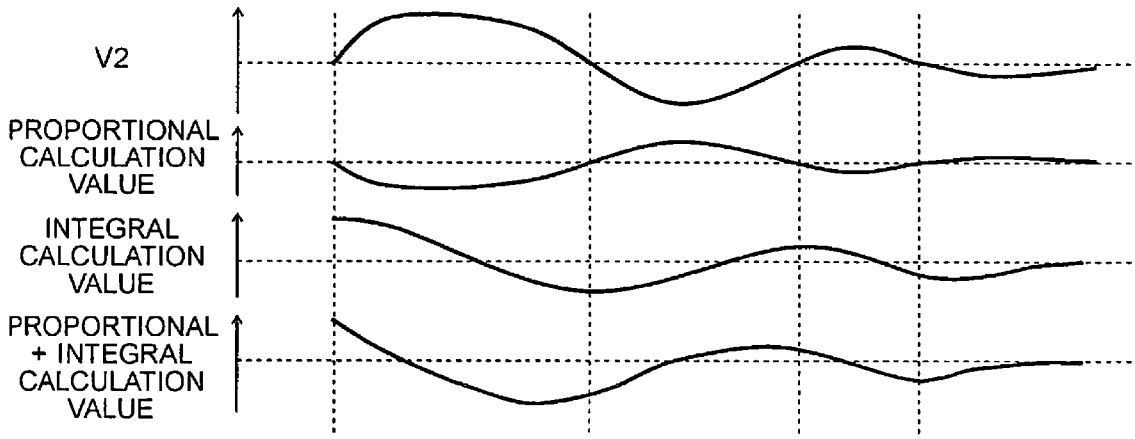
FIG. 35 is a timing chart showing a second air/fuel ratio feedback control according to the first embodiment of the present invention.
Figure 36:
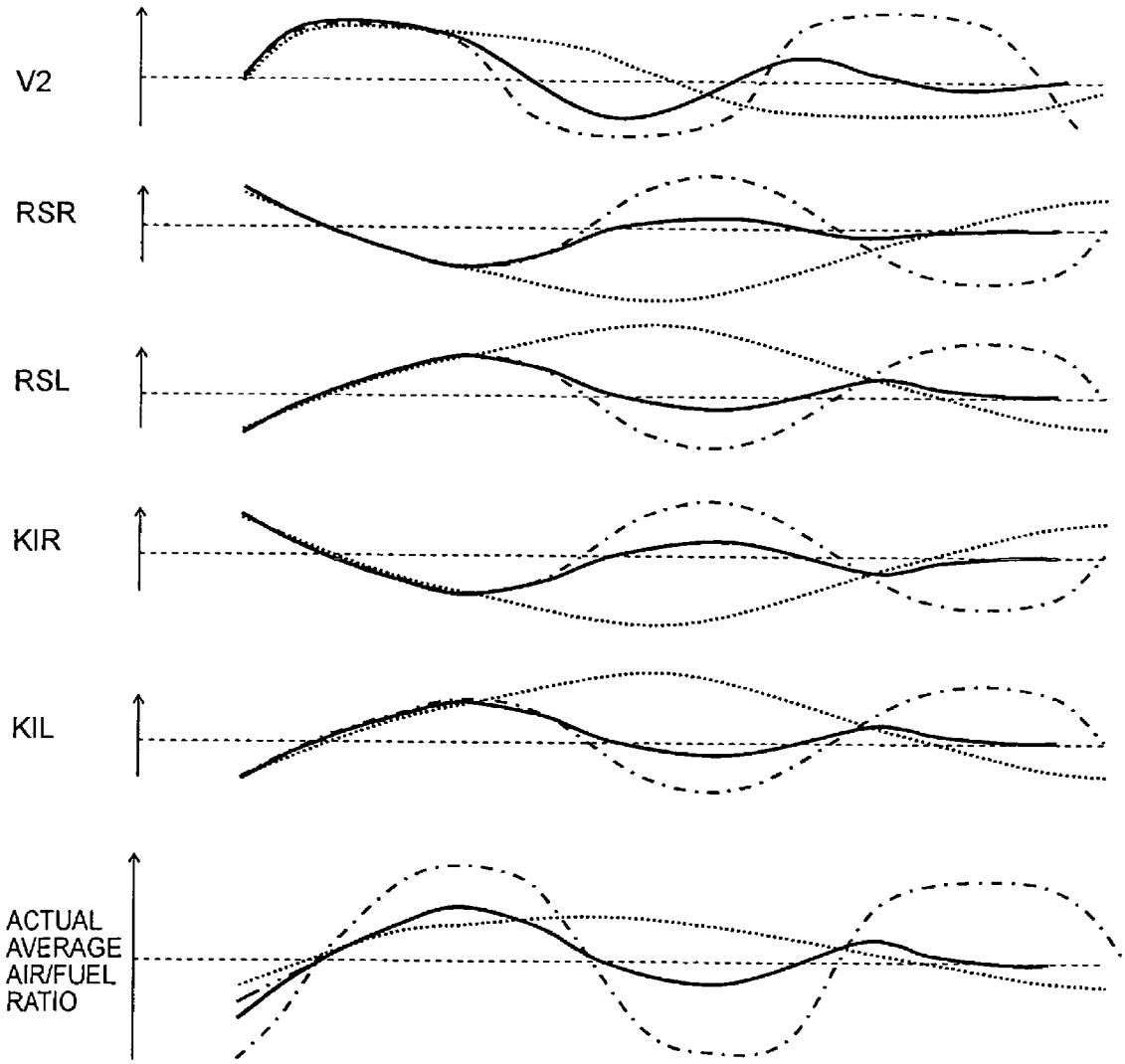
FIG. 36 is a timing chart showing behavior of an average air/fuel ratio according to the related art.

FIG. 36 is a timing chart showing the behavior of the average air/fuel ratio AFAVE in the case where two or more controlling constants (specifically, for example, the skip amounts RSR and RSL and the integral constants KIR and KIL) are respectively controlled by the second air/fuel ratio feedback control shown in FIG. 35 with the use of the related art.

In FIG. 36, by simultaneously controlling two or more controlling constants, the above-described interaction occurs. Then, the operating conditions are changed to change the behavior of the average air/fuel ratio AFAVE as indicated by solid lines, dot lines and chain lines.

The interaction between the controlling constants exhibits various changes in a nonlinear manner depending on the set value of each of the controlling constants, the combination of the controlling constants, the point of operation of the balance setting of each of the controlling constants, the responsiveness of the control target, which changes in accordance with the operating conditions, and the like.

Therefore, if two or more controlling constants are simultaneously controlled without setting a common management index as in the related art, the effect of the interaction cannot be controlled.

Therefore, the gain of the feedback control varies to also vary the shift amount of the average air/fuel ratio AFAVE controlled by the second air/fuel ratio feedback control. As a result, hunting as indicated by the chain line or unsatisfactory following as indicated by the dot line occurs to destabilize the second air/fuel ratio feedback control.

Figure 37:
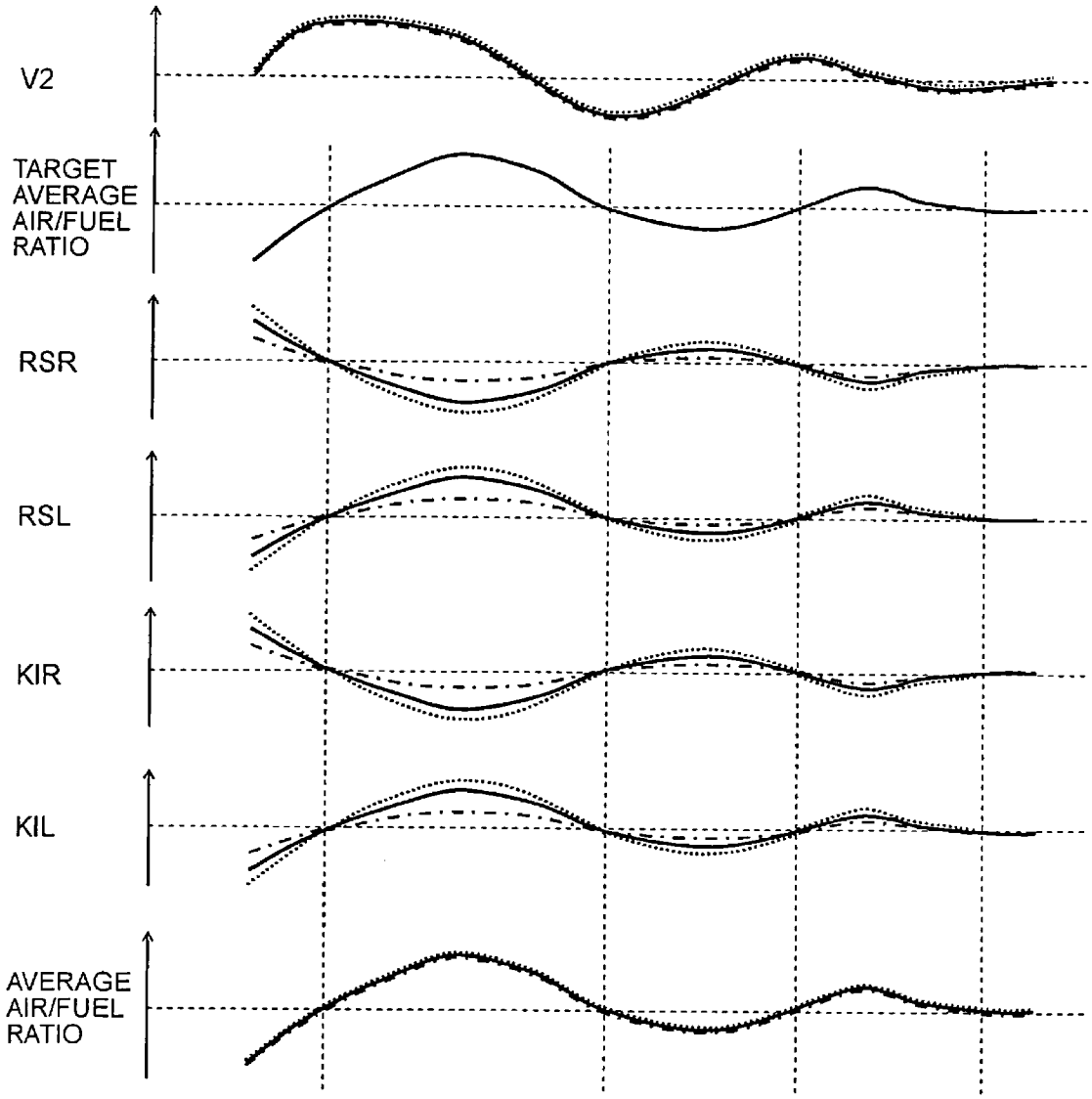
FIG. 37 is a first timing chart showing behavior of the average air/fuel ratio according to the first embodiment of the present invention.

FIG. 37 is a first timing chart showing the behavior of the average air/fuel ratio AFAVE according to the first embodiment of the present invention.

In FIG. 37, the target average air/fuel ratio AFAVEobj corresponding to a common management index is first calculated by the second air/fuel ratio feedback control.

By the conversion means 33, at least two controlling constants (specifically, the skip amounts RSR and RSL and the integral constants KIR and KIL) are calculated from the target average air/fuel ratio AFAVEobj through the one-dimensional map.

The set values of the controlling constants are preset to reflect the above-described interaction which changes depending on the operating conditions and the like.

Therefore, the behavior of the average air/fuel ratio AFAVE does not change depending on the operating condition as indicated by a solid line, a dot line and a chain line. As a result, the constantly stable second air/fuel ratio feedback control can be implemented.

Figure 38:
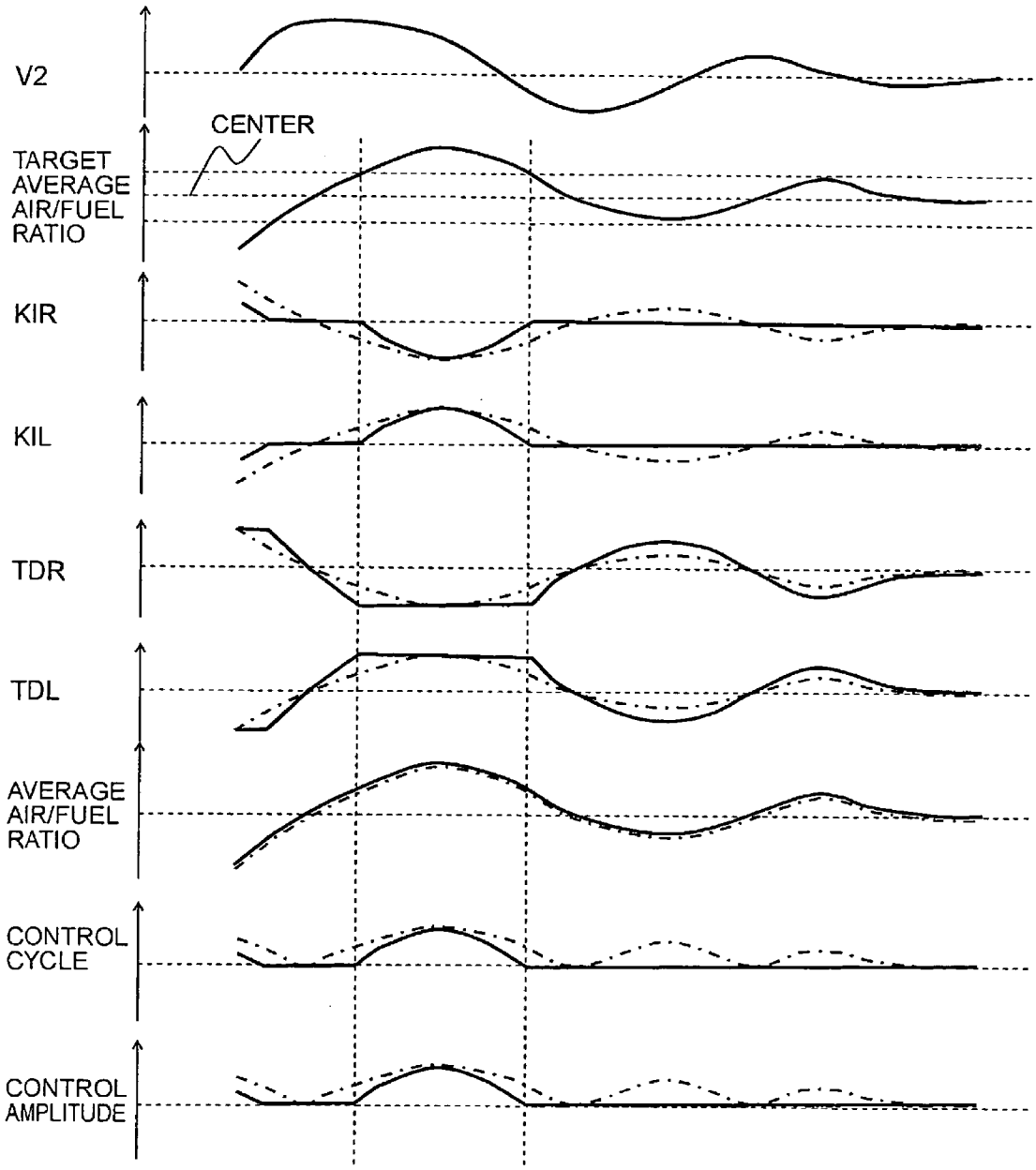
FIG. 38 is a second timing chart showing the behavior of the average air/fuel ratio according to the first embodiment of the present invention.

FIG. 38 is a second timing chart showing the behavior of the average air/fuel ratio AFAVE according to the first embodiment of the present invention.

In FIG. 38, as indicated by solid lines, the controlling constants are set in accordance with the point of operation of the target average air/fuel ratio AFAVEobj. Specifically, as shown in FIG. 30, while the shift amount of the average air/fuel ratio AFAVE is small, the balance between the delay times TDR and TDL is set large. As the shift amount of the average air/fuel ratio AFAVE becomes larger, the balance between the integral constants KIR and KIL is set large.

Therefore, the control cycle and the control amplitude of the air/fuel ratio can be adjusted in accordance with the target average air/fuel ratio AFAVEobj while maintaining the shift amount of the average air/fuel ratio AFAVE.

On the other hand, as indicated by chain lines, in the case of the related art where a common management index is not set, it is difficult to set the control amounts and the combination of the controlling constants in accordance with the point of operation of the average air/fuel ratio AFAVE while maintaining the shift amount of the average air/fuel ratio AFAVE.

As described above, the target average air/fuel ratio AFAVEobj corresponding to a common management index is calculated by the second air/fuel ratio feedback control, whereas at least two controlling constants are calculated by the control means from the target average air/fuel ratio AFAVEobj.

Therefore, the appropriate controlling constants are combined with each other to take advantage of the freedom of each of the controlling constants so as to maximize the advantage of the controlling constants (for example, the control accuracy or the shift range of the average air/fuel ratio AFAVE, the control cycle, the control amplitude of the air/fuel ratio and the like) while maintaining the shift amount of the average air/fuel ratio AFAVE. As a result, the shift amount of the average air/fuel ratio AFAVE can be finely controlled.

Figure 39:
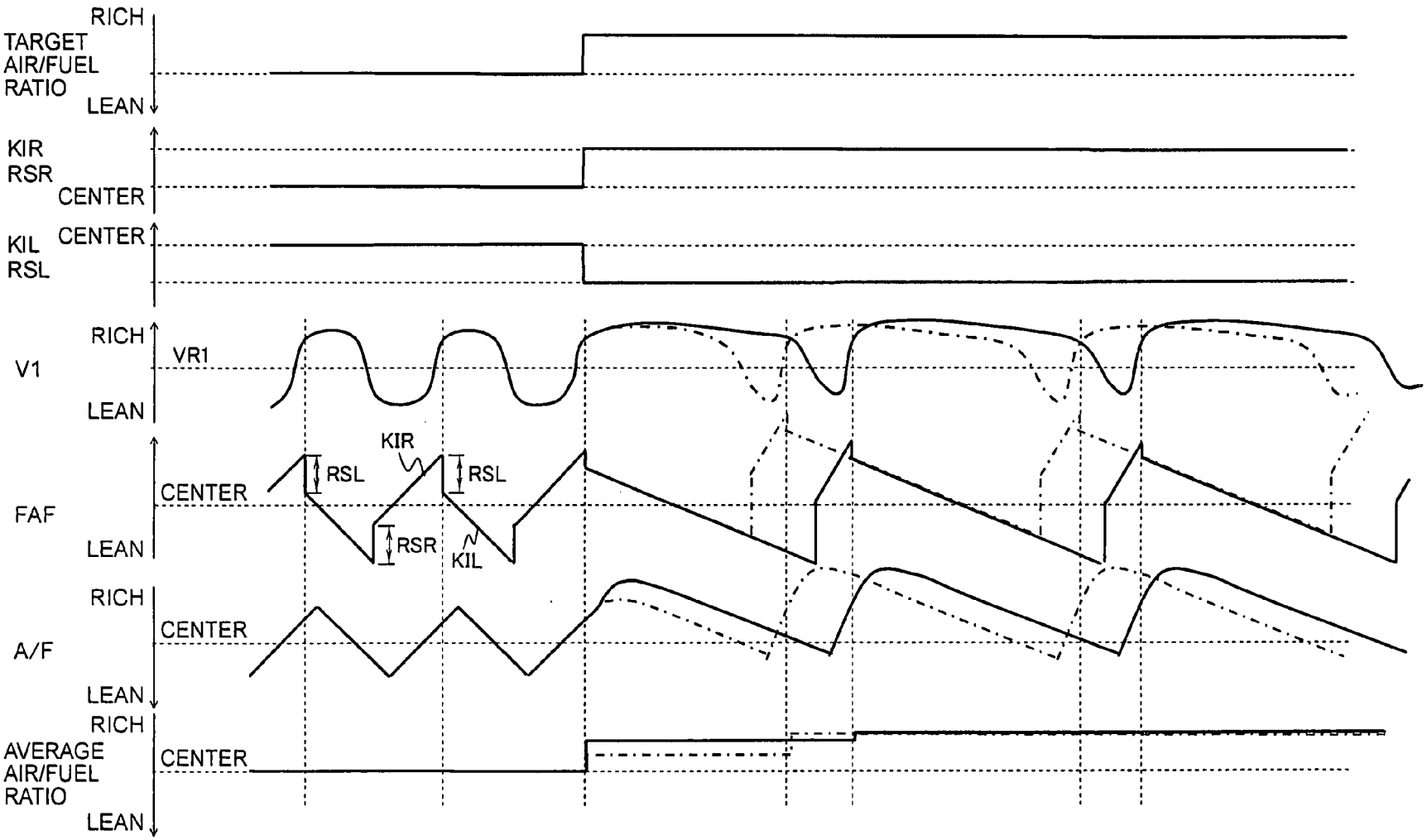
FIG. 39 is a timing chart showing the behavior of the average air/fuel ratio when a fuel supply quantity is controlled by using feedforward control according to the first embodiment of the present invention.

FIG. 39 is a timing chart showing the behavior of the average air/fuel ratio AFAVE when the feedforward control according to the first embodiment of the present invention is used to control the fuel supply quantity.

In this case, the behavior of the average air/fuel ratio AFAVE before and after a stepwise change of the target average air/fuel ratio AFAVEobj to the rich side is shown.

In FIG. 39, solid lines indicate the behavior of the average air/fuel ratio AFAVE in the case where the feedforward control is used, whereas chain lines indicate the behavior of the average air/fuel ratio AFAVE in the case where the feedforward control is not used.

The average air/fuel ratio AFAVE for one control cycle immediately after the occurrence of a change in the target average air/fuel ratio AFAVEobj has a higher following speed in the case where the feedforward control is used than in the case where the feedforward control is not used.

Although the fuel adjustment factor FAF is stabilized in the vicinity of the center in the case where the feedforward control is used, the fuel adjustment factor FAF is shifted in the shift direction of the average air/fuel ratio AFAVE in the case where the feedforward control is not used.

As described above, since the air/fuel ratio of the exhaust gas on the upstream side of the catalyst is related with the target average air/fuel ratio AFAVEobj, it is possible to perform the feedforward control on the fuel supply quantity.

Therefore, a following delay of the feedback control when the target average air/fuel ratio AFAVEobj changes can be improved, while the fuel adjustment factor FAF can be maintained in the vicinity of its center.

According to the control device for the internal combustion engine according to the first embodiment of the present invention, the second air/fuel ratio feedback control means 32 calculates the target average air/fuel ratio AFAVEobj corresponding to the target value of the average air/fuel ratio AFAVE of the exhaust gas on the upstream side of the catalyst in accordance with the sensor output V2 from the downstream $O_2$ sensor 21 and the output target value VR2. The conversion means 33 uses the target average air/fuel ratio AFAVEobj as an index to calculate at least two controlling constants.

Therefore, the control amount or the combination of the controlling constants can be set in accordance with the target average air/fuel ratio AFAVEobj to enable stable and accurate control of the air/fuel ratio of the exhaust gas on the upstream side of the catalyst.

Moreover, by setting the controlling constants with the use of the target average air/fuel ratio AFAVEobj as an index, appropriate controlling constants are combined with each other to maximize the advantage of each of the controlling constants (for example, the control accuracy of the average air/fuel ratio AFAVE, the shift range, the control cycle, and the control amplitude of the air/fuel ratio and the like) in accordance with the point of operation of the average air/fuel ratio AFAVE without changing the shift amount of the average air/fuel ratio AFAVE, thereby enabling fine control of the shift amount of the average air/fuel ratio AFAVE.

Although the second air/fuel ratio sensor has been described as the downstream $O_2$ sensor 21 in the first embodiment described above, the second air/fuel ratio sensor is not limited thereto. The second air/fuel ratio sensor may be any sensor as long as the second air/fuel ratio sensor is capable of detecting a cleaning state of the catalyst on the upstream side.

Therefore, even a linear air/fuel ratio sensor, an $NO_x$ sensor, an HC sensor, a CO sensor or the like can detect a cleaning state of the catalyst to produce the same effect.

Moreover, although the second air/fuel ratio feedback control means 32 has been described as a PI controller for executing a proportional calculation and an integral calculation in the first embodiment described above, the second air/fuel ratio feedback control means 32 may also execute a differential calculation.

Even in such a case, the feedback control can also be executed to produce the same effect.

Furthermore, although the second air/fuel ratio feedback control means 32 uses the proportional calculation and the integral calculation to calculate the target average air/fuel ratio AFAVEobj based on the sensor output V2 from the downstream $O_2$ sensor 21 and the output target value VR2 in the first embodiment described above, the second air/fuel ratio feedback control means 32 is not limited thereto.

The second air/fuel ratio feedback control means 32 may use, for example, state feedback control in the modern control theory, sliding mode control, observer, adaptive control, $H\infty$ control or the like based on the sensor output V2 from the downstream $O_2$ sensor 21 and the output target value VR2 to calculate the target average air/fuel ratio AFAVEobj.

Even in this case, the cleaning state of the catalyst can be controlled to produce the same effect.

What is claimed is:

1. A control device for an internal combustion engine, comprising:

a catalyst provided in an exhaust system of the internal combustion engine, for cleaning an exhaust gas;

a first air/fuel ratio sensor provided to an upstream side of the catalyst, for detecting an air/fuel ratio of the exhaust gas on the upstream side of the catalyst;

a second air/fuel ratio sensor provided to a downstream side of the catalyst, for detecting an air/fuel ratio of the exhaust gas on the downstream side of the catalyst;

a first air/fuel ratio feedback control means for controlling the air/fuel ratio of the exhaust gas on the upstream side of the catalyst based on an output value of the first air/fuel ratio sensor and a controlling constant group containing a plurality of controlling constants;

a second air/fuel ratio feedback control means for calculating a target average air/fuel ratio corresponding to a target value of an average air/fuel ratio of the exhaust gas on the upstream side of the catalyst based on an output value of the second air/fuel ratio sensor and a predetermined output target value; and a conversion means for calculating at least two controlling constants of the controlling constant group by using the target average air/fuel ratio as a common index.

2. A control device for an internal combustion engine according to claim 1, wherein the controlling constant is any one of a delay time, a skip amount, an integral constant, and a reference voltage.

3. A control device for an internal combustion engine according to claim 1, wherein controlling constant is set for each operating condition.

4. A control device for an internal combustion engine according to claim 1, wherein a forced variation is applied to the target average air/fuel ratio with a predetermined amplitude in a predetermined cycle.

5. A control device for an internal combustion engine according to claim 4, wherein the forced variation is applied upon failure diagnosis.

6. A control device for an internal combustion engine according to claim 4, wherein a value changed from a normal value is used as a gain in the second air/fuel ratio feedback means for a period in which the forced variation is applied.

7. A control device for an internal combustion engine according to claim 1, wherein the second air/fuel ratio feedback control means performs a proportional calculation and uses a value changed from a normal value as a gain of the proportional calculation in the second air/fuel ratio feedback control means over a transient operation period of the internal combustion engine.

8. A control device for an internal combustion engine according to claim 1, wherein the second air/fuel ratio feedback control means uses values changed from normal values as upper and lower limit values of the target average air/fuel ratio over a transient operation period of the internal combustion engine.

9. A control device for an internal combustion engine according to claim 1, wherein the second air/fuel ratio feedback control means performs a proportional calculation and uses a value changed from a normal value as a gain of the proportional calculation in the second air/fuel ratio feedback control means over a predetermined period after a transient operation of the internal combustion engine.

10. A control device for an internal combustion engine according to claim 1, wherein the second air/fuel ratio feedback control means uses values changed from normal values as upper and lower limit values of the target average air/fuel ratio over a predetermined period after a transient operation of the internal combustion engine.

11. A control device for an internal combustion engine according to claim 1, wherein the second air/fuel ratio feedback control means performs an integral calculation and stops updating the integral calculation by the second air/fuel ratio feedback control means over a transient operation period of the internal combustion engine and a predetermined period after the transient operation.

12. A control device for an internal combustion engine according to claim 9, wherein the predetermined period after the transient operation is a period after termination of the transient operation of the internal combustion engine until an integrated air quantity reaches a predetermined value.

13. A control device for an internal combustion engine according to claim 1, wherein the output of the first air/fuel ratio feedback control means is corrected based on the target average air/fuel ratio.

14. A control device for an internal combustion engine according claim 1, wherein the second air/fuel ratio feedback control means detects a control cycle of the first air/fuel ratio feedback control means to correct the controlling constant based on the target average air/fuel ratio.

15. A control device for an internal combustion engine, comprising:

a catalyst provided in an exhaust system of the internal combustion engine, which cleans an exhaust gas;

a first air/fuel ratio sensor which is located on an upstream side of the catalyst and detects an air/fuel ratio of the exhaust gas on the upstream side of the catalyst;

a second air/fuel ratio sensor which is located on a downstream side of the catalyst and detects an air/fuel ratio of the exhaust gas on the downstream side of the catalyst;

a first air/fuel ratio feedback control unit which controls the air/fuel ratio of the exhaust gas on the upstream side of the catalyst based on an output value of the first air/fuel ratio sensor and a controlling constant group containing a plurality of controlling constants;

a second air/fuel ratio feedback control unit which calculates a target average air/fuel ratio corresponding to a target value of an average air/fuel ratio of the exhaust gas on the upstream side of the catalyst based on an output value of the second air/fuel ratio sensor and a predetermined output target value; and a conversion unit which calculates at least two controlling constants of the controlling constant group using the target average air/fuel ratio as a common index, wherein the controlling constant is any one of a delay time, a skip amount, an integral constant, and a reference voltage.

* * * * *